US008123212B1

(12) United States Patent
Blair et al.

(10) Patent No.: US 8,123,212 B1
(45) Date of Patent: Feb. 28, 2012

(54) METHOD AND APPARATUS FOR ADJUSTING MEDIA POSITIONING AND INDEXING USING AN ENCODER IN AN IMAGE FORMING DEVICE

(75) Inventors: Brian Allen Blair, Richmond, KY (US); Dustin Daniel Fichter, Lexington, KY (US); Derek Masami Inouye, Lexington, KY (US); Jeffrey Lawrence Tonges, Versailles, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/916,441

(22) Filed: Oct. 29, 2010

(51) Int. Cl.
*B65H 1/08* (2006.01)

(52) U.S. Cl. ..... 271/126; 271/117; 271/127; 271/147; 271/153

(58) Field of Classification Search ..... 271/117, 271/118, 126, 127, 147, 153
See application file for complete search history.

(56) References Cited

U.S. PATENT DOCUMENTS

| | | | | |
|---|---|---|---|---|
| 4,832,329 | A * | 5/1989 | Rodi et al. | 271/155 |
| 6,000,689 | A * | 12/1999 | Furuki et al. | 271/126 |
| 7,971,868 | B2 * | 7/2011 | Matsushima et al. | 271/126 |
| 8,016,283 | B2 * | 9/2011 | Ueda et al. | 271/127 |
| 8,025,284 | B2 * | 9/2011 | Ikeuchi et al. | 271/126 |
| 2003/0085506 | A1 * | 5/2003 | Kubo | 271/126 |
| 2010/0072691 | A1 * | 3/2010 | Ueda et al. | 271/126 |

* cited by examiner

*Primary Examiner* — Gerald McClain
(74) *Attorney, Agent, or Firm* — Justin M. Tromp; John Victor Pezdek

(57) ABSTRACT

A method for indexing a lift plate in an image forming device according to one exemplary embodiment includes driving a motor in a first direction to drive a pick mechanism for feeding media from a stack of media sheets on a raisable lift plate such that as media is fed the height of the pick mechanism decreases. When the height of the pick mechanism falls below a predetermined level, the motor is driven a predetermined amount of rotation in a second direction opposite the first direction to raise the lift plate in order to raise the pick mechanism to a desired pick height.

8 Claims, 46 Drawing Sheets

METHOD AND APPARATUS FOR ADJUSTING MEDIA POSITIONING AND INDEXING USING AN ENCODER IN AN IMAGE FORMING DEVICE

CROSS REFERENCES TO RELATED APPLICATIONS

This patent application is related to the following United States Patent Applications:

U.S. patent application Ser. No. 12/915,999, filed Oct. 29, 2010, entitled "METHOD AND APPARATUS FOR FEEDING COMPRESSIBLE MEDIA IN AN IMAGE FORMING DEVICE";

U.S. patent application Ser. No. 12/916,040, filed Oct. 29, 2010, entitled "METHOD FOR DETERMINING THE AMOUNT OF MEDIA SHEETS IN A MEDIA TRAY IN AN IMAGE FORMING DEVICE";

U.S. patent application Ser. No. 12/916,333, filed Oct. 29, 2010, entitled "REMOVABLE INPUT TRAY ASSEMBLY HAVING AN INTEGRATED ROLLER NIP FOR AN IMAGE FORMING DEVICE";

U.S. patent application Ser. No. 12/916,361, filed Oct. 29, 2010, entitled "METHOD FOR POSITIONING AND FEEDING MEDIA INTO A MEDIA FEED PATH OF AN IMAGE FORMING DEVICE";

U.S. patent application Ser. No. 12/916,379, filed Oct. 29, 2010, entitled "RAISABLE LIFT PLATE SYSTEM FOR POSITIONING AND FEEDING MEDIA IN AN IMAGE FORMING DEVICE";

U.S. patent application Ser. No. 12/916,397, filed Oct. 29, 2010, entitled "DETACHABLE REVERSIBLE PICK MECHANISM FOR FEEDING MEDIA FROM A MEDIA TRAY OF AN IMAGE FORMING DEVICE";

U.S. patent application Ser. No. 12/916,426, filed Oct. 29, 2010, entitled "CONTINUOUS MEDIA EDGE REFERENCE SURFACE FOR REMOVABLE MEDIA INPUT TRAY ASSEMBLY OF AN IMAGE FORMING DEVICE";

U.S. patent application Ser. No. 12/916,429, filed Oct. 29, 2010, entitled "SYSTEM FOR FEEDING AND SEPARATING MEDIA IN AN IMAGE FORMING DEVICE";

U.S. patent application Ser. No. 12/916,433, filed Oct. 29, 2010, entitled "REMOVABLE MEDIA DAM FOR A MEDIA TRAY OF AN IMAGE FORMING DEVICE"; and U.S. patent application Ser. No. 12/916,446, filed Oct. 29, 2010, entitled "REMOVABLE INPUT TRAY ASSEMBLY HAVING A DUAL FUNCTION ROLLER FOR FEEDING MEDIA AND SEPARATING MEDIA IN AN IMAGE FORMING DEVICE".

Each of the foregoing applications is assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The field relates generally to media input feed systems for an image forming device ("IFD") having a removable input tray.

2. Description of the Related Art

IFDs, such as printers, scanners and photocopiers utilize media feed mechanisms for feeding various types of media sheets into the IFDs. Examples of the various types of media sheets include, but are not limited to, printing paper, bond paper, coated paper, fabrics, transparencies and labels. Almost all of the media feed mechanisms include a pick roller that feeds a media sheet into the IFD for further processing. In a media feed mechanism, various arrangements of the pick roller may exist for feeding the media sheet into the IFD.

In one such arrangement of a media feed mechanism, the pick roller may be coupled with other components of the media feed mechanism to exert a normal force on the media sheet. Examples of the other components that may be coupled to the pick roller include solenoids, cams, pick arms, gears, shafts, and the like. Simultaneously, the pick roller may be rotated due to the coupling with the other components to push the media sheet into the IFD due to friction between the pick roller and the media sheet. Herein, pushing the media sheet into the IFD refers to pushing the media sheet in a media process direction into a specific section of the IFD, for example, pushing the media sheet into a 'printing zone' where the IFD is a printer.

In existing media feed mechanisms, the normal force, which is applied substantially perpendicular to the flat surface of the media sheet by the pick roller, is generally of a constant value for all types of the media sheets. For example, the pick roller may exert a constant normal force on a bond paper, as well as, a transparency. As is known, media may have different densities, weights, thicknesses and stiffnesses. Further, the normal force required to feed one type of media into the IFD may be greater than the normal force required to feed another type of media. Accordingly, due to the application of the constant normal force on all types of the media sheets in existing media feed mechanisms, multiple feeds or misfeeds of the media sheet may occur.

Further, over time the normal force exerted by the pick roller may decrease due to wear of the pick roller. However, the existing media feed mechanisms may not facilitate increasing the normal force exerted by the pick roller on the media. This limitation may result in replacement of the pick roller in the IFD.

Upon coming in contact with a media sheet, a pick roller applies a normal force (referred to as 'N') on the media sheet. Further, there exists a coefficient of friction μ between pick roller and the media sheet. The rotation of the pick roller along with normal force and the coefficient of friction μ result in a driving force in a direction, such that, the media sheet is fed into the IFD. Normal force, the coefficient of friction μ (referred to as 'μ') and driving force (referred to as 'D') may be related by the following equation:

$$D=\mu*N$$

As per the relation in the above equation, normal force N is directly proportional to driving force D. It will be evident to a person skilled in the art that a particular value of driving force D drives the media sheet into the IFD. However, it is also evident from the above equation that driving force D also depends upon the coefficient of friction μ, and accordingly any variation in the coefficient of friction μ may vary driving force D. The coefficient of friction (μ) may differ for various types of the media sheet.

It will be evident to a person skilled in the art that based on the relation provided above, the magnitude of normal force N may need to be increased when the coefficient of friction (μ) between the media sheet and a pick roller decreases, in order to maintain the particular value of driving force D required to feed the media sheet in the media processing device. Similarly, the magnitude of normal force N may need to be decreased when the coefficient of friction μ between the media sheet and a pick roller increases, to feed the media sheet in the media processing device.

IFDs typically include multiple input sources to introduce the media sheets into the media path. The input sources may accommodate a range of media types and a range of media sheet quantities from a single media sheet to large quantities such as 2,000 or more sheets. One type of input source is referred to as a removable media input tray ("RMIT") integrated within the same housing that contains the imaging units of the IFD. A multi-purpose feeder may also be provided on the image forming device housing or as part of the integrated media tray for accommodating a low number of media sheets and often for specialty media sheets that are difficult to feed through normal input trays, such as envelopes, transparencies, and cardstock.

Another input source is referred to as an option assembly typically comprising a housing and a removable media input tray that is slidably received into the option housing. These option assemblies are typically stackable allowing one or more option assemblies to be used with a single image forming device which is typically positioned on top of the uppermost option assembly in the option assembly stack. Typically each option assembly may contain a different type of media such as letterhead or a different size such as A4 or a larger quantity of the same media type that is found in the integrated RMIT.

Each option assembly provides an extension to the media path of the IFD and may provide one or more additional branches or avenues for introducing media into the media path of the IFD. The media path extension extends from the top to the bottom of each option assembly and is upstream of the media path in the IFD. When another option assembly is positioned below an option assembly, the media path extension permits media in the lower option assembly to be fed through the upper option assembly and into the media path of the IFD that extends at its upstream end through the front portion of the integrated media tray. To accomplish the feeding of media either from a RMIT in an option assembly or from another option assembly, feed rollers have been provided in each option housing above the media tray therein and in the media path extension to receive picked media either from a lower option assembly RMIT or from its own adjacent RMIT. One disadvantage of this arrangement is that the feed rollers increase the overall height of each of the option assemblies by 2 cm or more. If a large number of option assemblies are stacked together, this added height may raise the overall height of the image forming system by 10 to 20 cm sometimes requiring a user to choose between removing an option assembly and having to reach to obtain the output of the imaging forming system. It would be advantageous to have a lower height option assembly while still be able to provide for pass-thru media feeding.

With the addition of one or more option assemblies to an IFD, alignment of the media path extension between the various components and to the media path in the IFD becomes problematic due to variations in component tolerances, also known as "tolerance stackup." Misalignment of the reference surfaces can cause damage to the leading edge of the media or skewing of the media as it moves along the media path extensions and into the IFD. To correct this, alignment reference surfaces against which an edge of the media being fed have been provided in the media trays in the option assemblies. Typically, these reference surfaces are located only in the vicinity of the feed rolls in each option assembly. It would be advantageous to have a reference surface that minimizes this type of misalignment between options trays and between an option tray and the IFD.

Included in each option assembly are a pick mechanism for moving media from the media tray, a media positioning mechanism and one or more drive motors for powering the pick mechanism, media positioning mechanism, and one or more adjustable media restraints such as a side restraint and a rear restraint to accommodate for different media widths and lengths. Further included are media sensors for determining when media is present in the tray, the size of the media and/or the location of the leading and trailing edges of the media.

Most pick mechanisms are designed only for mounting in a single orientation and for feeding media in only a single direction. This is typically achieved through the use of a one-way clutch in the pick mechanism; although other prior art pick mechanisms employ no clutch even though media is fed in a single direction. With both the clutchless and clutched pick mechanisms, their design envisions only a single mode or orientation of mounting. Because an option assembly may be used with more than one type or model of IFD, it would be desirable to have a single pick mechanism that could be mounted in a variety of orientations and provide media feeding in more than one direction.

Conventional pick mechanisms are usually mounted over the media in the media tray on one or more steel rods that extend between the sides of the media tray. With such mounting arrangements it is difficult to remove or repair the pick mechanism and usually requires the intervention of a skilled technician. It would be advantageous if the pick mechanism could be easily removed and reinstalled by a user if repair or replacement were needed. Lastly, conventional pick mechanisms are designed to provide a normal force on the topmost media sheet to be fed that is sufficient to overcome friction with the media sheet immediately beneath. If the rotational direction of these pick mechanisms were reversed, the force would cause the trailing edge of the media sheet to be driven into the rear media restraint damaging the trailing edge. It would be advantageous to have a pick mechanism that could reduce or eliminate such damage.

For media trays that employ elevator or lift plate systems to position media, e.g. to raise the media into a pick position, a single or multiple motors may be used. With prior systems when the media tray was removed for refilling, the user was required to manipulate the media prior to be able to add more. For example, the user had to press down on the media to lower the elevator until caught by a latch. It would be advantageous to have a drive system that could operate both the pick mechanism and the elevator or lift plate with a common motor while also providing the user with a consistent presentation of the media in the media tray when the media tray is removed for refilling. This would reduce manufacturing cost, operating cost and lower weight and energy usage. Further it would be advantageous to utilize a lift plate that reduces the uncertainty in the location of the leading edge of the media as it indexed upward into the picking position.

It would also be advantageous to have a pick mechanism that would reduce the variability in positioning the leading edge of the media. This would allow for the spacing between fed media sheets to be reduced. This is also referred to as "interpage gap." Reducing interpage gap would increase media throughput without increasing the speed of the system and help to lessen wear and tear.

Media trays have a media dam integrally formed in their front wall that is used to help direct the fed media into the media path. Typically such media dams are at an obtuse angle to the direction of the initial movement of the media being picked. Media dams are known to include wear strips on their front or face. Wear strips are slightly raised surfaces on the front face extending vertically along the surface of the media dam in contact with the picked media and help to decrease friction and aid in corrugating the fed media. Separator rollers are typically provided downstream of the media dam within the housing of the option assembly above the RMIT or in the IFD above the RMIT therein. The separator rollers usually include a pair of opposed rollers forming a nip therebetween driven in the same direction so that one roller stops misfed sheets and the other allows a topmost sheet to be fed. They are used to reduce the chance of media misfeeds such as multiple feeds and shingling. In some instances, separator rollers of one type are changed out to another type depending on media type to be fed from the media tray. Because of their downstream location in the housing, this is at times an awkward process. Further, the location of the separator roller downstream of the media dam outside of the media tray means that for a misfed sheet, there is greater uncertainty in determining the location of the leading edge of the misfed media sheet. It would be advantageous to have a media dam that includes the separator rollers and still further is removably mounted in the media tray so as to be easily uninstalled and reinstalled by a user, to easily change the type and configuration of the separator rolls, and to reduce uncertainty in locating the leading edge of the media sheet of the media to be fed.

Prior pick mechanisms were designed to swing down into the media tray and onto the media stack. This means that the pick mechanism had to be long enough to reach the bottom of the media tray. Also, this means that the overall weight of the pick mechanism would be greater than a system where the pick mechanism does not need to travel to the media tray bottom. A drawback of this arrangement is that when compressible media, such as envelopes or labels having RFID tags, are being fed out of the media tray, the normal force provided by the pick mechanism is greater than needed with the result that the pick mechanism tends to dig into the compressible media further compressing the compressible media which will not separate. Even when an elevator is used to lift the media stack up to the pick mechanism, meaning that the pick mechanism can be shorter and lighter, a similar result occurs. Limiting the travel of the elevator tray does not correct this issue because the end result remains a compliant pick mechanism picking compliant media. In those IFDs where a vertical wall joins the media dam to the bottom of tray, the pick mechanism may compress the media to the point where it then feeds the media directly into the vertical wall thereby prohibiting the media from making it to the inclined media dam portion. For successful compressible media picking to occur, the picking system requires that there be only one compliant element. With both configurations, for normal media, the media and tray or media and elevator are non-compliant elements while the pick mechanism is the compliant element. Whereas for either configuration, when compressible media is present, both the compressible media and the pick mechanism are compliant elements. It would be advantageous to have a pick mechanism that can work reliably with either compressible media or non-compressible media.

In another aspect of media feed systems, determination of the location of the top of the media stack is important. For media elevating trays, when the tray is removed and reinserted, the location of the top of the media stack must be determined. This aids in determining the position of the leading edge of the media sheet that will be fed into the media path. Prior systems use a contact sensor or mechanical gas gauge hardware linkage which references the top of media stack or the lifting plate. It would be advantageous to have a media feed system where such sensors or linkages can be eliminated.

SUMMARY OF THE INVENTION

A method for indexing a lift plate in an image forming device according to one example embodiment includes driving a motor in a first direction to drive a pick mechanism for feeding media from a stack of media sheets on a raisable lift plate such that as media is fed the height of the pick mechanism decreases. When the height of the pick mechanism falls below a predetermined level, the motor is driven a predetermined amount of rotation in a second direction opposite the first direction to raise the lift plate in order to raise the pick mechanism to a desired pick height. In some embodiments, whether the height of the pick mechanism has fallen below the predetermined level is based on whether a sensor adjacent to the pick mechanism has changed from a first state to a second state as a result of the decrease in height of the pick mechanism.

A method for adjusting media position for media to be fed in an image forming device according to a second example embodiment includes determining a media type for a stack of media sheets on a raisable lift plate. When the media type determined is a first media type, the motor is driven in a first direction to drive a pick mechanism for feeding media in a media process direction from the stack of media sheets such that as media is fed the height of the pick mechanism decreases. It is determined whether the height of the pick mechanism has fallen below a predetermined level based on whether a sensor adjacent to the pick mechanism has changed from a first state to a second state as a result of the decrease in height of the pick mechanism. When the height of the pick mechanism falls below the predetermined level, the motor is driven a first predetermined amount of rotation in a second direction opposite the first direction to raise the lift plate in order to raise the pick mechanism to a first desired pick height. When the media type determined is a second media type, the motor is driven in the first direction to drive the pick mechanism for feeding media in the media process direction from the stack of media sheets such that as media is fed the height of the pick mechanism decreases. At least one of a number of media fed and an amount of rotation of the motor in the first direction is determined. When the at least one of the number of media fed and the amount of rotation of the motor in the first direction exceeds a predetermined threshold, the motor is driven a second predetermined amount of rotation in the second direction to raise the lift plate in order to raise the pick mechanism to a second desired pick height different from the first desired pick height.

In some embodiments, the state of the sensor is changed by a flag arm extending from the pick mechanism. Embodiments include those wherein the state of the sensor is analyzed between each media feed when the motor is not being driven in the first direction. In one embodiment, driving the motor the first predetermined amount of rotation in the second direction and driving the motor the second predetermined amount of rotation in the second direction raise the lift plate between about 1 mm and about 10 mm.

In some embodiments, the amount of rotation of the motor is determined using an output from an encoder wheel coupled to the motor.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
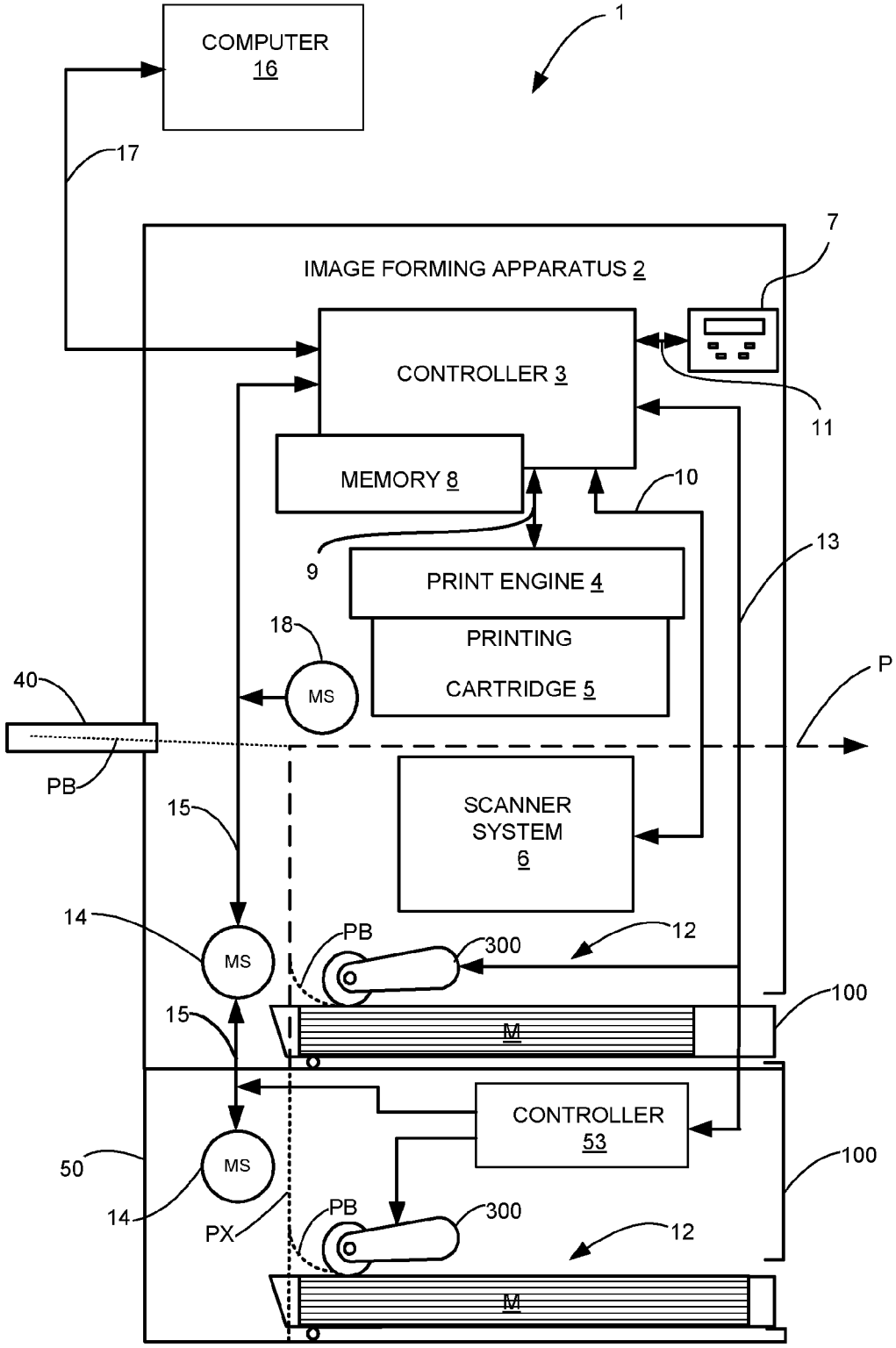
FIG. 1 is a schematic view of an imaging system according to one example embodiment.

It is to be understood that the present application is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this Detailed Description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and other alternative mechanical configurations are possible.

As used herein, the term "communications link" is used to generally refer to structure that facilitates electronic communication between multiple components, and may operate using wired or wireless technology. While several communication links are shown, it is understood that a single communication link may serve the same functions as the multiple communications links that are illustrated. As used herein, the term media width refers to the dimension of the media that is transverse to the direction of the media path. The term media length refers to the dimension of the media that is aligned to the direction of the media path. The media is said to move along the media path and the media path extensions from an upstream location to a downstream location as it moves from the media trays to the output area of the IFD. For each option tray, the top of the option tray is downstream from the bottom of the option tray. Conversely, the bottom of the option tray is upstream from the top of the option tray. Further, the media is conveyed using pairs of rollers that form nips therebetween. The term "nip" is used in the conventional sense to refer to a nip formed between two rollers that are located at about the same point in the media path and have a common point of tangency to the media path. With this nip type, the axes of the rollers are parallel to one another and are typically, but do not have to be, transverse to the media path. For example, a deskewing nip may be at an acute angle to the media feed path. The term "separated nip" refers to a nip formed between two rollers that are located at different points along the media path and have no common point of tangency with the media path. Again the axes of rotation of the rollers having a separate nip are parallel but are offset from one another along the media path. Nip gap refers to the space between two rollers. Nip gaps may be open, where there is an opening between the two rollers, zero where the two rollers are tangentially touching or negative where there is an interference between the two rollers. As used herein, the leading edge of the media is that edge which first enters the media path and the trailing edge of the media is that edge that last enters the media path. Depending on the orientation of the media in the media trays, the leading/trailing edges may be the short edge of the media or the long edge of the media, in that most media is rectangular. Further relative positional terms are used herein. For example, "superior" means that an element is above another element. Conversely "inferior" means that an element is below or beneath another element. "Media process direction" describes the movement of media within the imaging system as is generally meant to be from an input toward an output of the imaging system 1. The explanations of these terms along with the use of the terms "top," "bottom," "front," "rear," "left," "right," "up," and "down" are made to aid in understanding the spatial relationship of the various components and are not intended to be limiting.

Figure 2:
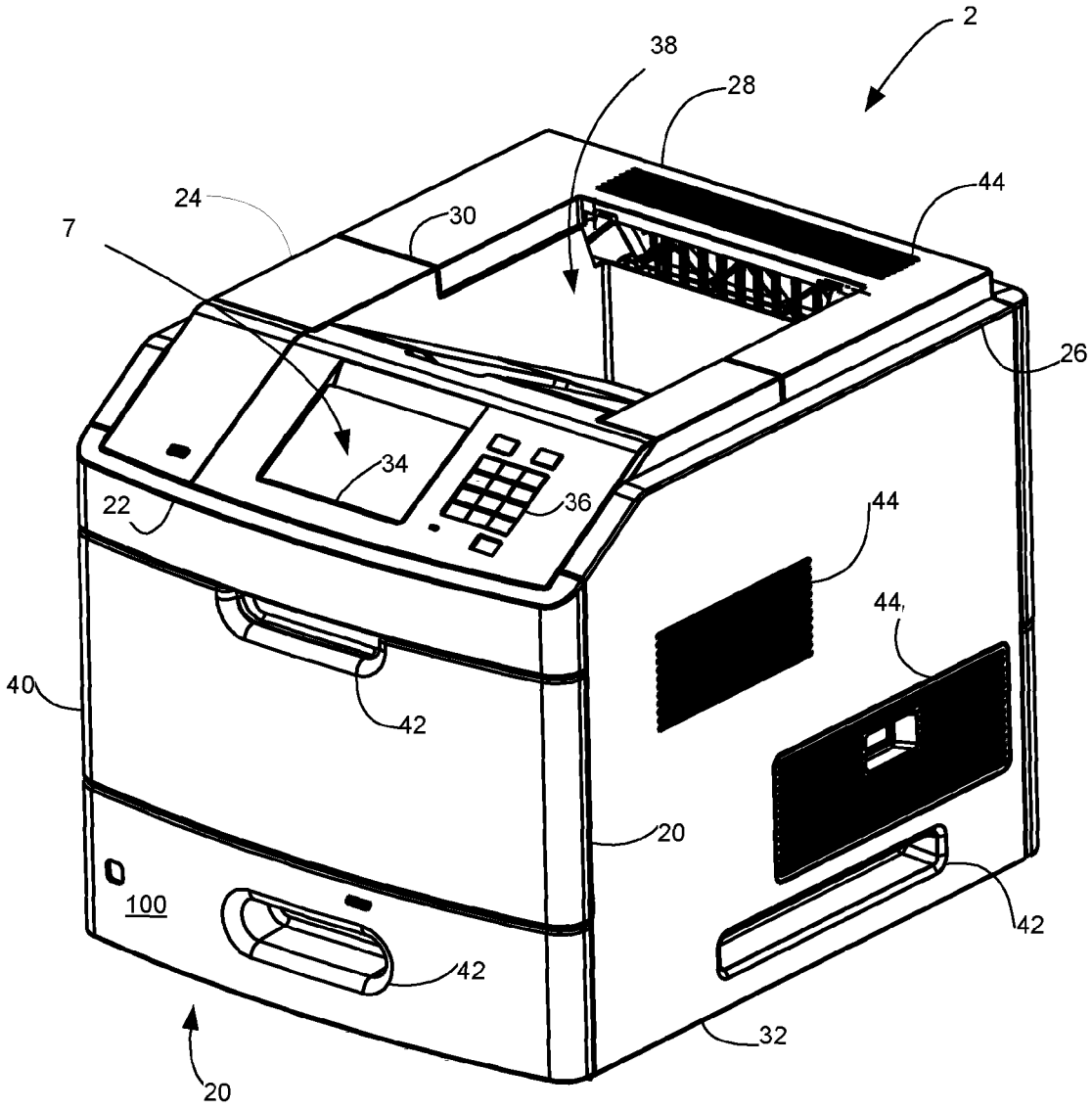
FIG. 2 is an illustration of an image forming device according to one example embodiment.
Figure 3:
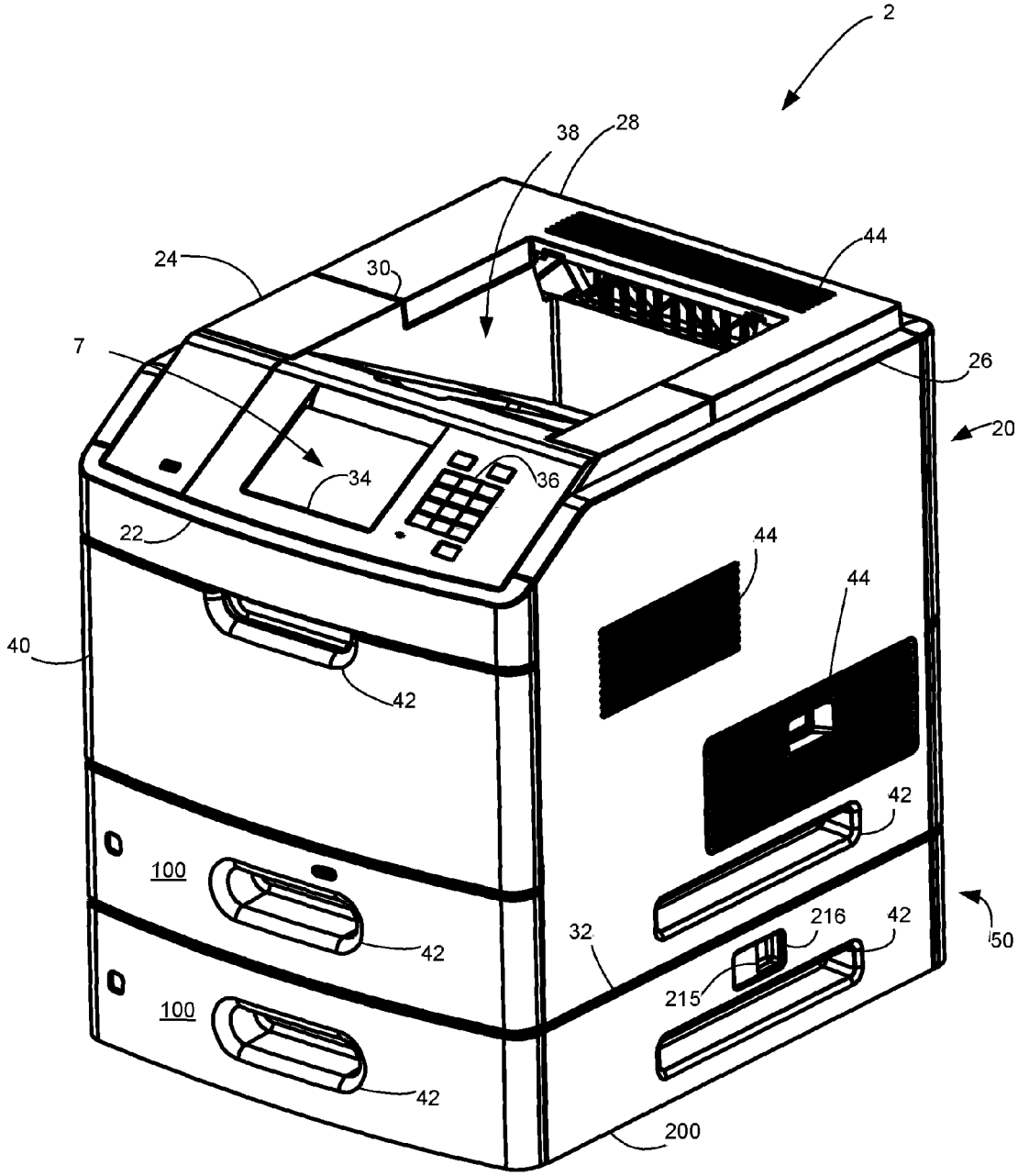
FIG. 3 is an illustration of the image forming device of FIG. 2 with the addition of an option assembly.
Figure 4:
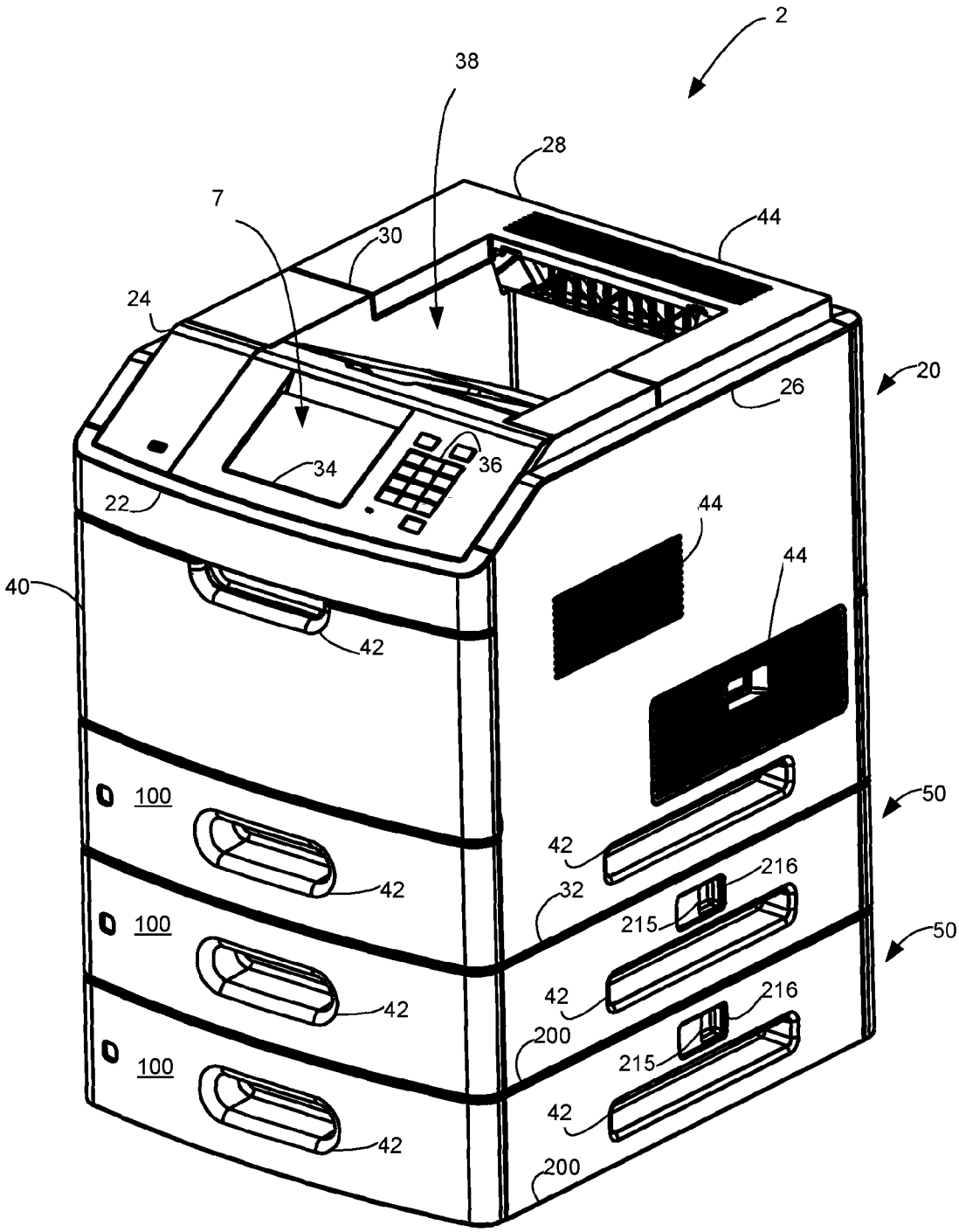
FIG. 4 is an illustration of the image forming device of FIG. 3 with the addition of another option assembly.

Referring now to the drawings and particularly to FIGS. 1-3, there is shown a diagrammatic depiction of an imaging system 1 with an option assembly. As shown, imaging system 1 may include an IFD 2, an optional computer 16 and/or one or more option assemblies 50 attached to the IFD 2. Imaging system 1 may be, for example, a customer imaging system, or alternatively, a development tool used in imaging apparatus design. IFD 2 is shown as a multifunction machine that includes a controller 3, a print engine 4, a printing cartridge 5, a scanner system 6, and a user interface 7. IFD 2 may also be configured to be a printer without scanning. IFD 2 may communicate with computer 16 via a standard communication protocol, such as for example, universal serial bus (USB), Ethernet or IEEE 802.xx. A multifunction machine is also sometimes referred to in the art as an all-in-one (AIO) unit. Those skilled in the art will recognize that IFD 2 may be, for example, an ink jet printer/copier; an electrophotographic printer/copier; a thermal transfer printer/copier; other mechanisms including at least scanner system 6 or a standalone scanner system.

Controller 3 includes a processor unit and associated memory 8, and may be formed as one or more Application Specific Integrated Circuits (ASIC). Memory 8 may be, for example, random access memory (RAM), read only memory (ROM), and/or non-volatile RAM (NVRAM). Alternatively, memory 8 may be in the form of a separate electronic memory (e.g., RAM, ROM, and/or NVRAM), a hard drive, a CD or DVD drive, or any memory device convenient for use with controller 3. Controller 3 may be, for example, a combined printer and scanner controller. In one embodiment, controller 3 communicates with print engine 4 via a communications link 9. Controller 3 communicates with scanner system 6 via a communications link 10. User interface 7 is communicatively coupled to controller 3 via a communications link 11. Controller 3 serves to process print data and to operate print engine 4 during printing, as well as to operate scanner system 6 and process data obtained via scanner system 6. Controller 3 may also be connected to a computer 16 via a communications link 17 where status indications and messages regarding the media and IFD 2 may be displayed and from which operating commands may be received. Computer 16 may be located nearby IFD 2 or remotely connected to IFD 2. In some circumstances, it may be desirable to operate IFD 2 in a standalone mode. In the standalone mode, IFD 2 is capable of functioning without a computer.

Controller 3 also communicates with a controller 53 via communications links 13 and 15. Controller 53 is provided within each attached option assembly 50. Controller 53 operates various motors housed within option assembly 50 that position media for feeding, feed media from media path branches PB into media path P or media path extensions PX as well as feed media along media path extensions PX and media path P and control the travel of media along media path P and media path extensions PX.

IFD 2 also includes a media feed system 12 having a pick mechanism 300 and removable media input tray 100 for holding media M to be printed or scanned. Pick mechanism 300 is controlled by controller 3 via communications link 13. A media path P (shown in dashed line) is provided from removable media input tray 100 extending through the printing engine 4 and scanner system 6 to an output area, to a duplexing path or to various finishing devices. Media path P (shown in dashed line) may also have extensions PX and/or branches PB (shown in dotted line) from or to other removable media input trays as described herein such as that shown in option assembly 50. Media path P may include a manual input tray 40 and corresponding path branch PB that merges with the media path P within IFD 2. Along the media path P and its extensions PX are provided media sensors 14 which are used to detect the position of the media, usually the leading and trailing edges of the media, as it moves along the media path P. Media sensors 14 positioned along media P and its extension PX are shown in communication with controller 3 via communications link 15.

FIG. 2 illustrates IFD 2 that includes the integrated removable media input tray 100 that is integrated into a lower portion of the housing 20 of IFD 2. Housing 20 has a front 22, first and second sides 24, 26, rear 28, top 30 and bottom 32. User interface 7 comprising a display 34 and a key panel 36 may be located on the front 22 of housing 20. Using the user interface 7, a user is able to enter commands and generally control the operation of the IFD 2. For example, the user may enter commands to switch modes (e.g., color mode, monochrome mode), view the number of images printed, take the IFD 2 on/off line to perform periodic maintenance, and the like. A media output area 38 is provided in the top 30. A multipurpose media input tray 40 folds out from the front 22 of housing 20 which may be used for handling envelopes, index cards or other media for which only a small number of media will be printed. Hand grips 42 are provided in several locations on housing 20, such as on sides 24, 26, along the top of multipurpose media tray 40, and on the front of RMIT 100. Also various ventilation openings, such as vents 44 are provided at locations on first and second sides 24, 26, and top 30. Downstream of RMIT 100 in IFD 2 a media sensor 18 is positioned along the media path P to sense the presence of, as well as the leading and trailing edges of media being fed from RMIT 100 with IFD 2 as well as media being from an option assembly 50. The location of media sensor 18 is indicated on FIG. 38.

FIGS. 3-7 illustrate the addition of an option assembly 50 comprising a RMIT 100, a housing 200 in which RMIT 100 is placed, a pick mechanism 300, a drive mechanism 400, and a media reference guide system 500. In FIG. 3, a single option assembly 50 has been added while in FIG. 4 two option assemblies 50 have been added. In both figures, the IFD 2 is at the top of the stack and sits on top of the uppermost option assembly 50. Latches and alignment features are provided as described herein between adjacent units. An adjacent unit is either an IFD 2 or another option assembly 50. Additional option assemblies 50 may be added to the stack. As each option assembly 50 is added, an extension PX to the media path P is also added. The media path extension PX within each option assembly 50 is comprised of two branches which eventually merge at a point above their respective housing 200, either, depending on location within the stack, within a superior option assembly 50 or within IFD 2 itself.

Media sheets M are introduced from RMIT 100 and moved along a media path P during the image formation process. The RMIT 100 is sized to contain a stack of media sheets M that will receive color and/or monochrome images. Each IFD 2 may include one or more input options for introducing the media sheets. Each RMIT 100 may have the same or similar features. Each RMIT 100 may be sized to hold the same number of media sheets or may be sized to hold different quantities of media sheets. In some instances, the RMIT 100 found in IFD 2 may hold a lesser, equal or greater quantity of media than a RMIT 100 found in an option assembly 50. As illustrated RMIT 100 is sized to hold approximately 550 pages of 20 pound media which has a media stack height of about 59 mm. With this media height, RMIT 100 would be considered to be full. If additional media were added, RMIT 100 would be considered to be overfilled. Typically RMIT 100 in option assembly 50 is insertable into a housing 200 of another option assembly 50, but this is not a requirement or limitation of the design.

Figure 5:
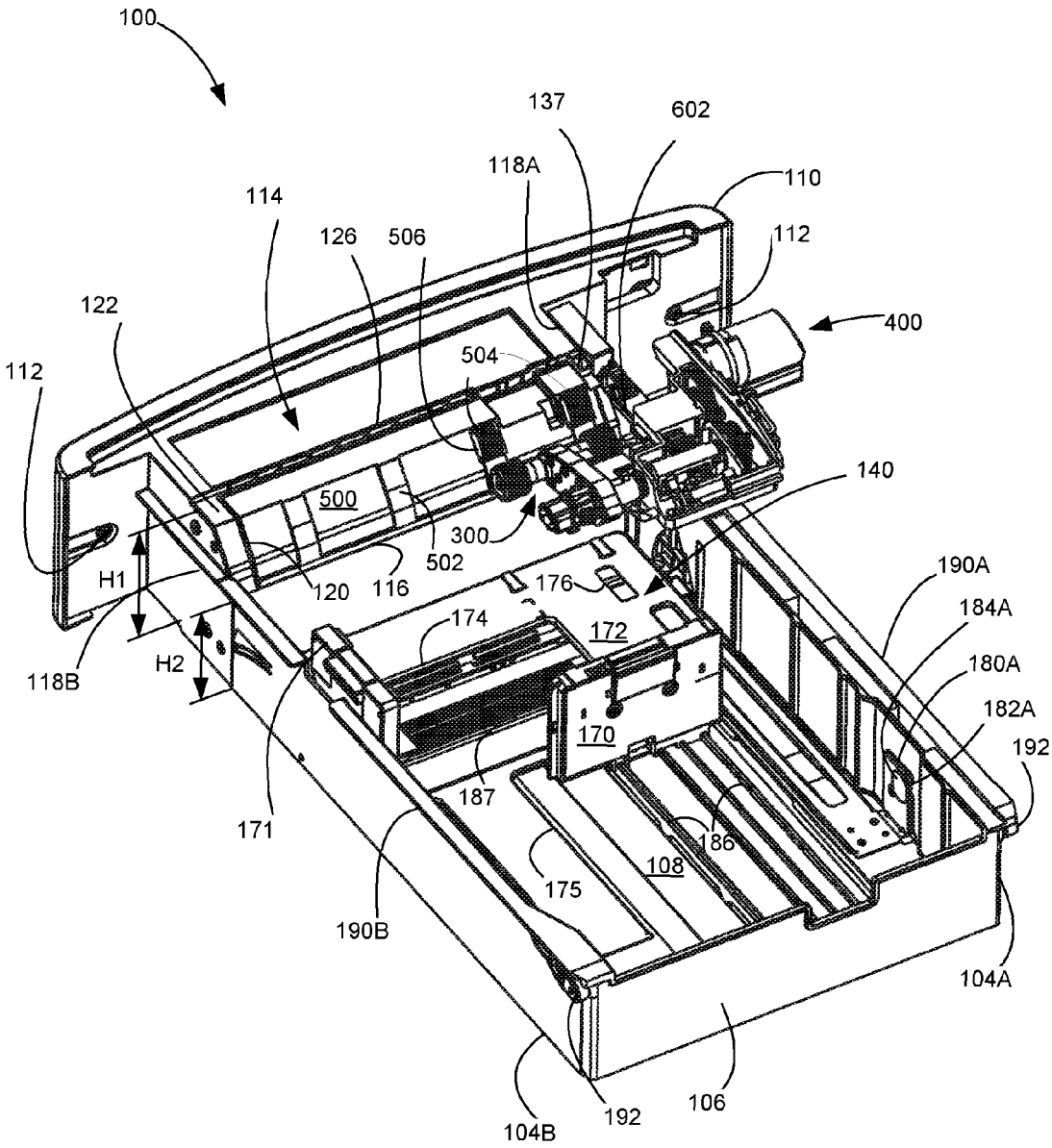
FIG. 5 is an illustration of a RMIT with a pick mechanism and drive system according to one example embodiment.
Figure 6:
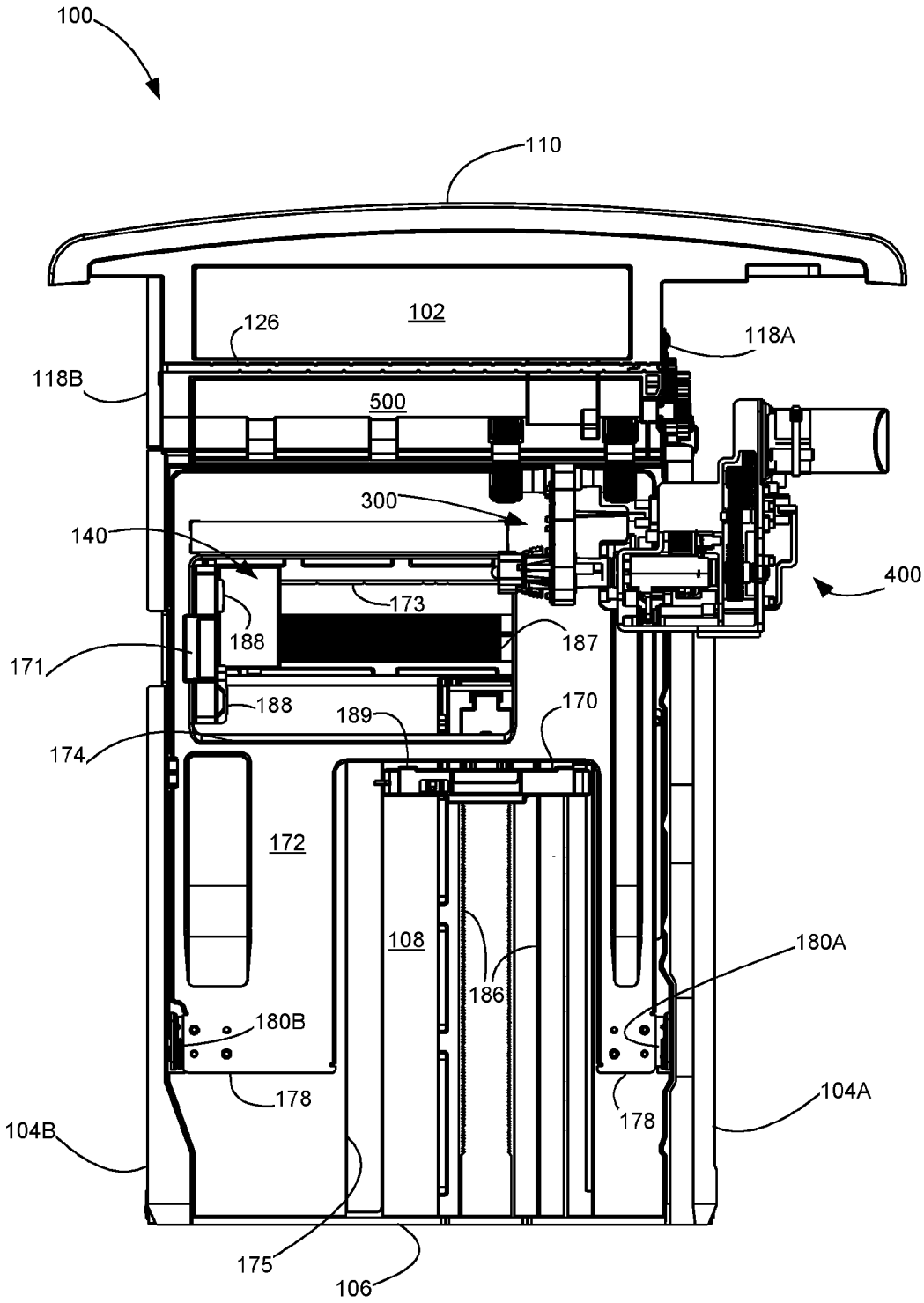
FIG. 6 is a top view of the RMIT, pick mechanism and drive system of FIG. 5.

Referring to FIGS. 5 and 6, RMIT 100 has a front wall 102, side walls 104A, 104B, a rear wall 106, and a bottom 108. Attached to the front of front wall 102 is panel 110 having hand grip 42 therein (See FIGS. 2-4). Panel 110 is illustrated as being attached to front wall 102 by fasteners 112. Front wall 102 may be further defined by front portion 114 having a height H1, a back portion 116 spaced apart from front portion 114 and having a height H2 that is less than height H1, with side portions 118A, 118B adjacent side walls 104A, 104B, respectively, connecting front and rear portions 114 and 116 defining a cavity 120, and a top portion 122. In one embodiment, a removable media dam assembly 500 is received into cavity 120 and is attached to a mount provided in front wall 102 and contains, in some embodiments, a pair of spaced apart separator rollers 504 projecting through corresponding openings 506 in media contact surface 502. In other embodiments, a sloped media dam extends from the top of rear portion 116 to the top portion 122 of front wall 102 and between side portions 118A, 118B of front wall 102 and may be molded into the front wall. In either of these embodiments a media contact surface 502 forms an obtuse angle with the bottom 108. Also the combination of rear portion 116 and media contact surface 502 may be referred to as a media dam having a vertical portion (rear portion 116) and an angled or sloped portion (media contact surface 502). See FIGS. 30-33 and accompanying description for a more detailed description of removable media dam 500. In front of a media dam, such as removable media dam 500, a channel 126 is provided to allow for media M to pass through RMIT 100 from a lower unit to a superior unit.

Figure 14:
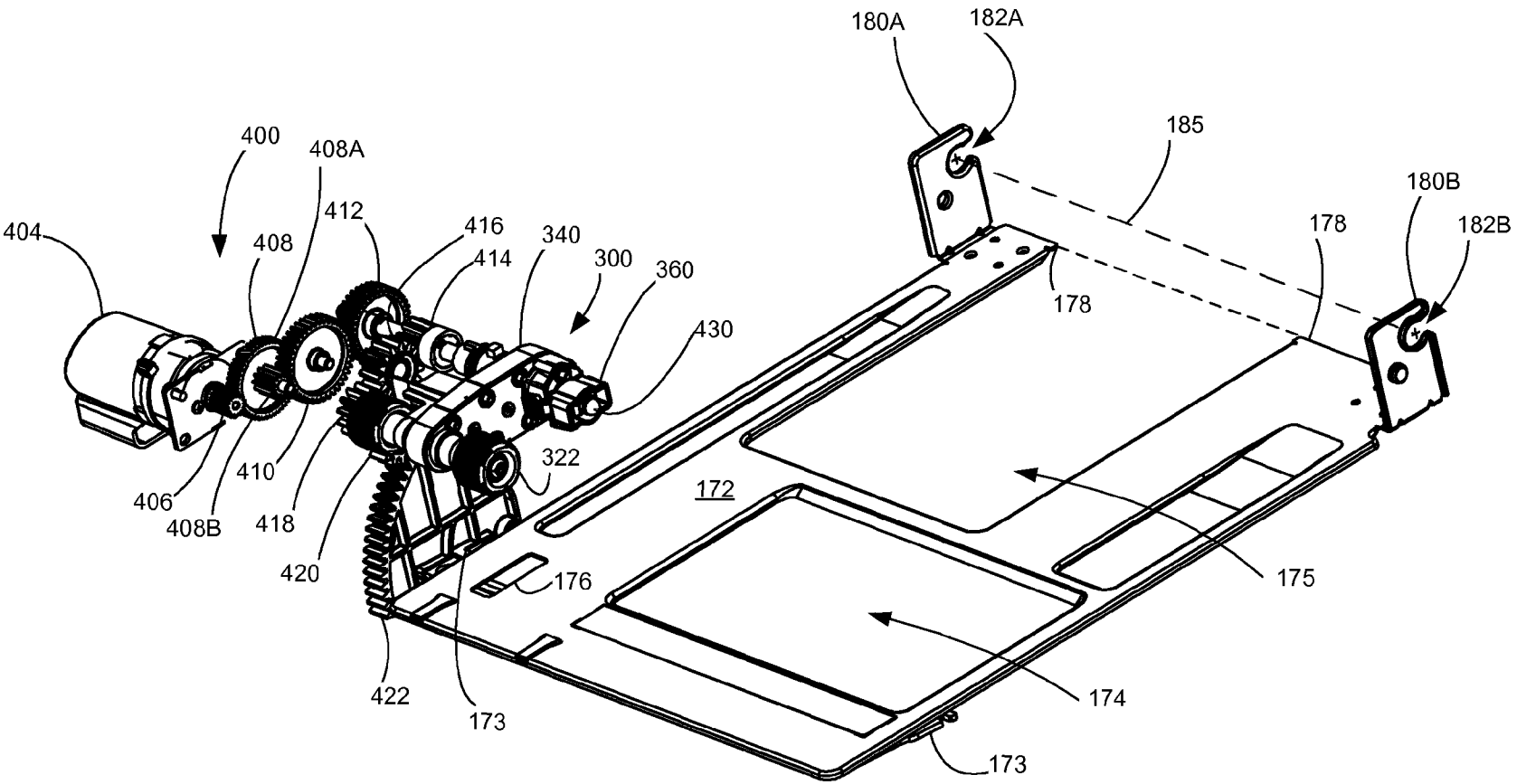
FIG. 14 is a perspective view of a drive mechanism connected to a lift plate according to one example embodiment.
Figure 15:
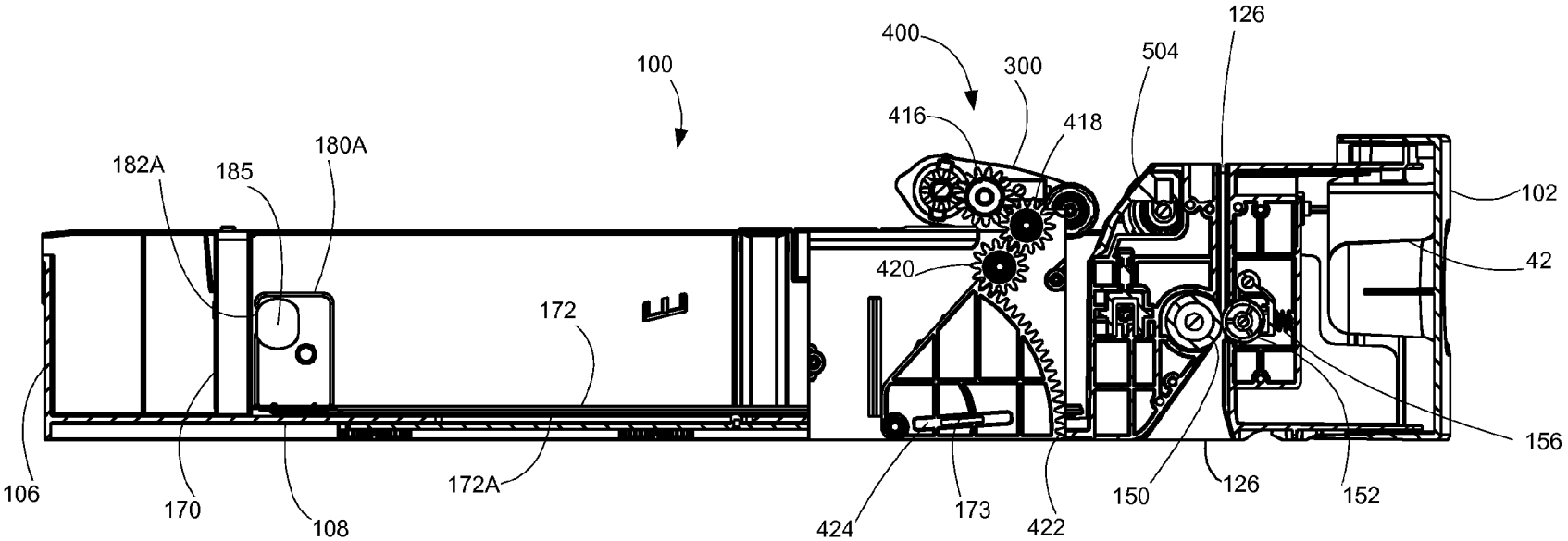
FIG. 15 is a section view of a drive mechanism and a RMIT according to one example embodiment.
Figure 16:
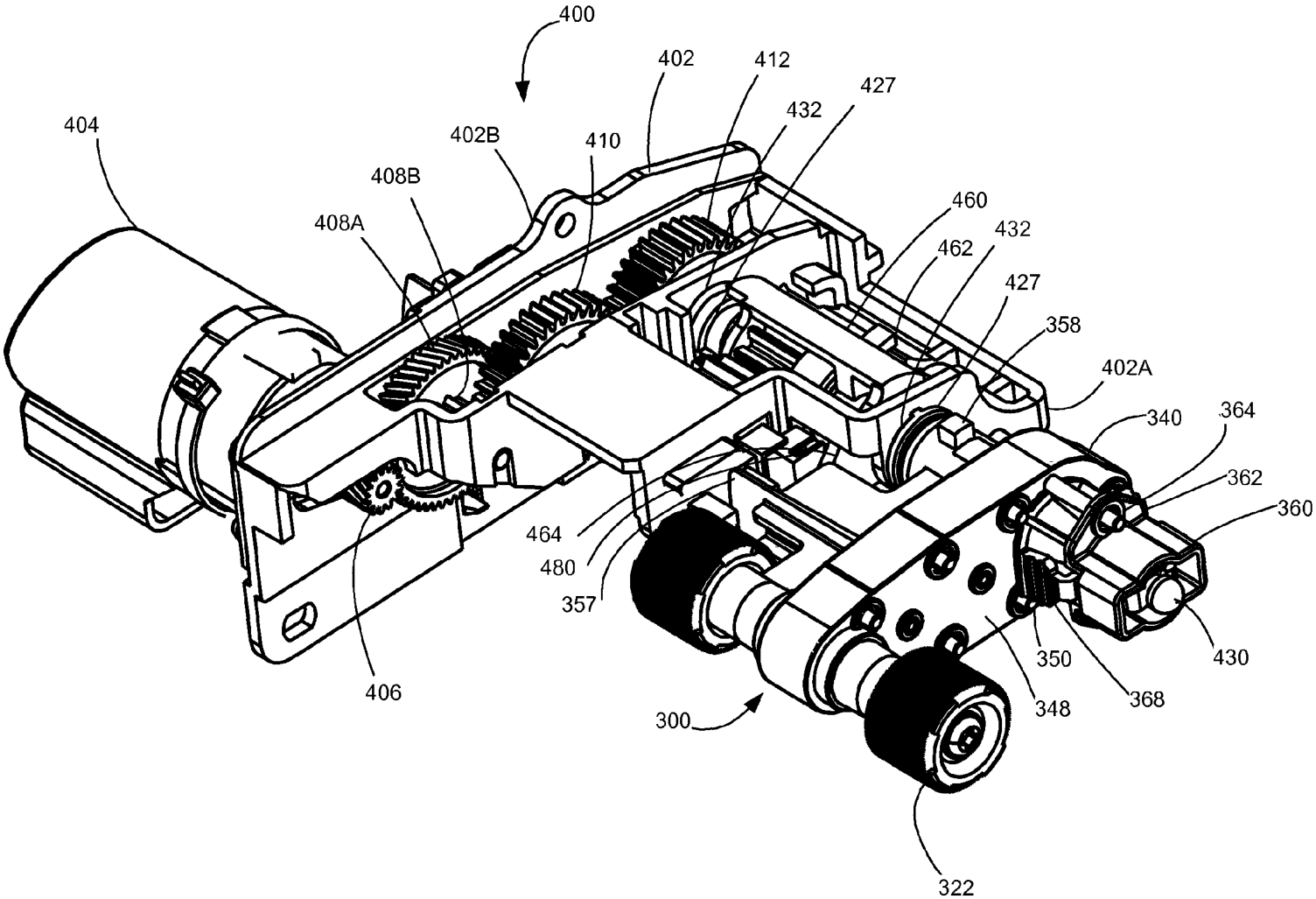
FIG. 16 is a perspective view of a drive mechanism and a removable pick mechanism according to one example embodiment.
Figure 17:
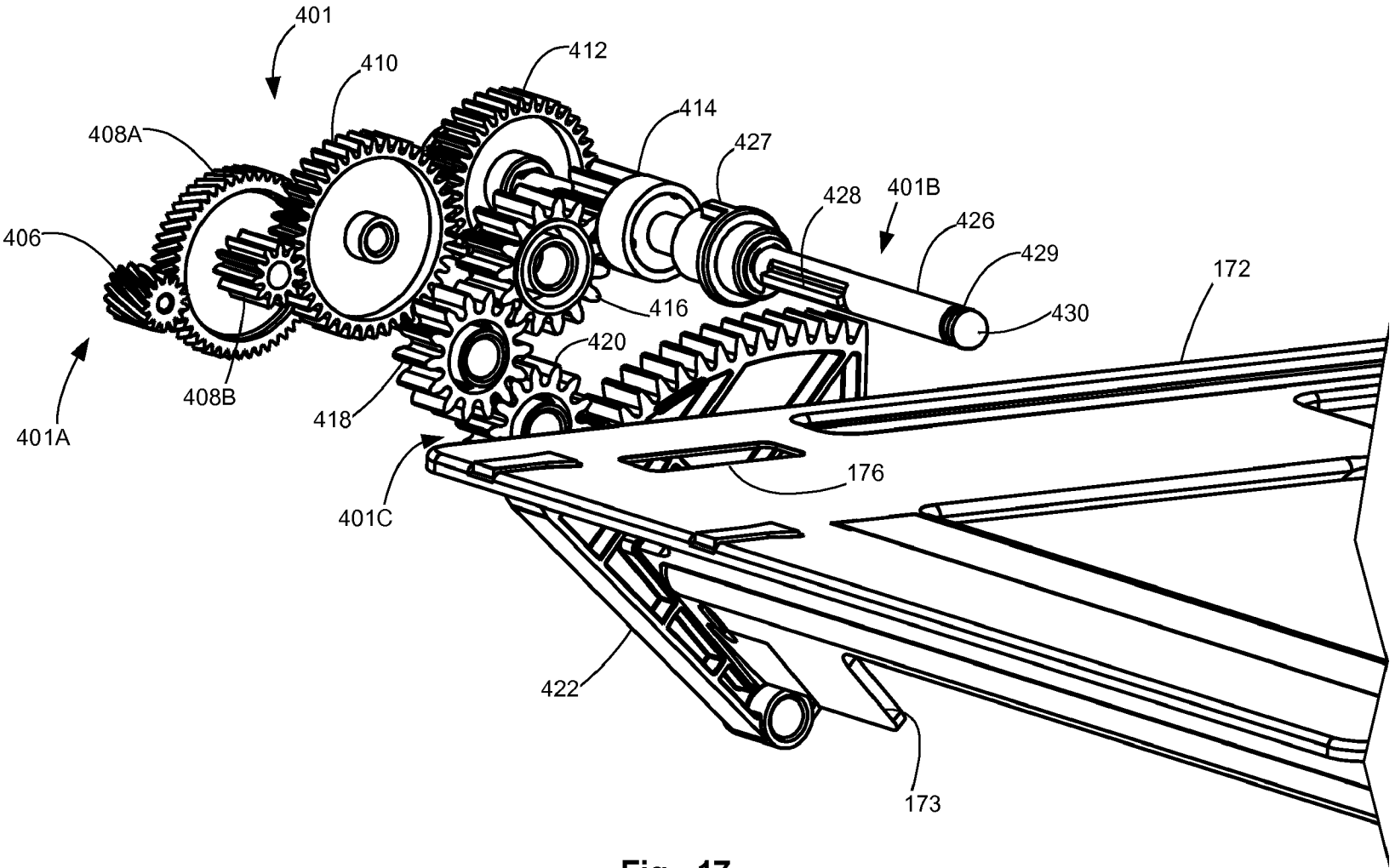
FIG. 17 is a perspective view of a drive transmission according to one example embodiment.
Figure 18:
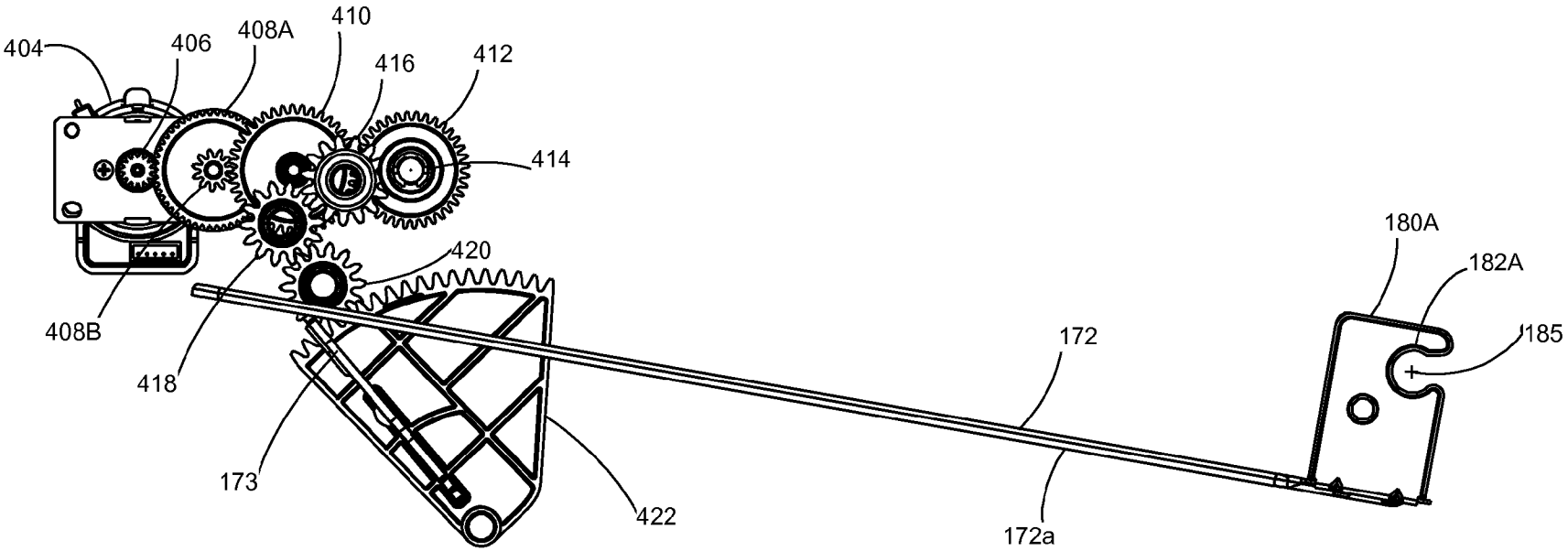
FIG. 18 is a side elevation view a drive transmission according to one example embodiment.

Rearward of front wall 102 is media storage location 140 for media to be fed to IFD 2 and is generally defined by front wall 102 and side walls 104A, 104B and bottom 108. As illustrated, rear wall 106 encloses media storage location 140. Alternate embodiments of RMIT 100 may not include a rear wall 106. Media storage location 140 may be open or enclosed. Within media storage location 140 are rear and side media restraints 170, 171, lift plate 172, and lift arm 173. Media M to be fed is placed on lift plate 172 which is positioned between side walls 104A, 104B and is dimensioned to hold the widest media for which RMIT 100 is designed to hold. As illustrated, the length of lift plate 172 is shorter than the length of the longest media for which RMIT is designed in that most media have a modicum of pliability. Example media sizes include but are not limited to A6, 8½"×11", A4, and 11"×17". Lift arm 173 is positioned beneath lift plate 172 and is connected to drive mechanism 400. Lift arm 173 extends through side wall 104A toward side wall 104B and is used to elevate lift plate 172 and media M up to pick mechanism 300 for feeding into media path P. Openings 174, 175 are provided in lift plate 172 to accommodate the adjustment of rear and side media restraints 170, 171, which are slidably attached to bottom 108, while allowing lift plate 172 to be raised or lowered. Opening 176 is used with a media out sensor mounted on drive mechanism 400. Provided near the rear end 178 of the lift plate 172 are a pair of opposed pivot arms 180A, 180B that extend vertically upward from the lift plate 172 parallel to side walls 104A, 104B, respectively. Openings 182A, 182B are provided adjacent the upper ends of pivot arms 180A, 180B, respectively, which are received on corresponding bearing posts 184A, 184B provided on side walls 104A, 104B, respectively. The use of the pivot arms 180A, 180B raises a pivot axis 185 of lift plate 172 from the bottom 108 to about the centerline of bearing posts 184A, 184B, a distance of about 30 mm. When media storage location 140 is at capacity, this places the leading edge of the top-most media proximate the top of rear portion 116. The location of axis 185 may be designed such that it would be approximately at the mid-point of the rated capacity for the RMIT 100. For example, if a filled RMIT 100 is designed to hold a media stack of about 50 mm in height then pivot axis 185 would be located at about 25 mm from the top surface of lift plate 172. Raising pivot axis 185 of lift plate 172 (See FIG. 14) reduces the amount of fanning or shingling that occurs in the leading edges of media M as it is raised up to pick mechanism 300 for feeding and provides near straight-line motion of the leading edges of the media M. This in turn helps to reduce uncertainty in locating the leading edge of the media M during media feeding.

Media restraints 170, 171 are adjustable and lockable within tracks 186, 187 provided in bottom 108 to accommodate various lengths and widths of media in RMIT 100. Track 186 allows rear media restraint 170 to move from a distal position near rear wall 106 to a proximal position approximately midway along side walls 104A, 104B. Track 187 allows side media restraint 171 to laterally move from a position adjacent side wall 104B to a position approximately 80 mm from side wall 104A. This allows RMIT 100 to hold a narrow compressible media such as envelopes for feeding. Side media restraint 171 has at least one vertically extending media biasing member 188 to bias a topmost portion of the media toward a side wall 104A for aligning media to the media path P and media edge reference surface 604. Biasing member 188 may extend the height of side media restraint 171 or may extend only a portion of its height. Rear media restraint 170 has a spring-bias angled plate 189 that abuts the trailing edges of the media and angles or rotates outwardly from the bottom of rear media restraint 170 while pivoting about an axis near the top of angled plate 189. Angled plate 189 helps to reduce fanning or shingling of the leading edges of media M as it is elevated into picking position within housing 20 or housing 200 by applying greater biasing on the lower portion of the media to the media process direction than at the top of angled plate 189.

Guide rails 190A, 190B are also provided on the side walls 104A, 104B, respectively, in addition to guide rollers 192 located on the distal end of side walls 104A, 104B near rear wall 106 to assist with insertion and removal of RMIT 100 from housing 200. In addition, a lifting surface 193, such as a ramp is also provided on the top of side wall 104A. Lifting surface 193 (see FIG. 30) is used into conjunction with a lifter 460 provided in one embodiment of the drive mechanism 400.

For purposes of clarity, also shown in FIGS. 5 and 6 are pick mechanism 300 and drive mechanism 400 and their relations to RMIT 100 when installed in housing 200. As illustrated, pick mechanism 300 is connected to and supported by drive mechanism 400. Drive mechanism 400 is mounted within housing 200. Other mounting configurations may also be used.

Housing

Figure 7:
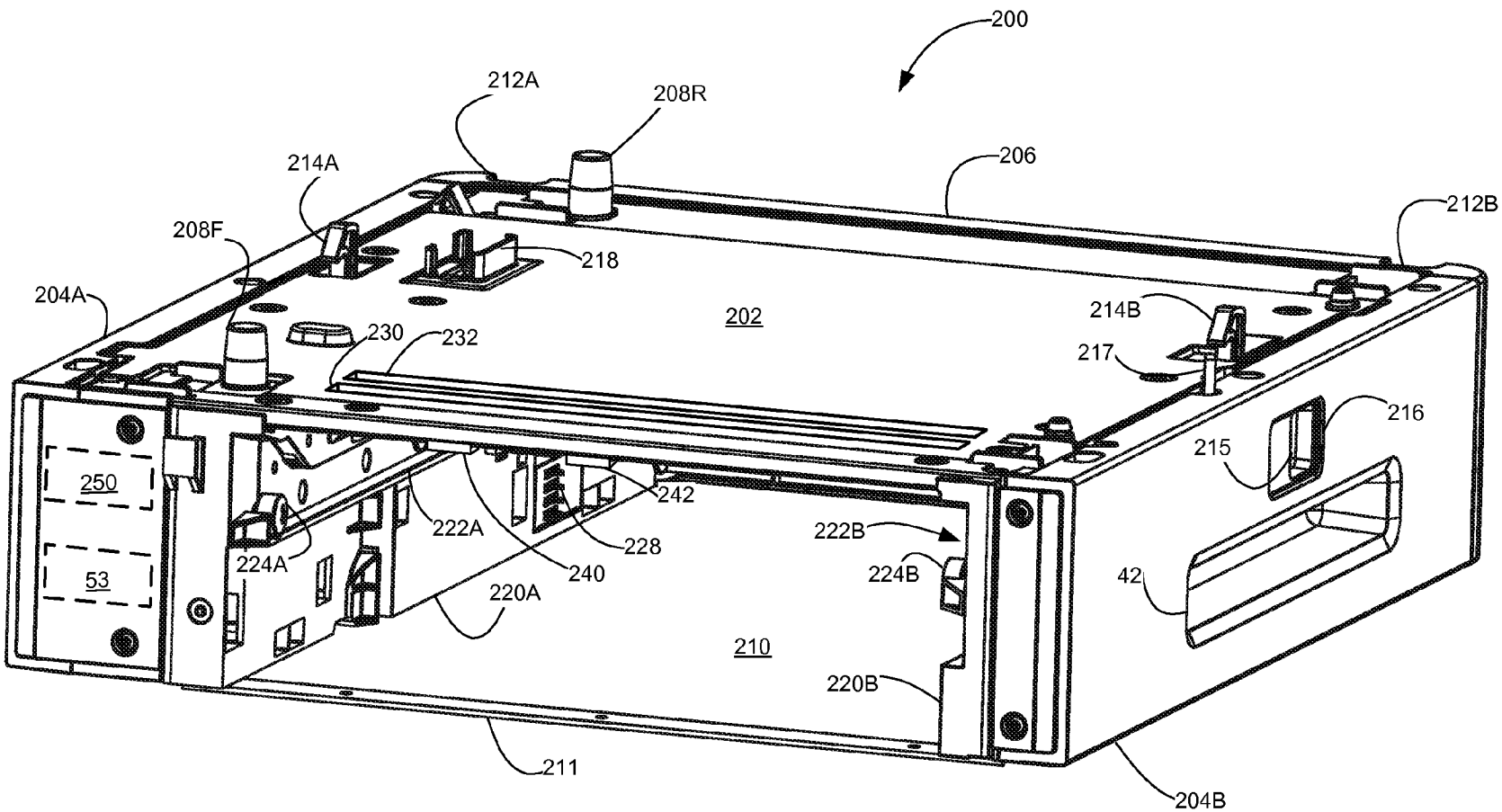
FIG. 7 is an illustration of a housing for an option assembly with the RMIT removed according to one example embodiment.

Housing 200 for option assembly 50 is illustrated in FIG. 7. As illustrated, housing 200 comprises a top 202, generally parallel sides 204A, 204B, and a back 206. Top 202 is fastened to side walls 204A, 204B by fasteners such as screws. Front and rear alignment posts 208F, 208R extend vertically from the top of side wall 204A and are aligned with one another so that a line drawn between them would to be parallel with side 204A. As illustrated posts 208F, 208R extend about 25 mm upwardly from top 202. Front alignment post 208F is provided on second plate 640 and fastens to the top of side wall 204A. Rear alignment post 208R is molded as part of side wall 204A. Front and rear alignment holes 210F, 210R are molded into and extend vertically from the bottom of side wall 204A and are aligned with alignment posts 208F, 208R (See FIG. 40). Because front and rear alignment holes 210F, 210R are molded into side wall 204A, their positions can be accurately determined and controlled with a minimum of tolerance stackup from unit to unit lowering vertical misalignment along media path extensions PX. Front and rear alignment posts 208F, 208R are received into corresponding front and rear alignment holes 210F, 210R in the unit which is above it, either another option assembly 50 or IFD 2. The upper ends of alignment posts 208F, 208R are tapered to provide for easier insertion. In one embodiment front alignment hole 210F is round and dimensioned to closely receive alignment post 208F while rear alignment hole 210R is an oblong opening dimensioned to allow for movement of rear alignment post 208R parallel to side wall 204A. Hand grips 42 are provided in the exterior portion of side walls 204A, 204B. The bottom of housing 200 is an opening 210 generally defined by sides 204A, 204B and back 206. A support 211 extends between the lower proximal ends of side walls 204A, 204B to maintain the parallelism between side walls 204A, 204B and define a front edge of opening 210. Rear wall 206 is provided with a pair of vertical channels 212A, 212B, each located near sidewalls 204A, 204B, respectively. Channels 212A, 212B serve as wire ways for cabling.

Spring biased hooks 214A, 214B extend vertically from the top of side walls 204A, 204B, respectively, and serve as latches to secure option assembly 50 to the unit above. Corresponding latch holes are provided in the bottom of side walls 204A, 204B of each option assembly 50 and in bottom 32 of housing 20. As an upper unit, e.g., IFD 2 or another option assembly 50 is lowered onto top of housing 200, spring-biased hooks 214A, 214B automatically engage with corresponding latch holes in the unit being installed locking the unit into position on top of housing 200. A spring biased release actuator 215 is provided in recess 216 on one or both of side walls 204A, 204B. As shown, release actuator 215 is in side wall 204B. Adjacent hooks 214B is a spring-biased rod 217 vertically mounted within one or both of side walls 204B. As illustrated rod 217 is mounted in side wall 204B. When an upper unit is mounted on top of housing 200 and is properly situated, rod 217 will be depressed into side wall 204B and hooks 214A, 214B will be engaged with the upper unit. To remove an installed upper unit, a user pulls or slides release actuator 215 against its bias spring toward the front of housing 200 which rotates hooks 214A, 214B toward rear wall 206 lowering hooks 214A, 214B and disengaging hooks 214A, 214B from the upper unit. At the same time an end of rod 217 within side wall 204B engages a detent or recess in release actuator 215 and retains release actuator 215 keeping hooks 214A, 214B in a lower unengaged position allowing the upper unit to be lifted off by a single user. As the upper unit is lifted, rod 217 rises due to the spring biasing and releases actuator 215 which springs back to its starting position. In turn hooks 214A and 214B spring back to a vertical position ready to be reengaged when an upper unit is again placed on housing 200. A second rod, a second recess and a second actuator similar to rod 217, recess 216 and actuator 215, may be provided in side wall 204A.

In side wall 204A, on both its top and bottom is an electrical connector 218 that will allow for communications links 13 and 15 to be extended into and through each option assembly as it is added. As shown a male electrical connection is shown on the top of side wall 204A. A female electrical connector (not shown) is provided on the bottom of side wall 204A and in bottom 32 of housing 20. In addition, controller 53 is provided in option assembly 50. Controller 53 is housed in or on side wall 204A and is in communication with controller 3 in IFD 2 via communications links 13, 15 and the various sensors 228, 240, 242, 440, 480, 492. Controller 53 also controls operation of motors 250, 404.

Drive mechanism 400 and pick assembly 300 are also mounted to side wall 204A below top 202. On interior portions 220A, 220B of side walls 204A, 204B guide tracks 222A, 222B, respectively, and guide rollers 224A, 224B, respectively, are provided and cooperatively engage guide rails 190A, 190B on RMIT 100 and provide support therefor when it is installed. Media size sensor 228 is also positioned on interior portion 220A. As shown, media size sensor 228 comprises four switches that are each actuated by a corresponding actuator 142 located on side wall 104A of RMIT 100. Actuators 142 are each in turn operated by mechanical linkages that move when rear media restraint 170 is positioned along tracks 186 within RMIT 100. The state of the switches in media size sensor 228 provides a binary signal to controllers 3, 53 allowing for up to 16 different media lengths to be sensed. Once media length is sensed, controller 3, 53 associates a media width for a given length. For example if the length sensed is 11 inches then the associated media width would be 8.5 inches. Similar associations are programmed for other commonly used media such as legal media and A4. A drive motor 250 (see FIG. 44), also termed a feed motor, for driving separator roller 504 and feed roller 150 is also housed within a recess in side wall 204A. Drive motor 250 drives drive gear 510 which via intermediary gear 158 drives drive gear 160 of feed roller 150 (See FIGS. 30 and 31).

Provided in top 202 are a pair of parallel slots 230, 232 that extend between side walls 204A, 204B that allow for the feeding of media M through channel 126 or feeding of media passing over media contact surface 502 from storage location 140, respectively. In one embodiment the ends of slots 230, 232 adjacent side wall 204A are formed by a vertical portion of a plate (which is referred to infra as second plate 642) mounted to side wall 204A below top 202. Media sensors 240, 242 are provided for slots 230, 232, respectively and are mounted underneath top 202. Media sensors 240, 242 detect the presence of as well as the leading and trailing edges of media passing through slots 230, 232, respectively. Media sensor 240 is also referred to as the feed through sensor while media sensor 242 is referred to as a pick sensor. While specific locations for various elements have been set forth, those locations may be changed. For example, pick mechanism 300 or drive mechanism 400 mounted in or on side wall 104A or may be mounted on the opposite side wall, 104B, 204B respectively and is a matter of design choice to one of skill in the art.

Universal Mount Pick Mechanism

Figure 8:
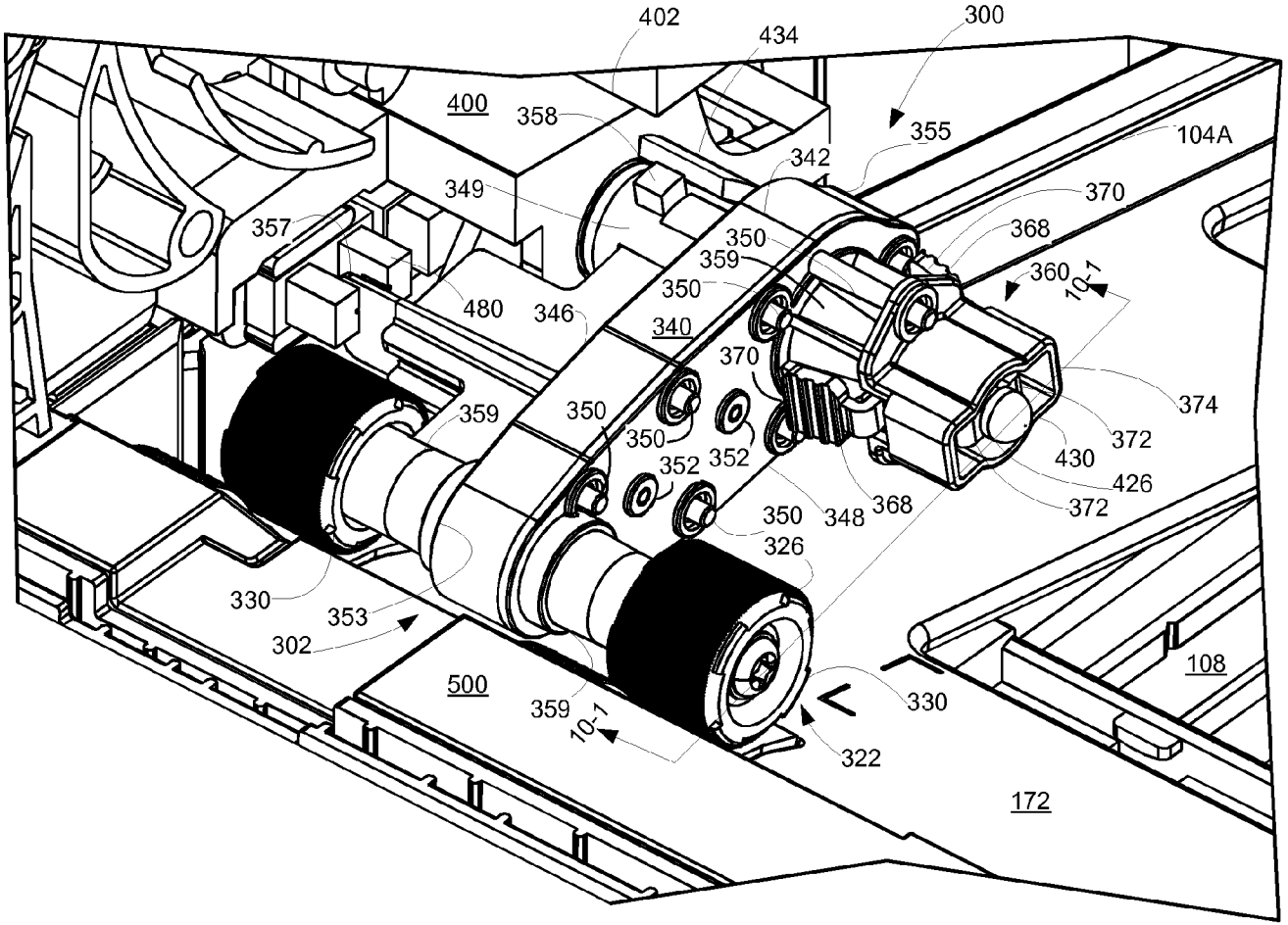
FIG. 8 is an illustration of a detachable pick mechanism according to one example embodiment.
Figure 9:
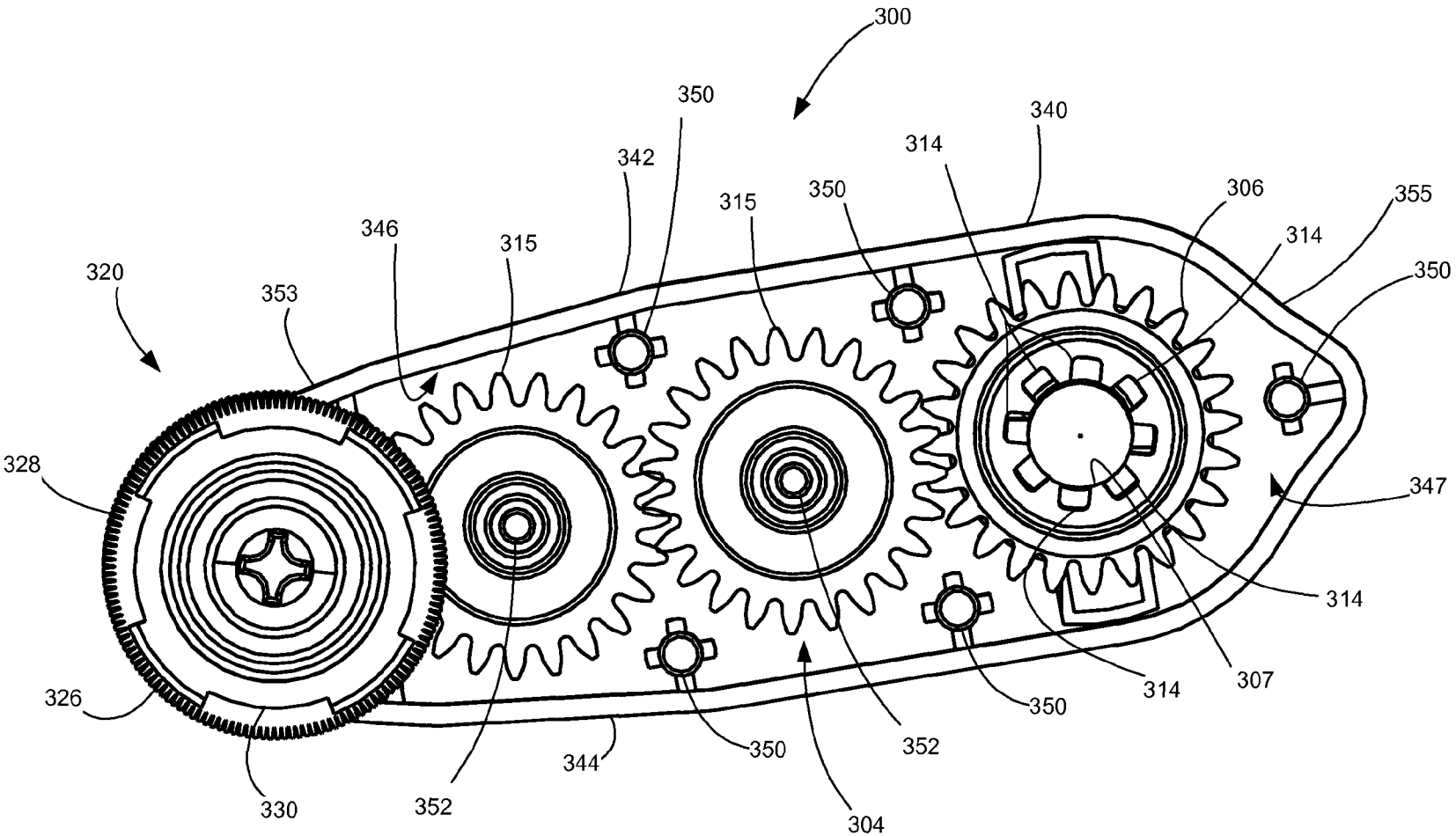
FIG. 9 is a view of the pick mechanism shown in FIG. 8 with side plate removed.
Figure 10:
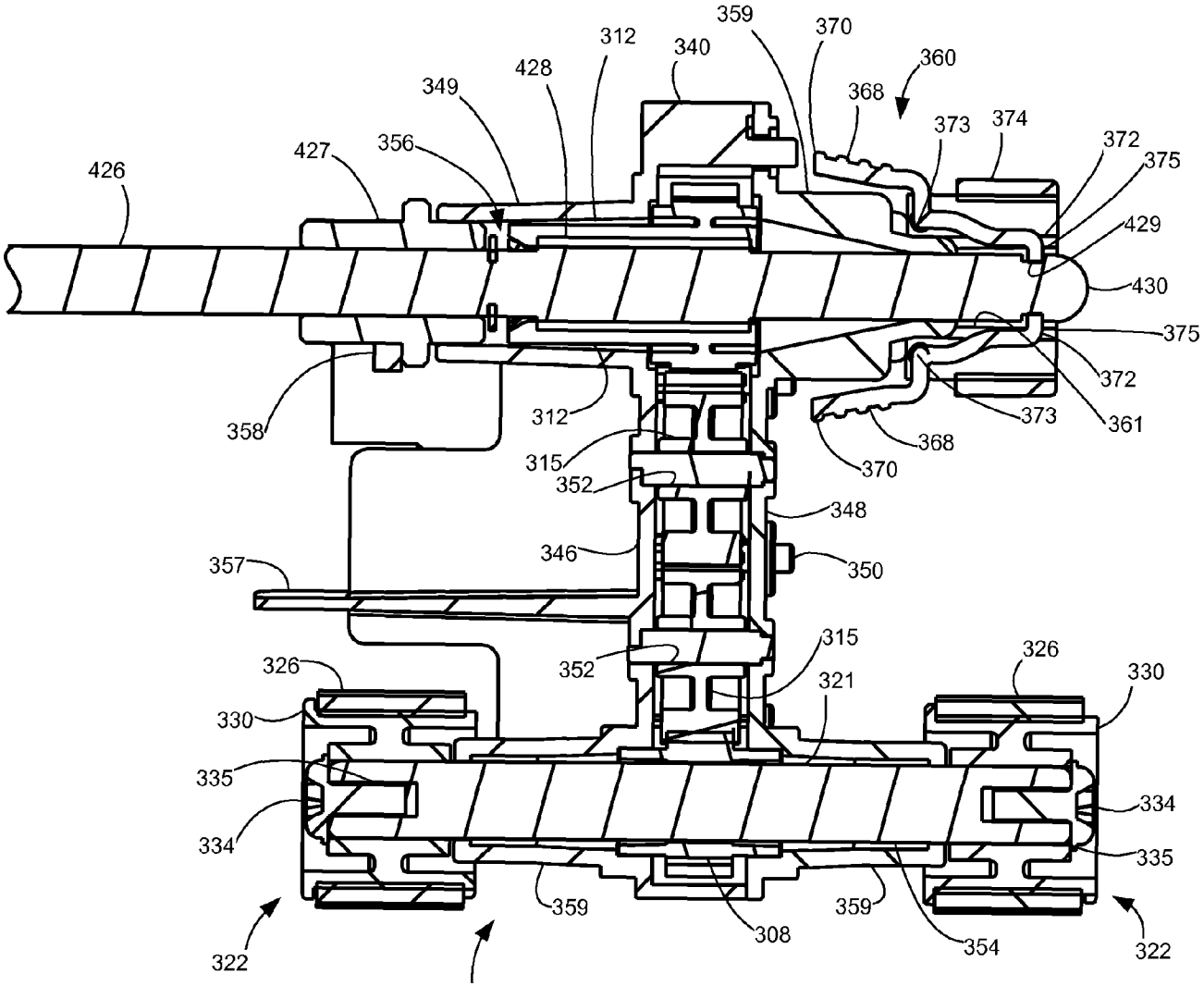
FIG. 10 is a planar section view of the pick mechanism shown in FIG. 8 taken along line 10-10 of FIG. 8.
Figure 11:
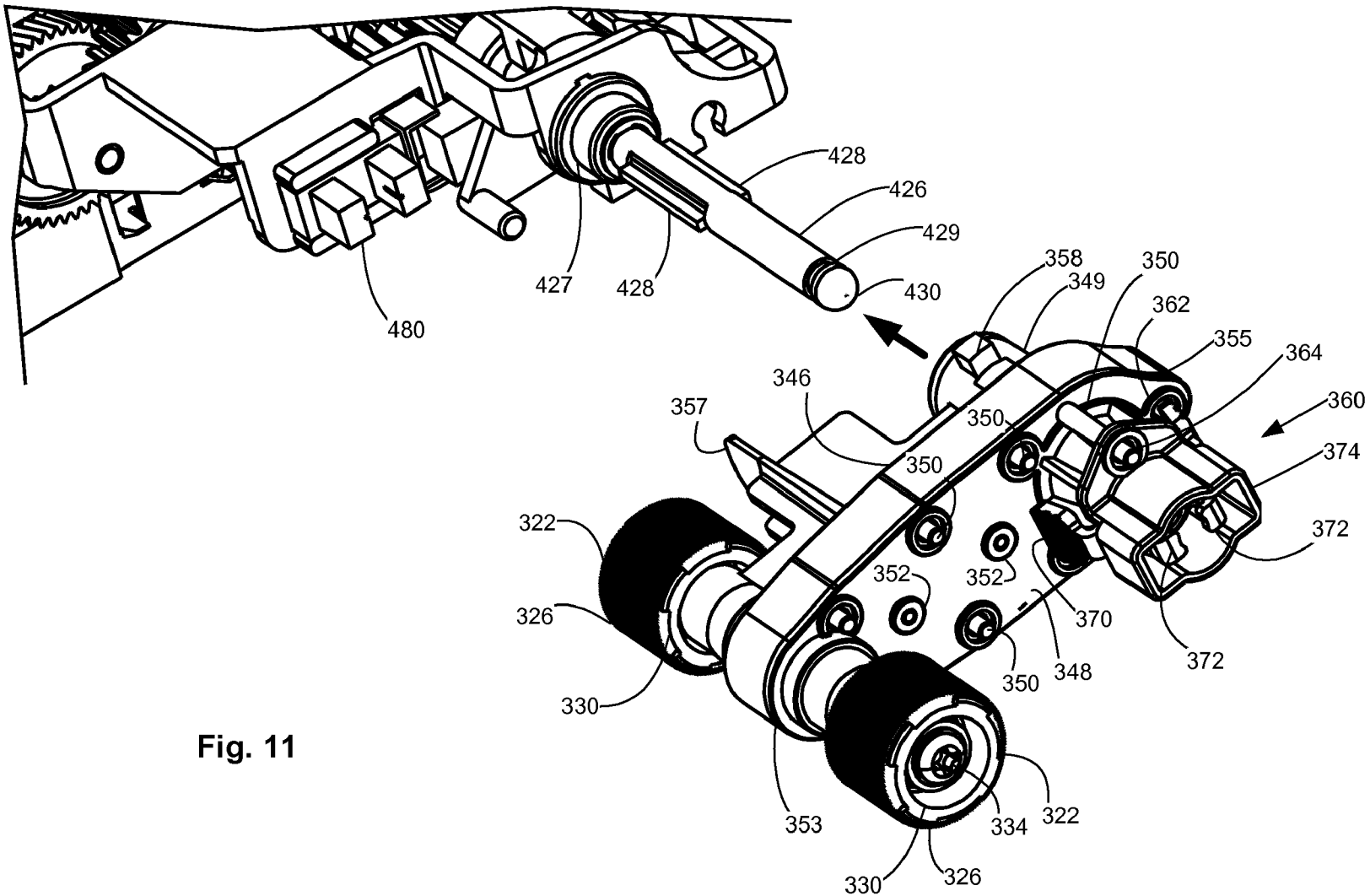
FIGS. 11 and 12 illustrate the pick mechanism shown in FIG. 8 in two different mounting orientations.
Figure 12:
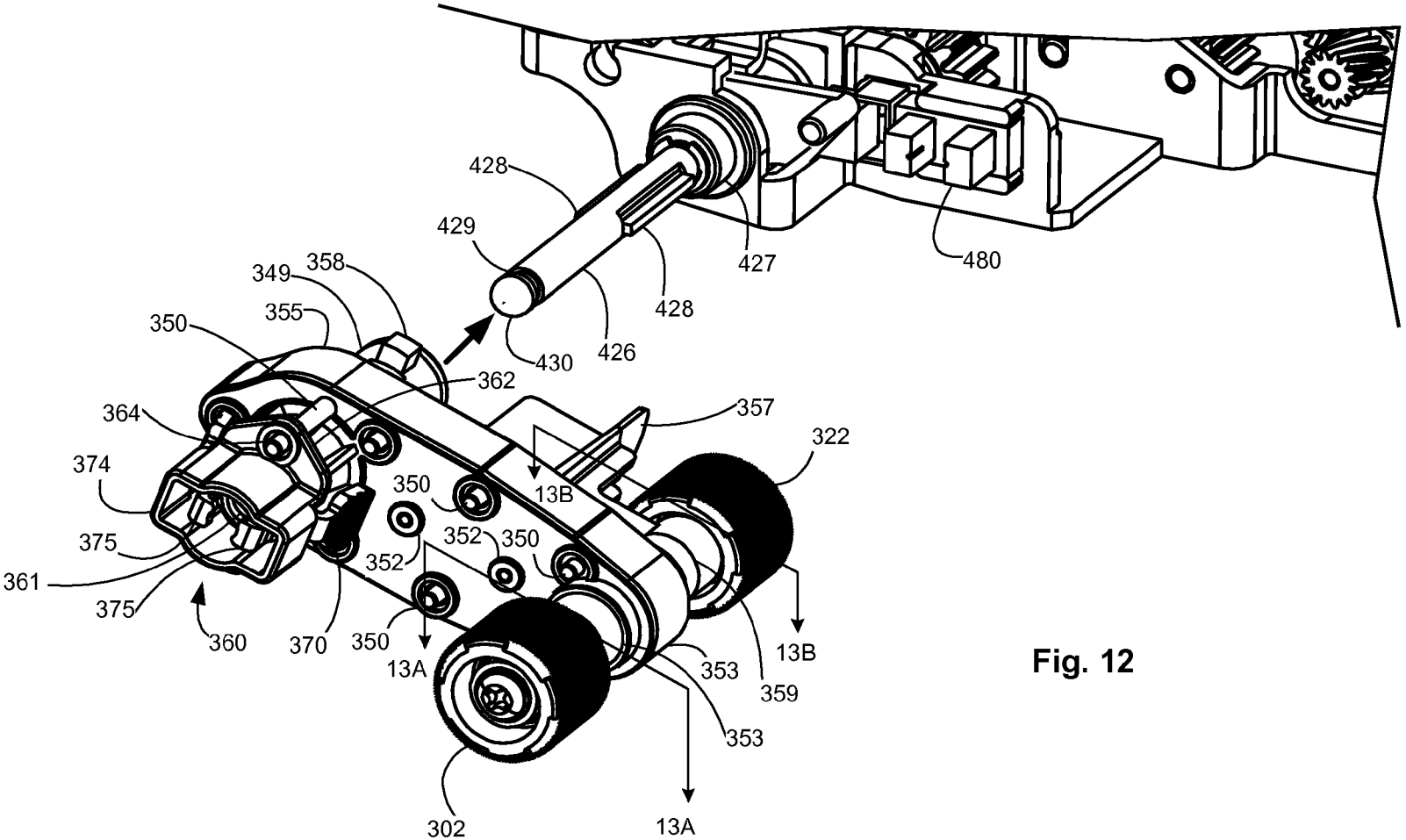
Figure 13B:
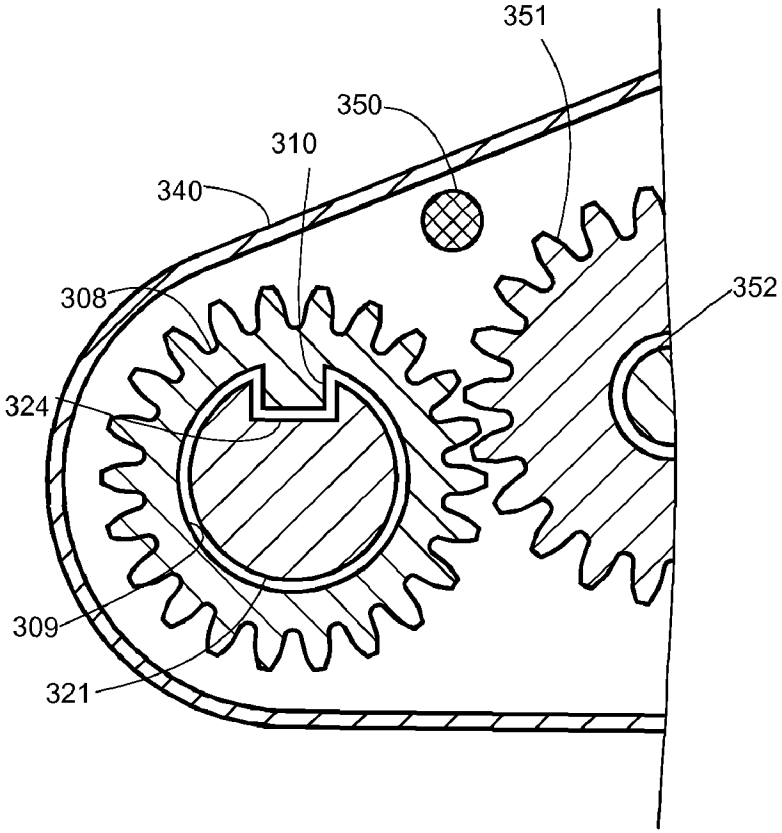
FIGS. 13A and 13B are section views of the pick axle assembly shown in FIG. 12 taken along line 13A-13A through a pick wheel and 13B-13B through a front portion of transmission housing of FIG. 12.
Figure 13A:
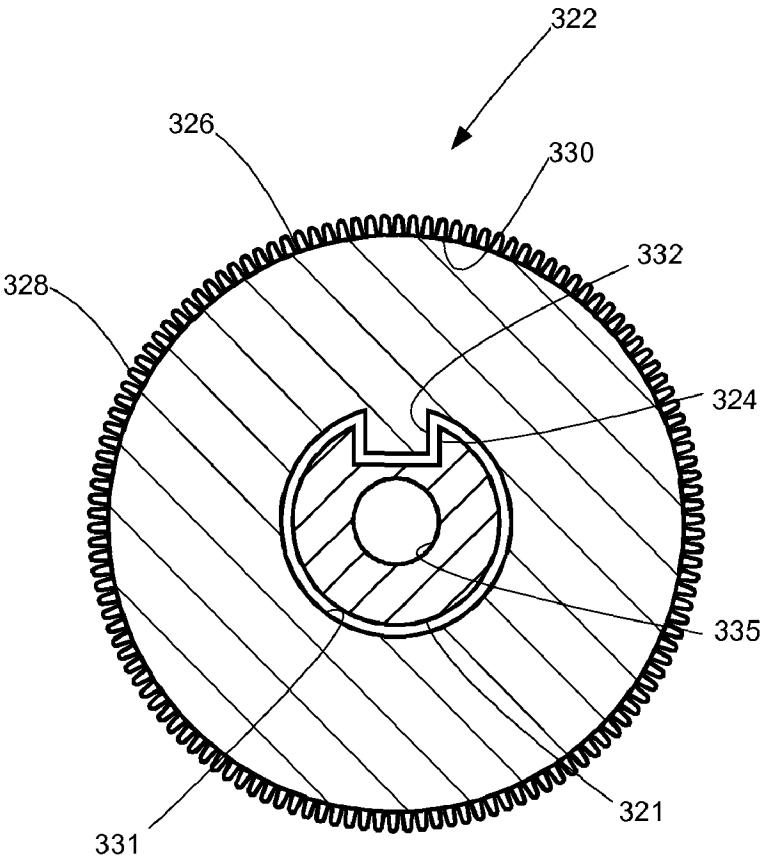

Referring to FIGS. 8-13B pick mechanism 300 is shown in further detail. FIG. 8 shows pick mechanism 300 removably mounted to drive mechanism 400 on pick drive shaft 426 which is a cantilevered shaft having a free end 430. As illustrated, pick mechanism 300 comprises a reversible drive transmission 302, a pick axle assembly 320 and a transmission housing 340 for reversible drive transmission 302. Pick mechanism 300 is detachably mountable on drive shaft 426. The terms such as top, bottom, front and rear of pick mechanism 300 are dependent on its orientation. As used in this description of pick mechanism 300, the terms top, bottom, front and rear refer to the orientation of pick mechanism 300 as illustrated in FIGS. 8, 9 and 11.

Drive transmission 304 comprises a drive shaft gear 306 operatively connected to a pick axle gear 308 via one or more optional intermediary gears 315. Drive shaft gear 306 slidably engages via center opening 307 with cantilevered drive shaft 426 extending from drive mechanism 400 mounted on housing 20 of IFD 2 or housing 200 of option assembly 50. Center opening 307 has a plurality of axial grooves 314 about its circumference. Drive shaft gear 306 may also have a sleeve 312 axially extending from one or both sides of drive shaft gear 306 into which axial grooves 314 may extend. Drive shaft 426 made be provided with at least one spline 428 radially extending therefrom and along a portion of the length of drive shaft 426. As shown in FIG. 11, two diametrically opposed splines 428 may be provided. Axial grooves 314 engage with splines 428 to transfer torque from the drive mechanism 400 to pick mechanism 300 which rotates pick axle assembly 320 and rotates pick mechanism 300 downward onto the topmost media in media storage location 140. The plurality of axial grooves 314 allow a user to more easily and more quickly install pick mechanism 300 onto drive shaft 426 in the desired orientation than a pick assembly having axial grooves that match the number of splines 428 provided. The use of splines 428 and axial grooves 314 allow for more support surface and drive contact surface between drive shaft 426 and pick assembly 300. Pick axle gear 308 has a center opening 309 having a key 310.

In pick axle assembly 320, pick axle 321 has a pick wheel 322 mounted at each end; however other configurations of pick wheels may also be used, for example a single pick wheel or three pick wheels may be mounted on pick axle 321. As illustrated, pick wheels 322 are attached using fasteners, such as screws 334. As one of skill in the art would recognize, other forms of attachment of pick wheels 322 to pick axle 321 may be used. Each pick wheel 322 is comprised of a drum or hub 330 having a pick tire 326 mounted thereon. Because pick mechanism 300 is reversible, each pick tire 326 has bi-directional treads 328 to provide substantially the same gripping force in either rotational direction. Drums 330 mount onto pick axle 321 via openings 331 provided therein using fasteners 334 axially threaded into holes 335 at each end of pick axle 321. As one of skill in the art would recognize, other forms of attachment of pick wheels 322 to pick axle 321 may be used, such as for example, a snap-on type fitting. As illustrated, pick axle 321 has a keyway 324 extending axially along it length. Drums 330 each have a key 332 extending into opening 331. Pick axle gear 308 having center opening 309 has a key 312 extending into opening 309. Keys 332 of drums 330 and key 312 of pick axle gear 308 engage keyway 324. The keys/keyway allow pick axle 321 and pick wheels 322 to be rotated when pick axle gear 310 is rotated. Keyways may be provided on drums 330 and pick axle gear 308 and a key used on pick axle 321. In operation, when drive shaft 426 is rotated, torque is transferred to drive shaft gear 304 then to pick axle gear 308 via intermediary gears 315 and then to pick axle 321 which drives pick wheels 322.

Drive transmission 304 and pick axle 321 are mounted in transmission housing 340 having a top 342, a bottom 344, and a side 346 forming a cavity 347 in which gears 306, 308 are housed. Intermediary gears 315 are mounted on bearing surfaces 352 provided on side 346 in cavity 347. If sleeve 312 is present, a corresponding sleeve 349 is provided on the exterior of side 346 and sized to receive sleeve 312 therein. Also with cavity 347 a plurality of heat stakes 350 are formed on side 346 about the periphery of cavity 347 and project outwardly beyond transmission housing 340. In one form heat stakes are plastic rods. A side plate 348 is used to enclose cavity 347. Side plate 348 has a plurality of openings 351 therethrough that correspond to the plurality of heat stakes 350. Heat stakes 350 are inserted into openings 351 and side plate 348 is slid into position to enclosed cavity 347. A heating element is used to melt the portions of heat stakes 350 that extend beyond side plate 348 thus sealing side plate 348 to housing 340. As shown in the figures, heat stakes 350 are illustrated in an unmelted state. When melted, the exterior ends of heat stakes 350 would appear flattened similar to bearing surfaces 352. As known in the art, other forms of fastening side plate 348 to housing 340 may also be used. Heat stakes 350 provide fastening force similar to screw or rivet but occupy less space within transmission housing 340.

A front portion 353 of transmission housing 340 has a front opening 354 extending therethrough through which pick axle 321 is mounted. The height of front portion 353 is less than the diameter of pick wheels 322, i.e. the treads 328 of pick tires 326 extend beyond top and bottom of the front portion 353. As shown, front portion 353 tapers downwardly from top 342 and upwardly from bottom 344. In one form, transmission housing 340 is approximately 70 mm in length, about 25 mm in height, and about 12 mm in depth; pick axle 321 is approximately 65 mm in length with a diameter of about 5 mm; drum 330 is about 16 mm in diameter and about 15 mm in width; pick wheel 322 has a diameter of about 20 mm including pick tire 326. The height of front portion 353 at its highest is about 18 mm. A rear portion 355 of transmission housing 340 has a rear opening 356 extending therethrough through which drive shaft 426 passes. Additional sleeves 359 may be provided on the exterior portions of side 346 and side plate 348 centered over front and rear openings 354, 356. Sleeves 359 on front portion 353 may be used to provide axial positioning for pick wheels 322. Sleeve 359 extending axially from side plate 348 may be used for mounting latch 360 to transmission housing 340.

Because pick mechanism 300 is easily removable from drive shaft 426 using latch 360, it can be replaced by a user rather than a trained technician. As illustrated, latch 360 is mounted on the exterior of side plate 348 and has an opening 361 centered about the free end 430 of drive shaft 426 allowing latch 360 to be slid onto pick drive shaft 426. Latch 360 engages a circumferential groove 429 provided near free end 430 of drive shaft 426. Opposed resilient members 368 are pivotally mounted at pivots 373 on the exterior of latch 360 and have first ends 370 and second ends 372. First ends 370 flare slightly outward from latch 360 and are in the form of finger pads with ridges on the outer surfaces. Second ends 372 having inwardly turned opposed extensions 375 that extend toward one another. Extensions 375 may overlap, contact or be slightly separated when latch 360 is not engaged on drive shaft 426. Extensions 375 engage with circumferential groove 429 and axially position pick mechanism 300 on pick drive shaft 426. A mounting flange 362 with mounting hole 364 is provided on latch 360. Latch 360 is mounted to side plate 348 using a heat stake 350 provided on the exterior of side plate 348 that passes through mounting hole 364. Mounting hole 364 may be two mounting holes and each having a corresponding heat stake 350. Again the portions of heat stake 350 extending beyond mounting flange 362 are melted securing latch 360 to side plate 348.

When installing pick mechanism 300, a user simply slides pick mechanism 300 onto drive shaft 426. Free end 430, which in one embodiment is rounded, acts to separate extensions 375 as pick mechanism 300 is slid into position on drive shaft 426. Extensions 375 on second ends 372 snap into groove 429. Removal of pick mechanism 300 is accomplished by the user pressing first ends 370 inwardly toward drive shaft 426 rotating opposed member 368 about pivots 373 thus releasing second ends 372 from groove 429 and permitting pick mechanism 300 to be slid off drive shaft 426.

A flag 357 also extends outwardly from transmission housing 340 and is used to change the state of index sensor 480 which is used for feeding media M from RMIT tray 100. As illustrated, flag 357 extends outwardly from side 346. While latch 360 and flag 357 are shown as mounted on opposite sides of transmission housing 340, they can be mounted on the same side. At least one stop 358 extends from the transmission housing 340 for limiting the rotation of the pick mechanism 300 about the drive shaft 426. The frame 402 of the drive mechanism 400 includes an abutment 434 disposed adjacent to the pick mechanism 300 such that when the pick mechanism 300 rotates beyond a predetermined point, the stop 358 contacts the abutment 434 thereby limiting either the upward or downward rotation of the pick mechanism 300 about the pick drive shaft 426. In some embodiments, a pair of diametrically opposed stops 358 extend from the transmission housing 340 such that the stops 358 limit both the upward and downward rotation of the pick mechanism 300 about the pick drive shaft 426. Embodiments include those wherein the stop(s) 358 radially extend from the sleeve 349. In some embodiments, the sleeve 349 is tubular in shape. In the example embodiment shown, abutment 434 is an arcuate member curving around the exterior of sleeve 349 (See FIG. 8). In this configuration, when the pick mechanism 300 rotates downward beyond a predetermined point, the bottom stop 358 contacts the abutment 434 thereby limiting the downward rotation of the pick mechanism 300 and when the pick mechanism 300 rotates upward beyond a predetermined point, the top stop 358 contacts the abutment 434 thereby limiting the upward rotation of the pick mechanism 300.

Pick mechanism 300 has several advantages over prior pick mechanisms. Because it is reversible, small in length and lightweight, a clutching mechanism is not required within the drive transmission 304. This helps to reduce cost and weight of pick mechanism 300. Reversibility, combined with the dimensioning of pick wheels 322 extending beyond the height of front portion 353, allows pick mechanism to be rotated 180 degrees end to end from its position shown in FIG. 11 to that shown in FIG. 12 when pick mechanism is mounted on side wall 204A of housing 200. This is termed a right hand mount when viewed from the media process direction. Pick mechanism 300 may also be flipped over from side to side allowing pick mechanism 300 to be mounted on side wall 204B of housing 200, a left hand mount when viewed from the process direction. Thus pick mechanism 300 can accommodate right hand mounts, left hand mounts and from either mount can be oriented such that pick wheels 322 are oriented toward front wall 102 or rear wall 106 of RMIT 100. Because pick mechanism 300 can accommodate this variety of mounting and operating orientations, it is termed a universal pick mechanism.

Plastic, such as acrylonitrile butadiene styrene (ABS) or polyoxymethylene (POM), may be used for the majority of components in pick mechanism 300. Pick tires 326 are fabricated from elastomer based materials to provide gripping forces against media M. Gears 304, 308, 315 used in drive transmission 304 may be made of POM. Because pick mechanism 300 is used in conjunction with lift plate 172 which raises the media M to pick mechanism 300, it can be made shorter in length than prior art pick mechanisms used in similar capacity media trays where such pick mechanisms have to be able to reach the tray bottom. The shorter length reduces the weight of the pick mechanism 300 over such prior art designs. For example, pick mechanism 300 has a weight of about 20 grams while a prior art pick mechanism for a similar capacity media tray had a weight of about 55 grams. Further, because the rotational travel of pick mechanism 300 is limited to about 2.5 degrees of rotational travel during normal media picking, the amount of pick force applied to the topmost media is more constant over its travel. The combination of stops 358 and abutment 434 limit the total upward and downward motion of pick mechanism 300 to an arc of about 23 degrees versus about 140 to 160 degrees of rotation motion for prior art configurations.

For example, for the present pick mechanism the normal pick force is about 20 grams at the maximum media height within storage location 140 and about 18 grams at the lower end of its rotational travel versus about 42 grams at the maximum media height and about 45 grams at the tray bottom for a prior art pick mechanism. This greater force on prior art pick mechanisms induces more double feeds of media M. To overcome this prior art, pick mechanisms are counterbalanced using springs that require adjustment during assembly of the pick mechanism leading to significant variability in the magnitude of normal pick force. For the present pick mechanism 300, the primary cause of variance in normal pick force is due to dimensional variances of its components which provide a slight amount of variance in weight causing a slight variance in the normal pick force of about 2 grams. However, due to close dimensional tolerances, the amount of normal pick force variances caused by weight variances of components in the present pick mechanism 300 is significantly less than the amount of variability in the normal pick force of a counterbalanced pick mechanism. Because normal pick force of pick mechanism 300 is more uniform over its travel, the problem with double feds of media is reduced over prior art pick mechanisms. Another benefit is that counterbalancing mechanisms can be eliminated and the needed counterbalancing procedures during assembly can be avoided in almost all instances.

Drive Mechanism

With reference to FIGS. 14 to 18, a drive mechanism 400 according to an example embodiment is shown. A frame 402 mounted to housing 20 supports drive mechanism 400. Drive mechanism 400 includes a common motor 404 that drives pick mechanism 300 and lifts lift plate 172. Drive transmission 401 is shown having a single input 401A connected to motor 404. Drive transmission 401 includes a first output 401B connected to pick mechanism 300 and a second output 401C connected to lift plate 172. While the example embodiment shown includes two outputs 401B, 401C, additional outputs may be provided as desired for performing additional functions.

A drive pinion 406 extends from motor 404 and connects to drive transmission 401 to transfer rotational force from motor 404 to drive transmission 401. In the example embodiment shown, drive pinion 406 is connected to a speed reducer dual gear 408 that includes a larger portion 408A and smaller portion 408B. Pinion 406 is connected to larger portion 408A while smaller portion 408B is connected to an intermediary gear 410. It will be appreciated that in this configuration, the rotational speed of intermediary gear 410 is less than the rotational speed of motor 404 and drive pinion 406 as a result of the difference between the circumferences of larger portion 408A and smaller portion 408B of speed reducer dual gear 408. Alternatives include those wherein the orientation of larger portion 408A and smaller portion 408B is reversed so that the rotational speed of intermediary gear 410 is greater than the rotational speed of motor 404 and drive pinion 406. Further alternatives include those wherein speed reducer dual gear 408 is replaced with a simple intermediary gear so that the rotational speed of intermediary gear 410 is the same as the rotational speed of motor 404 and drive pinion 406.

A pick mechanism drive gear 412 is connected to intermediary gear 410. Pick mechanism drive shaft 426 is substantially concentric with and extends from pick mechanism drive gear 412. Drive shaft 426 is positioned by a pair of bearing sleeves 427 relative to frame 402. Bearing sleeves 427 are each mounted in a respective hole 432 in frame 402 and are disposed around drive shaft 426 so that drive shaft 426 is free to rotate. Drive shaft 426 extends from frame 402 in a cantilevered fashion and includes a free end 430. Pick mechanism 300 is removably mountable on free end 430 of drive shaft 426. When pick mechanism 300 is mounted on drive shaft 426, drive shaft 426 transfers rotational force to drive shaft gear 306 for driving the pick wheels 322. Frame 402 further includes an abutment 434 adjacent to pick mechanism 300 (See FIG. 8). Abutment 434 limits the rotational travel of pick mechanism 300 by providing a hard stop for stops 358 and the rotational motion of the pick mechanism 300.

A first clutched gear 414 is connected to first output 401B of drive transmission 401. In the example embodiment shown, first clutched gear 414 is positioned around drive shaft 426. A second clutched gear 416 is connected to first clutched gear 414 and second output 401C of drive transmission 401. First and second clutched gears 414, 416 each include a one-way clutch. In the example embodiment shown, second clutched gear 416 is connected to an intermediary gear 418 protruding through top of the side wall 104A of the RMIT 100. Intermediary gear 418 is connected to a sector gear 422 pivotally mounted in side wall 104A. In the example embodiment illustrated, intermediary gear 418 is connected to sector gear 422 via an additional intermediary gear 420 in side wall 104A. Lift arm 173 is mounted to sector gear 422 through a radially oriented opening 424 in sector gear 422. Lift arm 173 is slidably disposed between bottom 108 and a bottom surface 172A of lift plate 172. Accordingly, rotation of sector gear 422 in one direction rotates lift arm upward against bottom surface 172A thereby rotating lift plate 172 about pivot axis 185.

The engagement of first clutched gear 414 is opposite the engagement of second clutched gear 416. Clutched gears 414, 416 are configured so that when pick mechanism 300 is driven in the media process direction for feeding media M, lift plate 172 is held in place during feeding of media. When elevation of lift plate 172 is called for as media is removed during media feeding, motor 404 rotation is reversed raising lift plate 172 while reversing the rotation of pick mechanism 300 to be opposite the media process direction. In the example embodiment shown, when motor 404 drives the pick mechanism 300 in the media process direction, first clutched gear 414 is disengaged so that it does not rotate with drive shaft 426 and second clutched gear 416 is engaged to hold lift plate 172 in place. When motor 404 drives pick mechanism 300 opposite the media process direction, first clutched gear 414 is engaged so that it rotates with drive shaft 426 as it is driven by motor 404 and second clutched gear 416 is disengaged and driven by first clutched gear 414 to rotate sector gear 422. Rotation of the sector gear 422 raises lift arm 173 and, in turn, raises lift plate 172.

Figure 19:
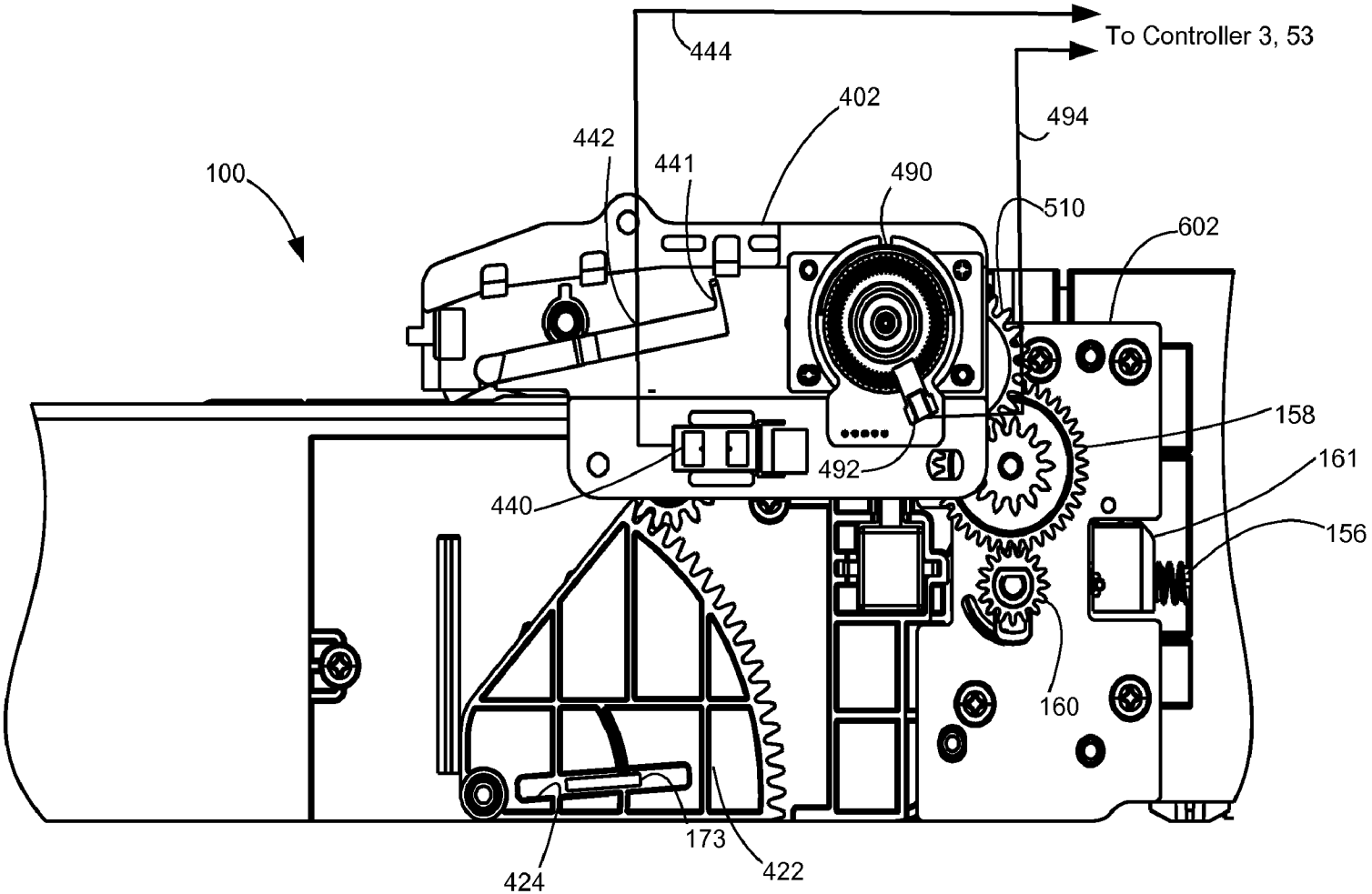
FIG. 19 is a side elevation view of a motor coupled to an encoder wheel according to one example embodiment.

With reference to FIG. 19, motor 404 includes an encoder wheel 490 that rotates with motor 404 providing encoder pulses indicative of the rotation of motor 404. As encoder wheel 490 rotates, an encoder wheel sensor 492 provides an output 494 in the form of pulses to controllers 3, 53 that allows controllers 3, 53 to track the rotation of encoder wheel 490 and motor 404 which may be used to track movement of lift plate 172 and rotation of pick mechanism 300.

Figure 20:
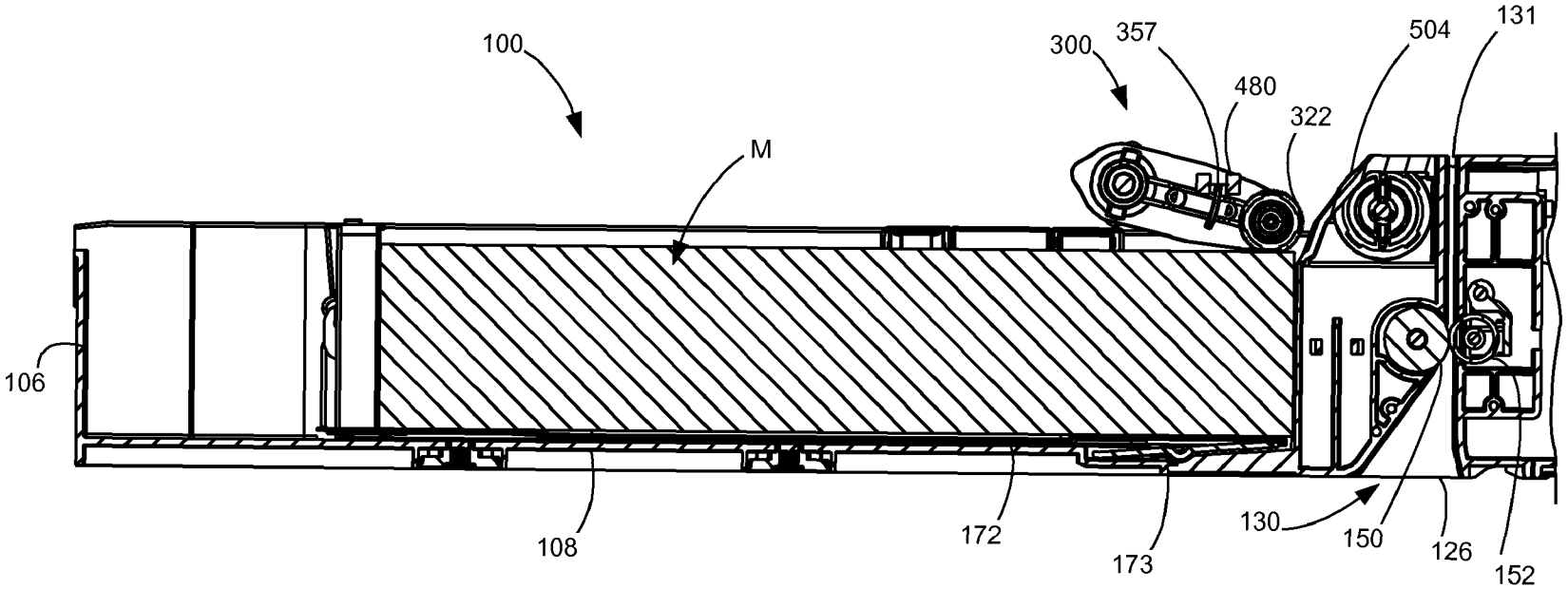
FIG. 20 is a section view of a RMIT according to one example embodiment with media therein.
Figure 21:
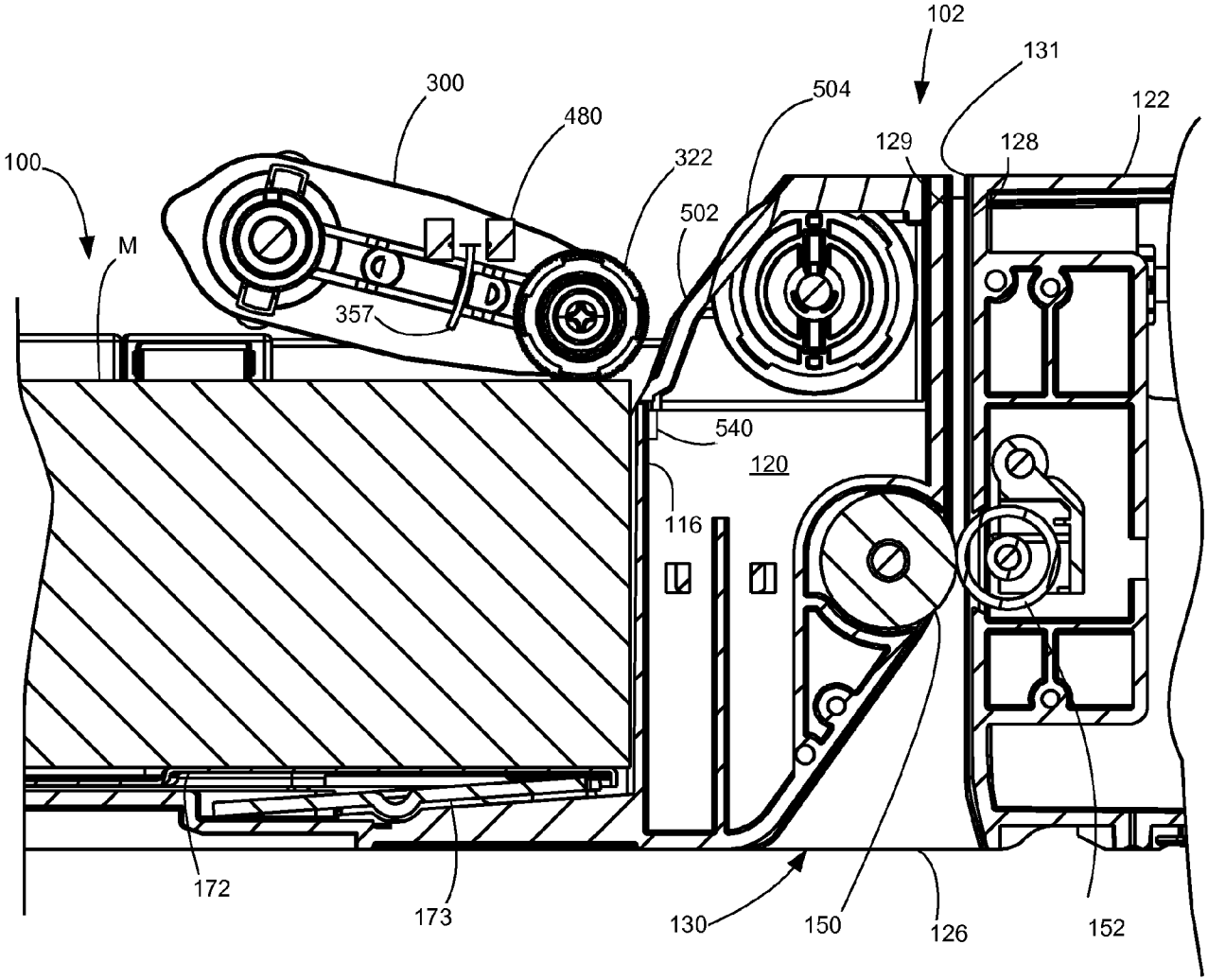
FIG. 21 is a section view of a RMIT according to one example embodiment with media therein.
Figure 22:
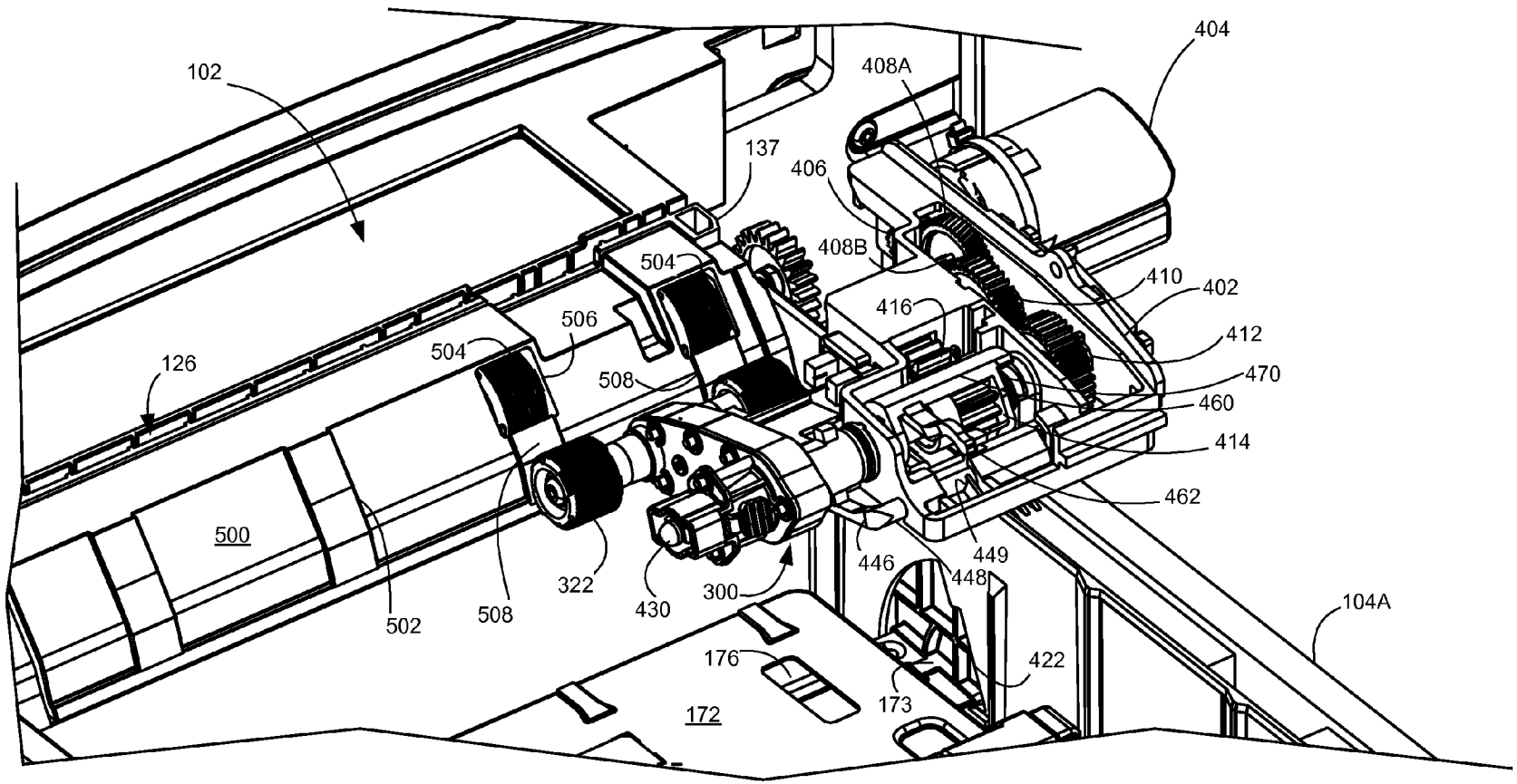
FIG. 22 is a perspective view of a pick mechanism and drive mechanism according to one example embodiment.

With reference back to FIG. 16, an index sensor 480 having an output 484 is positioned on frame 402 adjacent to the drive shaft 426. In the example embodiment illustrated, index sensor 480 is an optical sensor having an optical path between a pair of opposed arms. However, any suitable sensor may be used. In operation, lift plate 172 is raised in indexed moves in order to ensure that the top of the stack of media sheets is within a desired pick height so that the rotational travel of pick mechanism 300 remains within a predetermined range of travel as previously described. When RMITs 100 are inserted into housings 20, 200, controller 3, 53 analyzes output 484 of the index sensor 480 to determine whether upward indexing of lift plate 172 is needed. If index sensor 480 is in a first state when RMIT 100 is inserted (FIGS. 20 and 21), indexing is not required. If index sensor 480 is in a second state, indexing is required (FIG. 22). In the example embodiment illustrated, if the optical path of index sensor 480 is blocked by index flag 357 when RMIT 100 is inserted, no indexing is required. Conversely, if the optical path of index sensor 480 is unblocked, indexing is required. As will be appreciated, reverse logic to that described may also be used.

Figure 23:
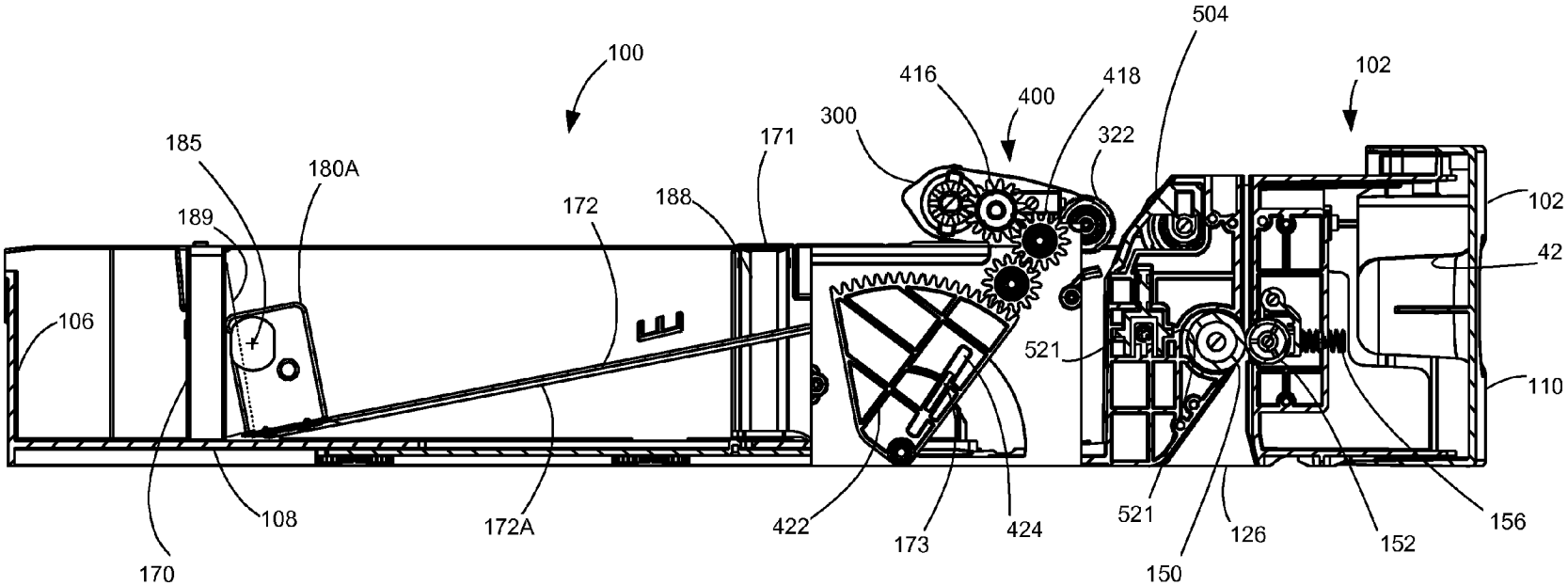
FIG. 23 is a section view of a RMIT with a lift plate in a raised position according to one example embodiment.
Figure 24:
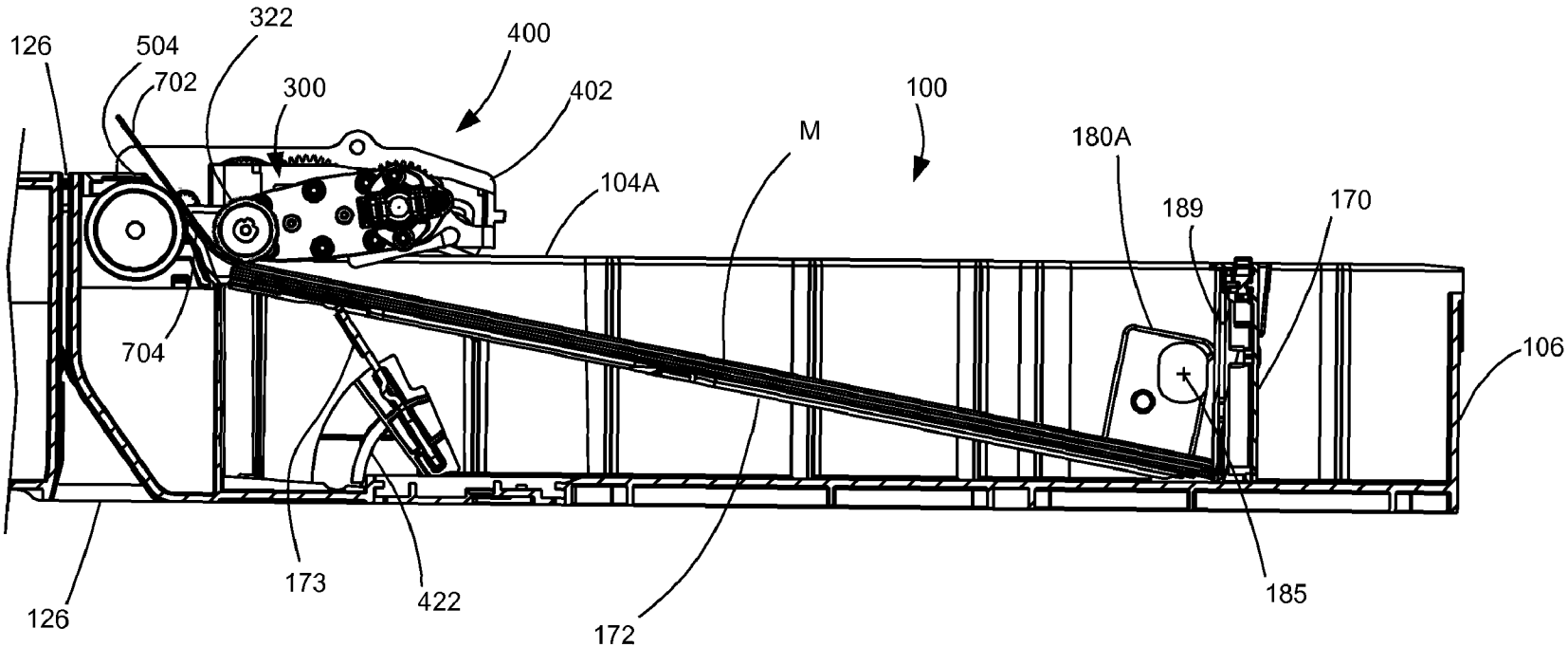
FIG. 24 is a section view of media being fed from a RMIT according to one example embodiment.

With reference to FIGS. 23 and 24, in order to index lift plate 172, motor 404 drives pick mechanism 300 opposite the media process direction and raises lift plate 172 in order to raise the stack of media. Once the top of the stack of media contacts the pick mechanism 300, the stack of media pushes pick mechanism 300 up until index flag 357 changes the state of index sensor 480. After the state of index sensor 480 changes, e.g. from unblocked to blocked, motor 404 continues to rotate for a predetermined number of encoder pulses until lift plate 172 reaches a maximum desired pick height. Once lift plate 172 reaches the maximum desired pick height, pick mechanism 300 is then ready to feed media in the media process direction. As media M is fed, the height of the media stack decreases thereby lowering the position of pick mechanism 300. Eventually, pick mechanism 300 lowers far enough for index flag 357 to change the state of index sensor 480, e.g. from blocked to unblocked, thereby signaling that another index is required. Motor 404 once again drives pick mechanism 300 opposite the media process direction and raises lift plate 172 to raise the stack of media. In some embodiments, when an index is required, motor 404 rotates for a predetermined number of encoder pulses until lift plate 172 reaches the maximum desired pick height. In other embodiments, motor 404 first raises lift plate 172 until index flag 357 changes the state of index sensor 480, e.g. from unblocked to blocked. After the state of index sensor 480 changes, motor 404 then rotates for a predetermined number of encoder pulses until lift plate 172 reaches the maximum desired pick height. The index moves that occur as a result of the reduction in the height of the media stack due to media being fed are referred to as nominal raises or nominal index moves. As media continues to be fed, nominal index moves are repeated to ensure that the pick mechanism 300 stays within the desired pick range until all of the media in RMIT 100 is fed to IFD 2.

When feeding incompressible media, the feeding system includes only one compliant element, the pick mechanism 300 which rotates downward about the drive shaft 426 as it feeds media; both the lift plate 172 and the incompressible media are non-compliant elements. However, when compressible media is fed, the media itself is a compliant element. Feeding difficulty may be encountered when more than one compliant element exists in the feeding system. In order to feed compressible media, such as envelopes or RFID labels, using a pick mechanism 300 that rotates about the drive shaft 426, the force required to buckle the media must be less than the force required to compress the media. When compressible media are placed in RMIT 100, depending on the number of compressible media and the compressibility of the media, initially, the force required to compress the media may be less than the force required to buckle and feed the media. As a result, the media will tend to compress rather than buckle and separate as the compliant pick mechanism 300 continues to rotate downward about the drive shaft 426 and the normal force applied by the pick mechanism 300 to the media stack continues to increase. This compression will continue until the force required to compress the media exceeds the force required to buckle and feed the media at which point the media will buckle and feed. However, in some cases, by this point, the pick mechanism 300 will have rotated out of the desired pick zone.

Accordingly, in some embodiments, in order to accommodate feeding of compressible media, the downward rotation of the pick mechanism 300 is limited. In the example embodiment illustrated, the rotation of the pick mechanism 300 about the drive shaft 426 is limited when the stop(s) 358 contact the abutment 434 (See FIG. 8). At the point where the downward rotation of the pick mechanism 300 is limited, the pick mechanism 300 is converted from a compliant element to a non-compliant element. By converting the pick mechanism 300 to a non-compliant element, the pick mechanism 300 is not able to compress the media further. Typically, the force required to buckle compressible media is less than the force required to buckle incompressible media because compressible media generally does not include edge welds. As a result, at the point where the downward rotation of the pick mechanism 300 is limited, the tackiness of the pick wheels 322 generally allows the pick mechanism 300 to feed the media without compressing it further as long as the coefficient of friction between the wheels 322 and the media is greater than the coefficient of friction between adjacent media.

Further, in those embodiments where the inclined media dam 500 includes a substantially vertical wall portion proximate the media storage location 140 extending downward from the media dam 500, such as back portion 116 of the front wall 102 (See FIG. 5), the downward rotation of the pick mechanism 300 is limited at a point above the intersection between the inclined media dam 500 and the substantially vertical wall portion. This ensures that when the media is fed by the pick mechanism 300, it is able to ascend the media dam 500. If the media were fed below the intersection between the inclined media dam 500 and the substantially vertical wall portion, the leading edge of the media would be fed directly into the substantially vertical wall portion which could result in a misfeed if the media is unable to ascend the substantially vertical wall portion and reach the media dam 500.

In some embodiments, in order to permit the feeding of compressible media, the controller 3 analyzes the state of the index sensor 480 after each pick is completed. The controller 3 compares the state of the index sensor 480 after each pick with the state of the index sensor 480 after the previous pick. When the state of the index sensor 480 changes, for example, when the index sensor 480 goes from blocked to unblocked, the controller 3 raises the lift plate 172. If after a pick is completed, the state of the index sensor 480 is the same as after the previous pick, the controller 3 directs the pick mechanism 300 to feed the next media sheet. Analyzing the state of the index sensor 480 between picks allows the media an opportunity to decompress as the normal force applied by the pick mechanism 300 decreases. As a result, the controller 3 is able to ignore changes in the state of the index sensor 480 that occur during a pick operation as a result of the compression of compressible media.

Figure 25:
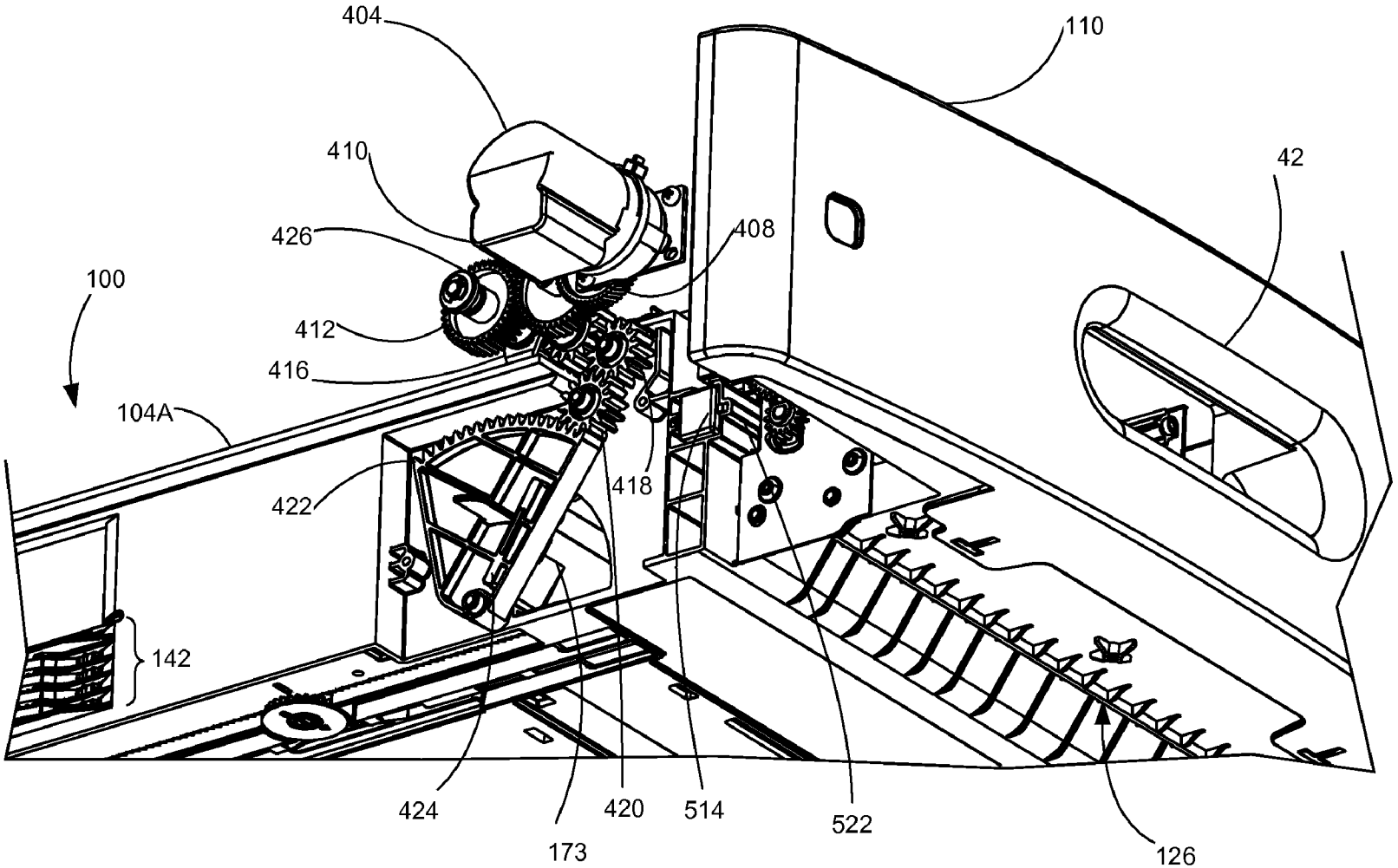
FIG. 25 is a perspective view of a drive mechanism engaged with a lift plate of a RMIT according to one example embodiment.
Figure 26:
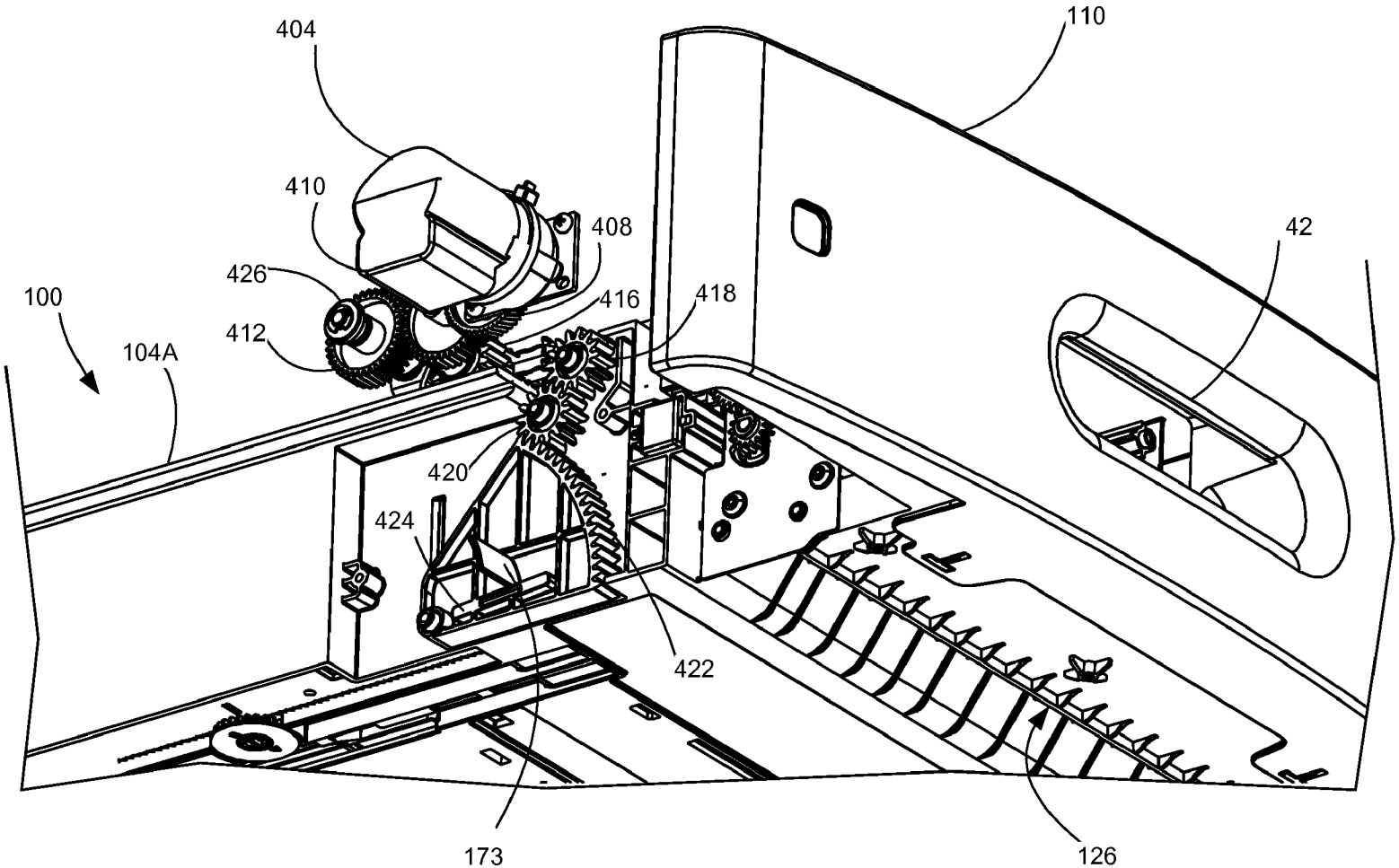
FIG. 26 is a perspective view of the drive mechanism of FIG. 25 disengaged from the lift plate.

With reference to FIGS. 25 and 26, each time RMIT 100 is removed from the housing 20, drive transmission 401 disconnects from the second output 401*c* causing the lift plate 172 to fall to bottom 108 of RMIT 100. As a result, lift plate 172 is presented to the user in a consistent manner for re-filling each time RMIT 100 is removed regardless of the amount of media still remaining in RMIT 100. In the example embodiment shown, when RMIT 100 is removed, the connection between second clutched gear 416 and intermediary gear 418 in the side wall 104*a* is broken. As a result, each time RMIT 100 is reinserted into housing 20, 200 lift plate 172 must be indexed from bottom 108 of RMIT 100 until pick mechanism reaches the maximum desired pick height.

Figure 27:
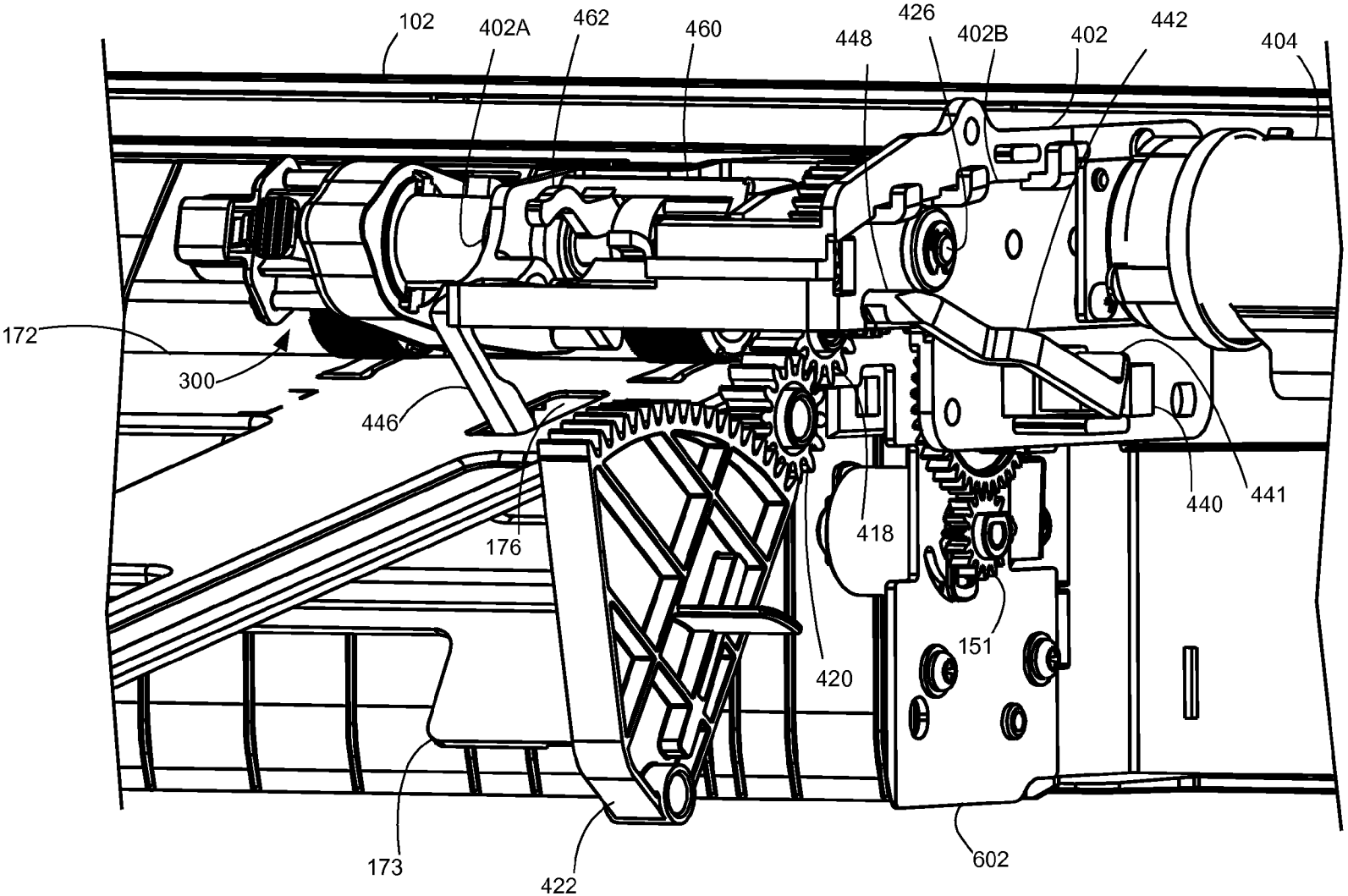
FIG. 27 is a perspective view of a drive mechanism having a lifter according to one example embodiment.

With reference to FIGS. 5, 6, and 27, a media out flag 441 is mounted on frame 402. Media out flag 441 includes a flag arm 442 and a media contact arm 446 connected to one another by a connecting rod 448. Connecting rod 448 has a tab 449 for engaging with a lifter 460 for lifting media contact arm 446 when RMIT 100 is removed from the housing 20. Media contact arm 446 extends from a first side 402A of frame 402 beneath drive shaft 426 while flag arm 442 extends from opposite side 402*b* of frame 402. A media out sensor 440 having an output 444 is disposed on the side 402B of frame 402 opposite drive shaft 426. In the example embodiment illustrated, media out sensor 440 is an optical sensor having an optical path between a pair of opposed arms. However, any suitable sensor may be used. In operation, when media M is present in storage location 140, media contact arm 446 rests on the top of the media stack. When media contact arm 446 rests on the media stack, flag arm 442 is held above the opposed arms of media out sensor 440. When RMIT 100 runs out of media, media contact arm 442 falls through opening 176 in lift plate 172 thereby dropping flag arm 442 into the arms of media out sensor 440 and changing output 444 of media out sensor 440 to indicate that RMIT 100 is out of media.

Figure 28:
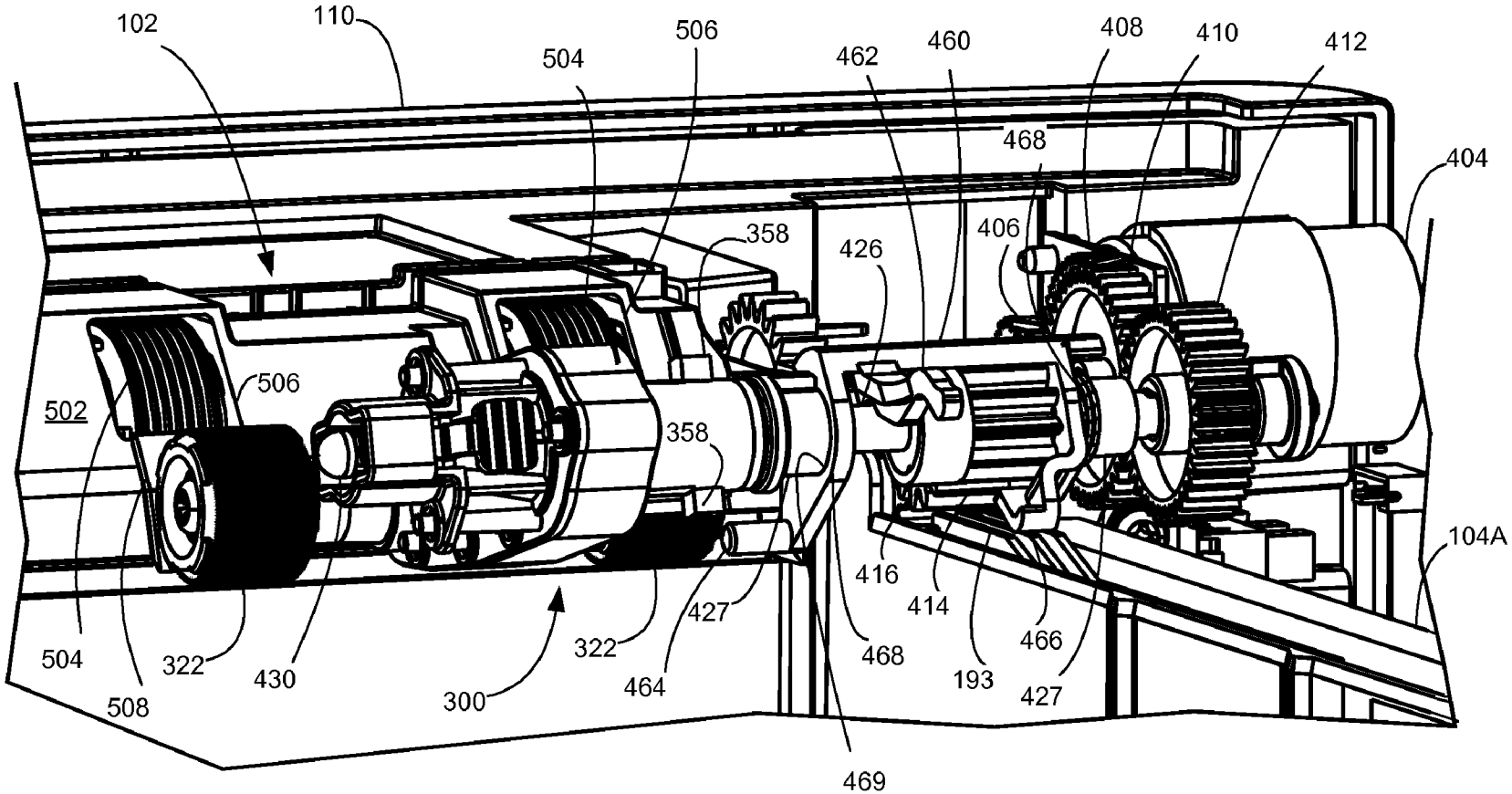
FIG. 28 is a perspective view of a pick mechanism and a drive mechanism engaged with a lifting surface of a RMIT according to one example embodiment.
Figure 29:
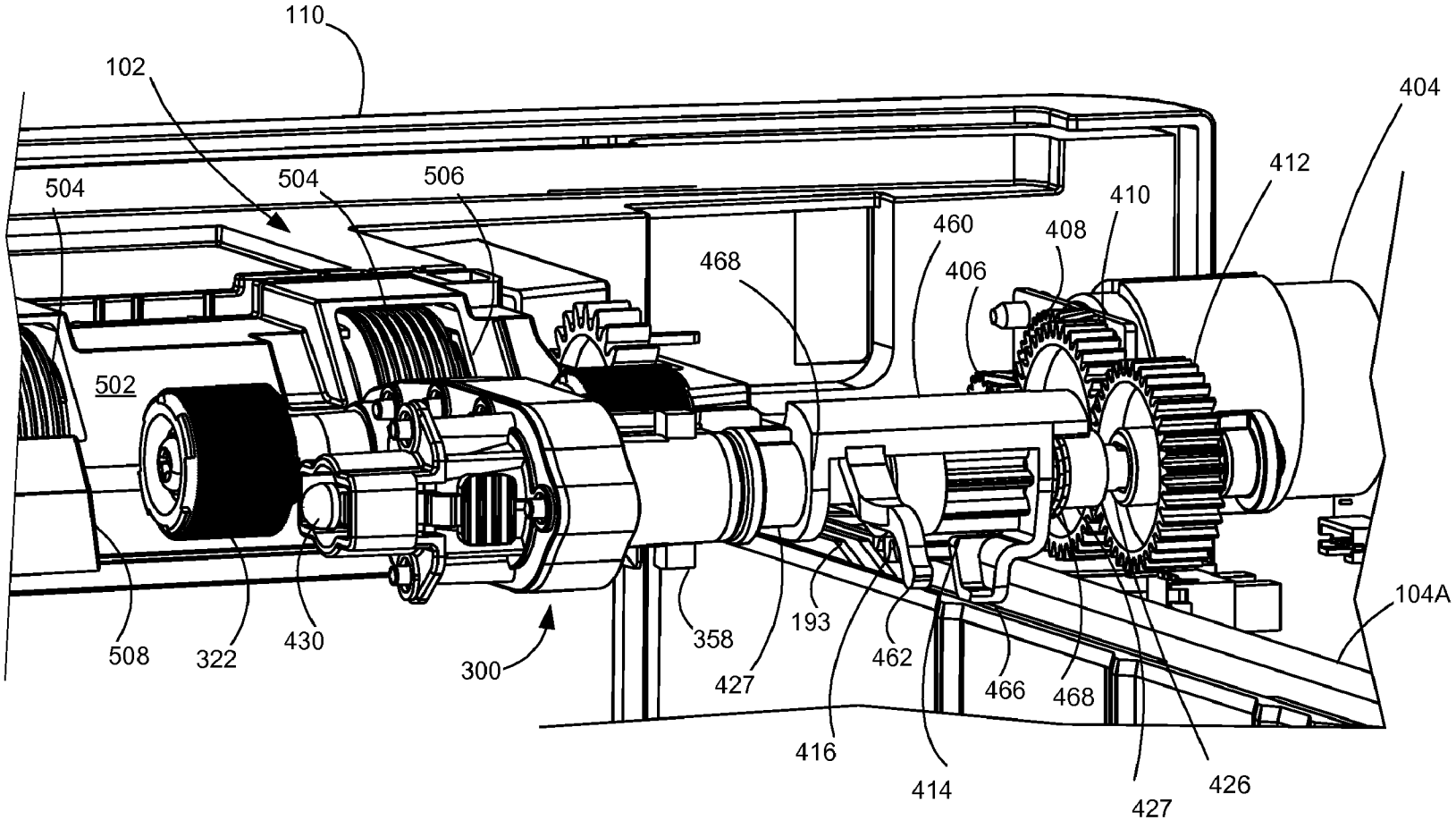
FIG. 29 is a perspective view of the pick mechanism and drive mechanism of FIG. 28 disengaged from the lifting surface.

With reference to FIGS. 28 and 29, drive mechanism 400 includes a lifter 460 for lifting pick mechanism 300 and media contact arm 446 when RMIT 100 is removed so that they are not caught by rear wall 106 as it passes below. Lifter 460 is mounted around drive shaft 426 and first clutched gear 414. Lifter 460 has a hole 469 in each of its ends 468 to receive the drive shaft 426. Lifter 460 includes a first arm 462 for engaging with tab 449 of media out flag 441 and a second arm 464 for engaging with pick mechanism 300. A biasing spring 470 biases lifter 460 toward a home position where first arm 462 is engaged with and depresses tab 449 so that media contact arm 446 is raised and second arm 464 is engaged with and raises pick mechanism 300. A camming surface 466 extends from lifter 460 underneath frame 402. When RMIT 100 is inserted into the housing 20, 200 lifting surface 193 of side wall 104A engages with and causes camming surface 466 to rotate. Rotation of camming surface 466 that results from engagement with lifting surface 193 overcomes the biasing force of biasing spring 470 to rotate lifter 460. This rotation causes first arm 462 to lift off of tab 449 allowing media contact arm 446 to drop freely and causes second arm 464 to lower and disengage from pick mechanism 300 allowing pick mechanism 300 to rotate about drive shaft 426.

Removable Media Dam

Figure 30:
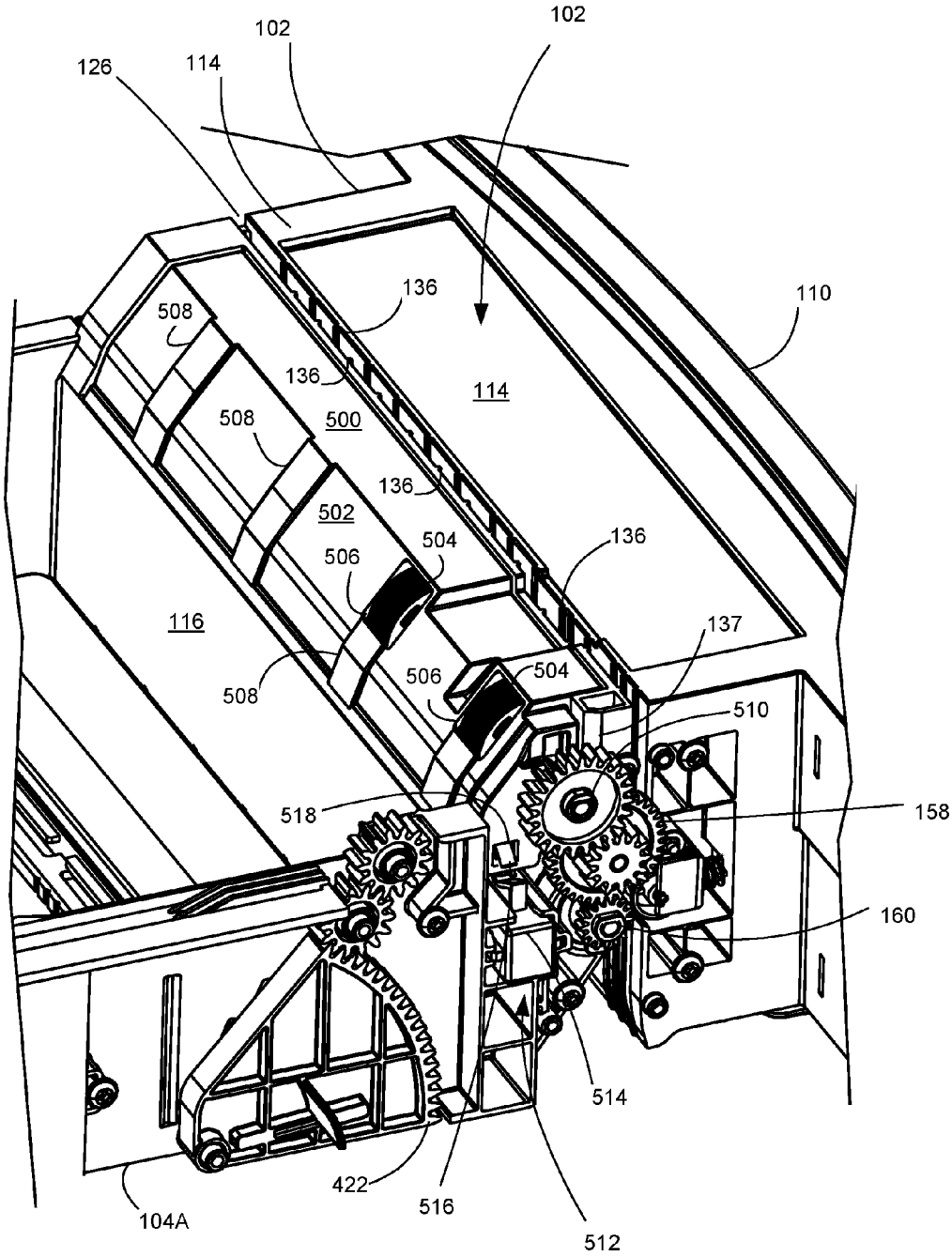
FIG. 30 is a section view of a RMIT illustrating an installed removable media dam according to one example embodiment.

Referring to FIGS. 30-33, removable media dam 500 is illustrated. In FIG. 30, removable media dam 500 is shown mounted in cavity 120 in front wall 102 behind channel 126. Mounts are provided on both front wall 102 and on removable media dam to allow for the detachable mounting of removable media dam in RMIT 100. On media contact surface 502, a pair of spaced apart, rotatably mounted separator rollers 504 are provided in corresponding openings 506 of removable media dam 500. A portion of the surface of each separator roller 504 radially extends through the corresponding opening 506. When the media dam is molded into front wall 102, separator rollers are also provided as described for the removable media dam. Separator rollers 504 may have various tread patterns, like those on a tire on their surfaces which contact the media being fed from RMIT 100. The patterns are a matter of design choice. A plurality of slightly raised wear strips 508 are provided on media contact surface 502. The surfaces of wear strips 508 may have frictional features such as transverse ridges or steps mold therein or provided in a member that is affixed to the surface of wear strips 508. Drive gear 510 is attached to an end of shaft 511 on which separator rolls 504 are mounted. Drive gear 510 also connects, via intermediate gear 158, with drive gear 160 which drives feed roller 150. Backup roller 152 is spring-biased against feed roller 150 forming a nip 154 therebetween (See FIGS. 15 and 35). In one embodiment, drive gear 160, feed roller 150, backup roller 152, and intermediate gear 158 may be mounted to first plate 602 that is attached to side portion 118A. A motor (not shown) provided in housing assembly 200 provides torque for rotating gears 510, 158, and 160.

Figure 31:
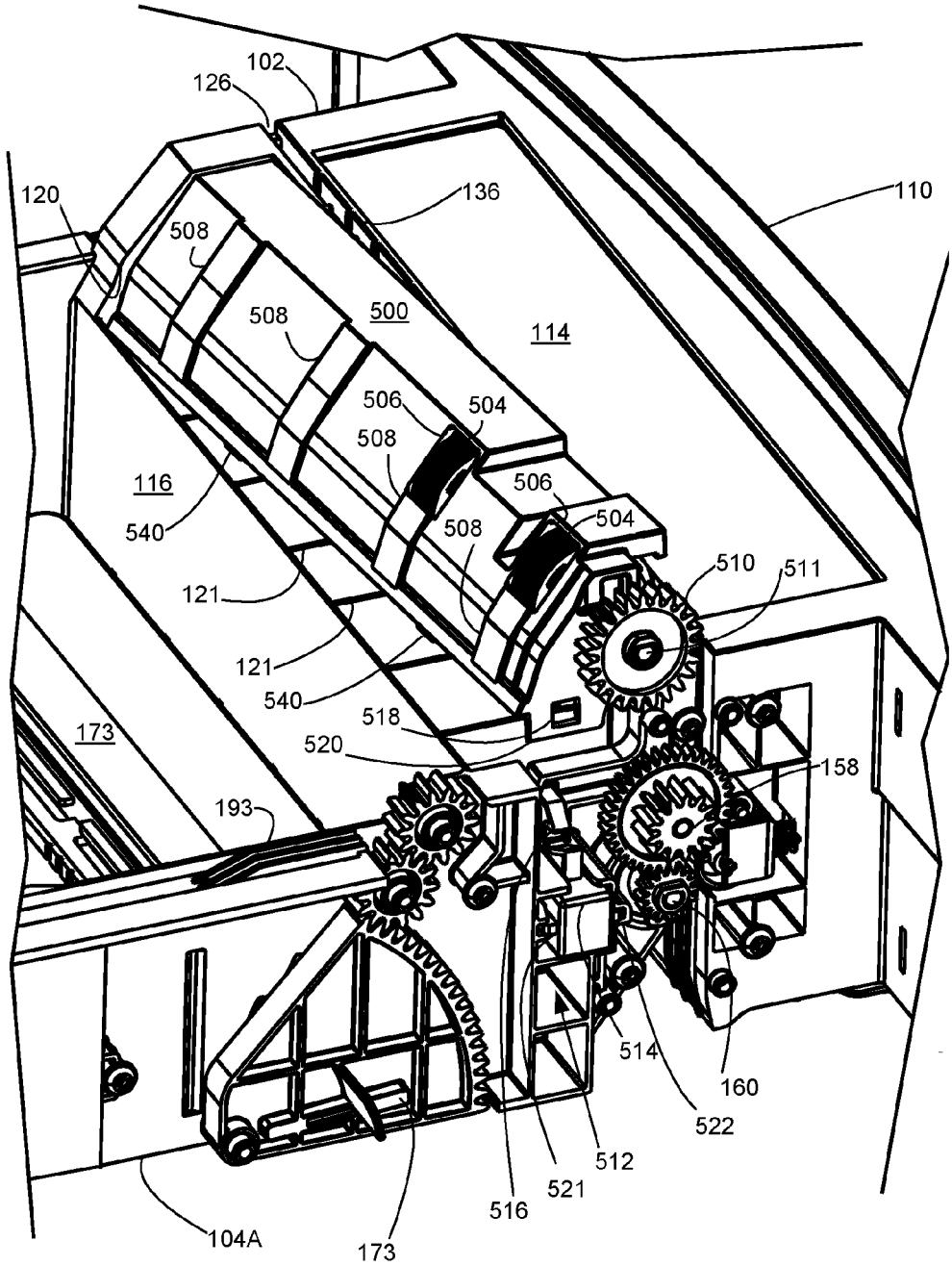
FIG. 31 is a section view of a RMIT illustrating a partially removed removable media dam according to one example embodiment.

In FIG. 31, removable media dam 500 is shown partially removed. Details of latch mechanism 512 according to one embodiment can be better seen. An opening in a side panel 520 of media dam 500 serves as latch catch 518. Actuator 514 has opposed side rails 521 slidably received into guide channels 522. A spring (not shown) is provided at a distal end of actuator 514 to bias actuator 514 toward side wall 104A and to bias latch hook 516 into latch catch 518. Stops (not shown) prevent actuator 514 from being pushed out of RMIT 100. To remove removable media dam 500, actuator 514 is depressed by a user. This allows latch hook 516 to release from latch catch 518, allowing a user to lift removable media dam 500 upwards and out of cavity 120 without the use of tools. Thus in this embodiment, removable media dam 500 is referred to as a tool-free removable media dam. A second side panel 524, opposite the first side panel 520 of the removable media dam 500 has at least one post 526 extending outwardly therefrom which is received in a corresponding opening in a wall of cavity 120. As shown, two posts 526 are illustrated (See FIG. 32). To insert the same or another removable media dam having different configuration of separator rollers 504 and or a different media contact surface 502 or wear strips 508, a user would insert posts 526 into their corresponding openings in the wall forming cavity 120. Removable media dam is then lowered into cavity 120 with latch hook 516 snapping into latch catch 518 completing installation of removable media dam 500. While latching assembly 512 is illustrated, one of skill in the art would recognize that other forms of mounts and snap fit mechanisms can be used to the same effect and that the illustrated latching assembly is not considered to be a limitation of the design.

Removable media dam 500 may also be installed using conventional fasteners such as screws. In such an embodiment, latch assembly 512 would not be provided and removable media dam 500 would not be referred to as a tool-free removable media dam.

Figure 32:
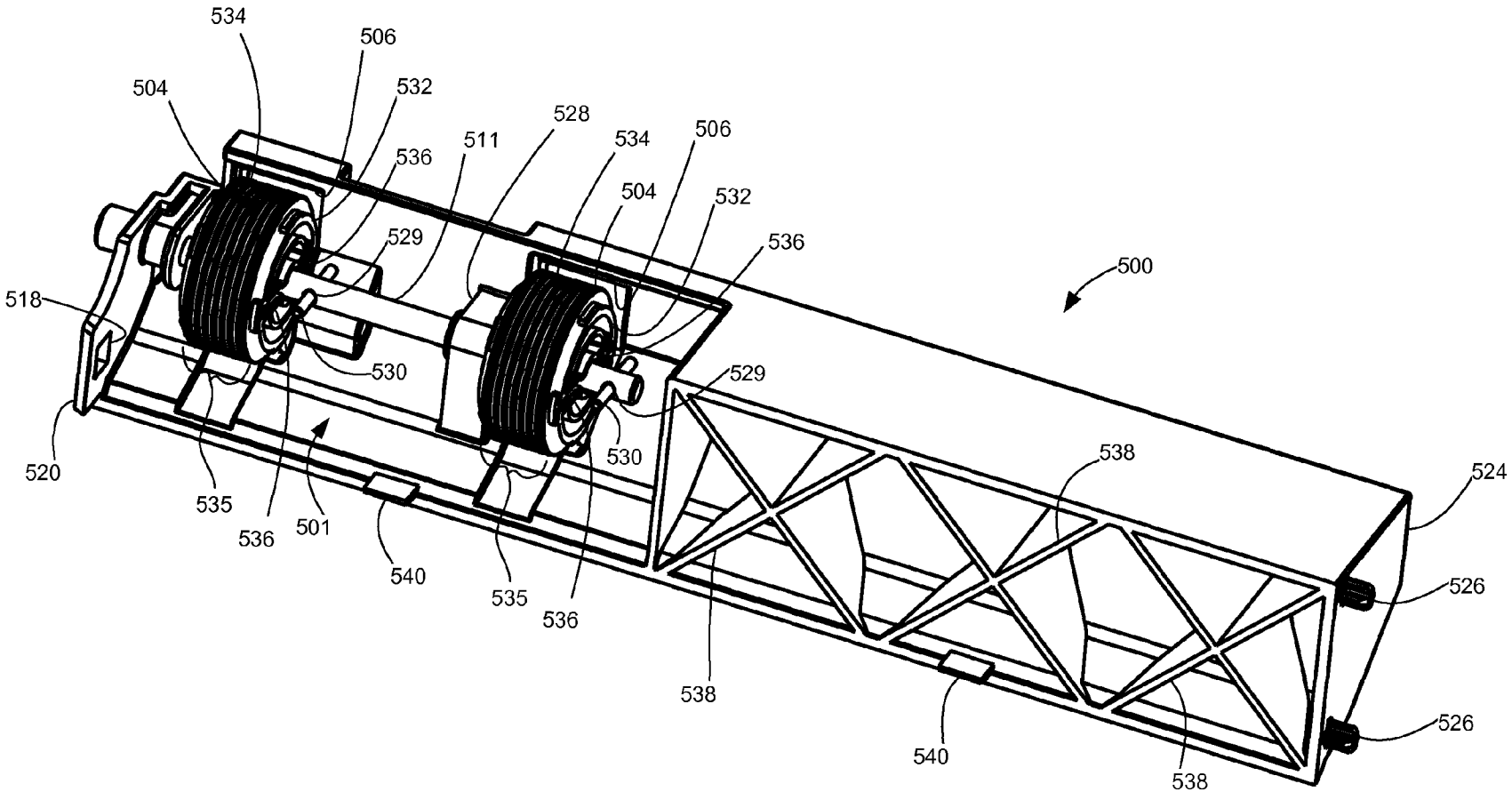
FIG. 32 is a section view of the bottom of a removable media dam showing separator rollers about to be attached to a drive shaft according to one example embodiment.
Figure 33:
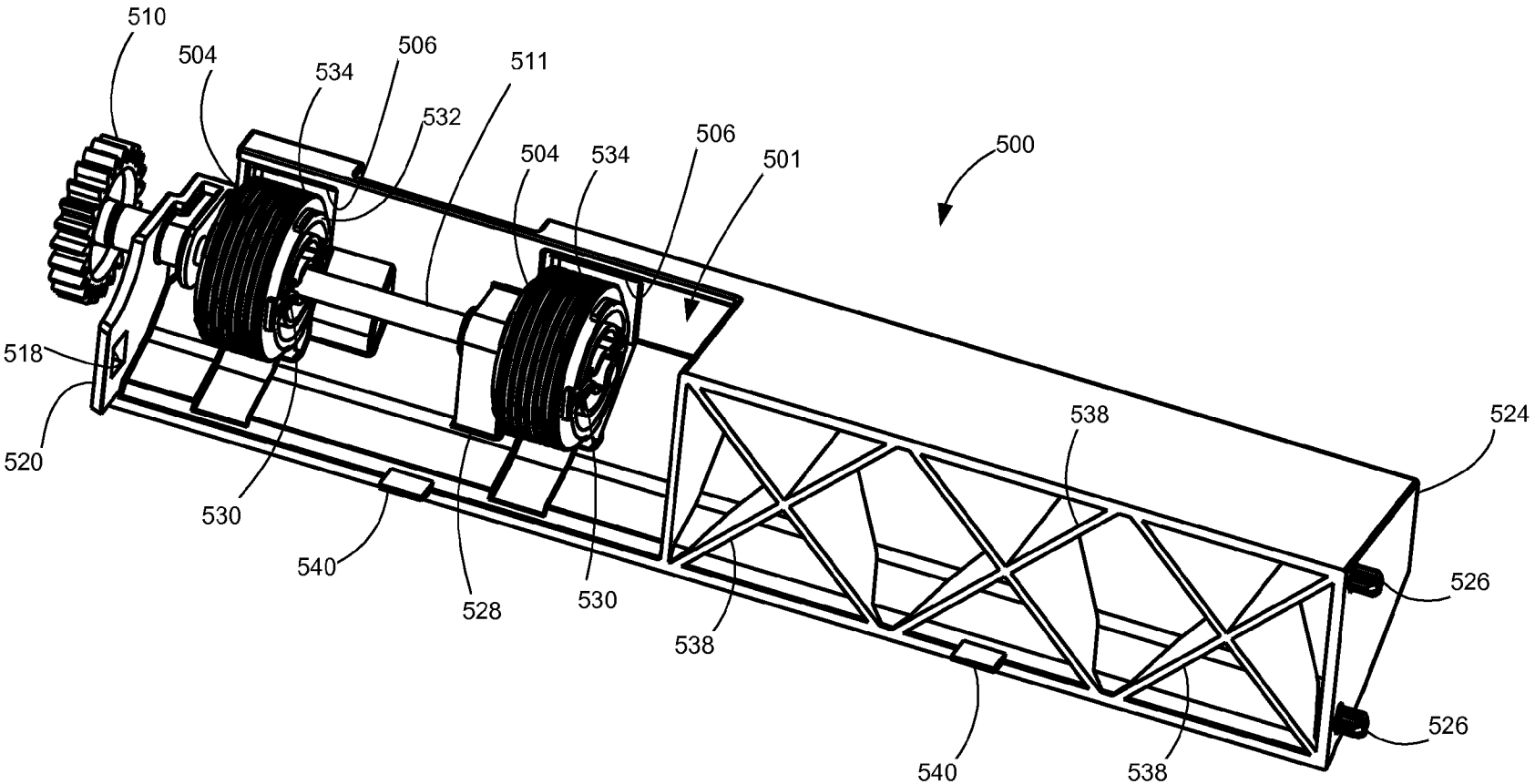
FIG. 33 is a section view of the bottom of a removable media dam with separator rollers attached according to one example embodiment.

FIGS. 32 and 33 illustrate one embodiment of the attachment of separator rollers 504 to removable media dam 500. A cavity 501 is provided on the underside of removable media dam 500 for the mounting of separator rollers 504. As shown, shaft 511 which passes through an opening in side panel 520 then through one of the separator rollers 504, then through bearing 528 and then the second separator roller 504. Transverse holes 529 are provided in shaft 511 to receive pins 530. Each separator roller 504 comprises a hub 532 and tire 534 having treads 535. Hubs 532 are provided with channels 536 that engage pins 530 that are inserted into holes 529. Hubs 532 are slip fit onto pins 530 by pulling shaft 511 outwardly from side panel 520. Support ribs 538 are provided in cavity 501 to stiffen removable media dam 500. Tabs 540 extending from the lower rear edge of media dam 500 slide in behind the upper edge of rear portion 116 to help stiffen rear portion 116. Other configurations for separator rollers 504 may be used, for example one separator roller or 3 or more separator rollers.

Figure 34A:
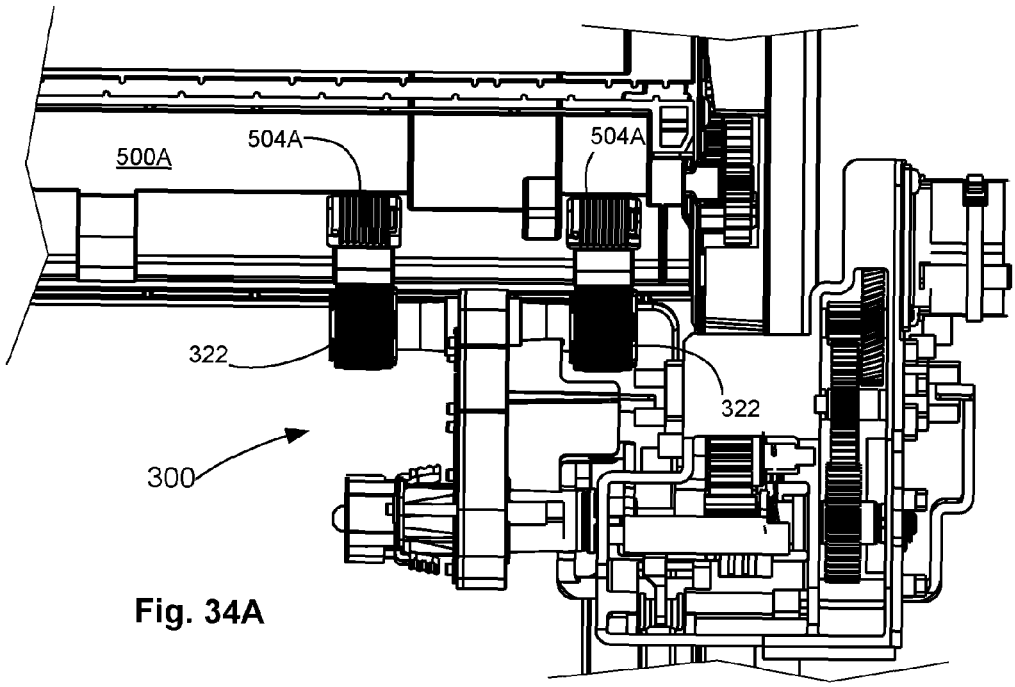
FIGS. 34A and 34B are an alternate arrangement of separator rollers in a removable media dam.
Figure 34B:
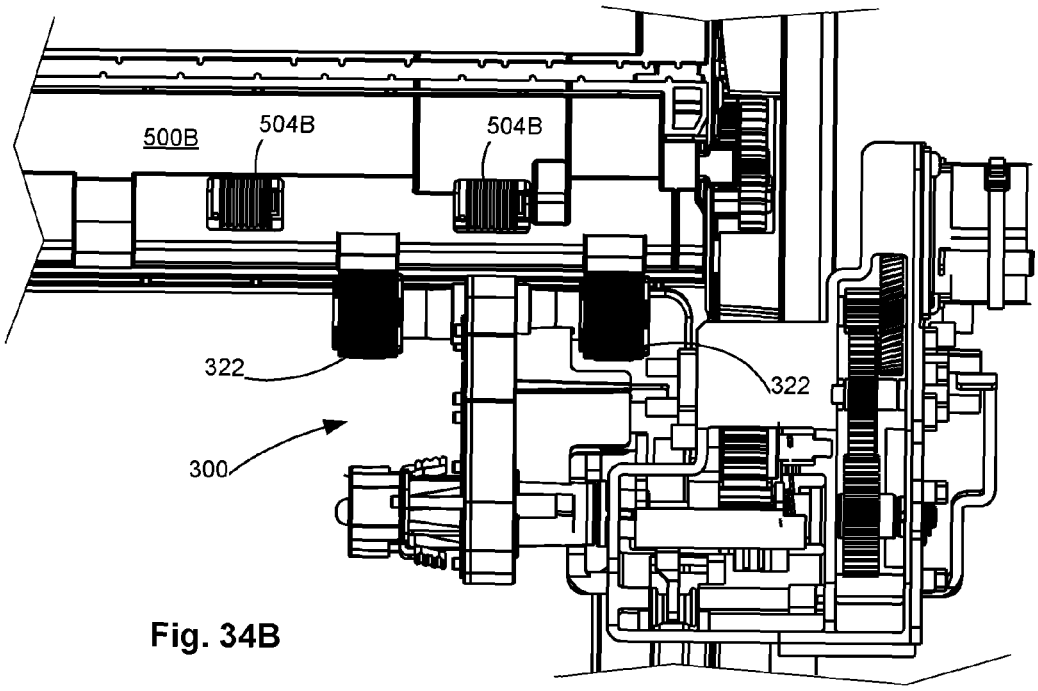

Removable media dam 500 allows a user to replace a removable media dam having worn separator rollers 504 with a new removable media dam having new separator rollers, or to use separator rollers having a different tread, or a media dam having a different number or different configuration of separator rollers without the need to have different RMITs, or a different number configuration of wear strips or patterns used on the wear strips. FIGS. 34A and 34B show two embodiments of a removable media dam having different configurations for separator rollers 504. FIG. 34A shows for media dam 500A, a separator roller 504A aligned with each the pick wheel 322 of pick mechanism 300. FIG. 34B shows for media dam 500B, the separator rollers 504B being transversely or laterally offset from pick tires 302 of pick mechanism 300.

Figure 45:
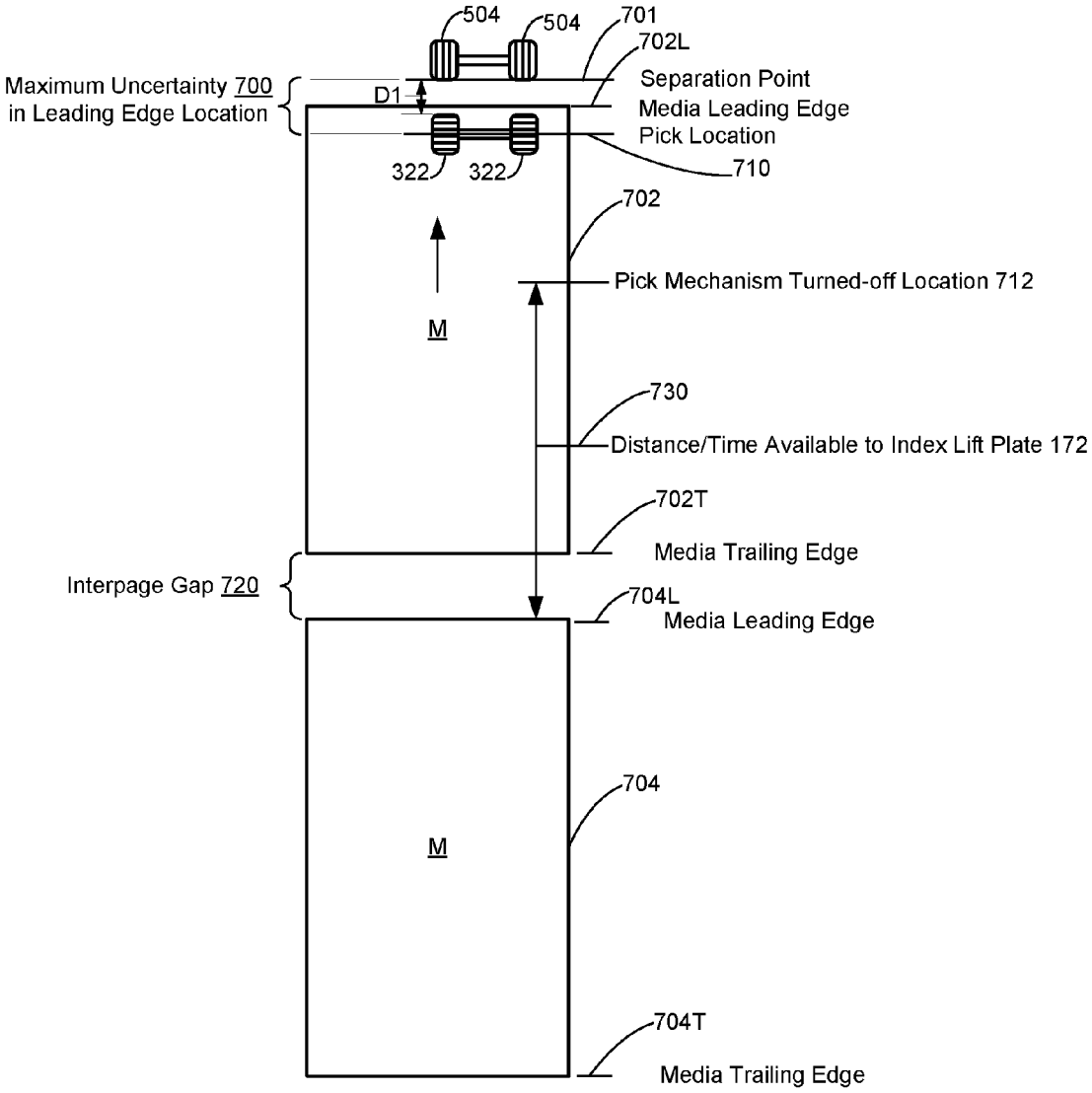
FIG. 45 is a schematic representation of media feeding from an RMIT according to one example embodiment.

As illustrated, separator rollers 504 are positioned opposite the pick wheels 322. The separator rollers 504 rotate in a direction counter to the media process direction of the pick wheels 322 when pick mechanism 300 is feeding media M from RMIT 100. In some embodiments, the separator rollers 504 are rotated counter to the media process direction throughout the duration of each pick cycle. Separator rollers 504 in some embodiments rotate at a slower speed than that of the pick wheels 322, such as between 40-60 percent of the rotational speed of the pick wheels 322. The counter rotation of the separator rollers 504 helps to prevent shingling and misfeeds of media. Referring also to FIGS. 24 and 45, during shingling a second or following sheet 704 is also fed from the top of the media stack but its leading edge is slightly behind or shingled with respect to topmost sheet 702 being fed. As both media approach the separator rollers 504, the leading edge 702L of topmost sheet 702 strikes the surface of the separator roll tangentially and continues across the surface. If topmost sheet 702 is skewed when it reaches the separator rollers 504, then one side of the leading edge 702L will reach the separator rollers 504 before the other thereby encountering a drag force that will correct the skew. The leading edge 704L of shingled media sheet 704 strikes the surface of the separator rollers 504 in a normal direction and is stopped by separator rollers 504 while the topmost media 702 continues being fed. The separator rollers 504 return the second media sheet 704 to a separation point upstream and adjacent the separator rollers 504.

Separator rollers 504 and pick wheels 322 form what is termed an open nip in that as shown the separator roller 504 is downstream and spaced away from pick wheels 322. The use of an open nip allows pick mechanism 300 to be placed in a variety of positions such as being center referenced or being edge referenced as illustrated. An advantage of using an open nip design lies in its ability to deskew media as just described. Also, mounting pick mechanism 300 adjacent to side wall 104A leads to a more compact design and the ability to more reliably feed narrow media in media trays not incorporating media biasing systems that center media about the pick mechanism. In prior art systems, the pick mechanism was positioned about a front-to-back centerline of the media storage area within the media tray in order to minimize skewing forces on the media caused by the pick mechanism when feeding media.

The tangential point of contact between the topmost media sheet and separator rollers 504 is spaced vertically above the tangential point of contact between the topmost media sheet and the pick wheels 322. As illustrated, the distance between the surfaces of pick wheel 322 and separator rollers 504 is about 10 mm. In prior art, the separator roller is placed further downstream of the pick point of the media, for example 50-150 mm, which increases the amount of uncertainty in the location of the leading edge of the shingled media and also increases the overall size of the entire imaging system 1. In such prior art arrangements, a separate backup roller is provided with the separator roller forming a nip therebetween. By use of the open nip arrangement between pick wheels 322 and separator rollers 504, the amount of leading edge uncertainty is reduced by a factor of 5 or more. This in turn allows the interpage gap spacing between successive sheets to be reduced increasing media feed through for a given speed. The open nip allows for removal of the separator load after pick mechanism 300 is turned off which removes any drag caused by separator rolls 504 on the media that may cause skewing. Also a backup roller can be eliminated from the media path.

Feed Through Media Path Extension and Media Reference Edge Guide System

Figure 35:
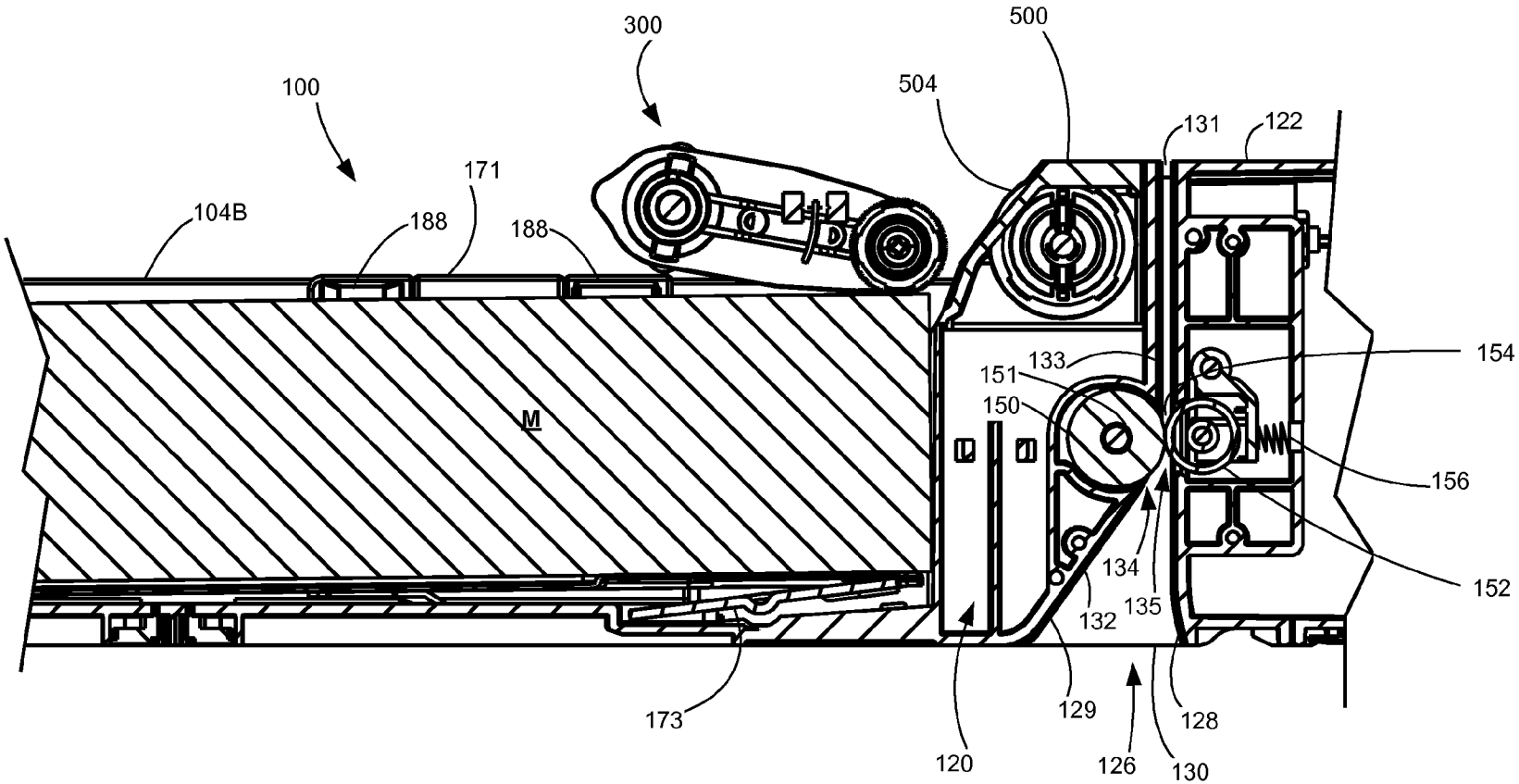
FIG. 35 is a section view of the RMIT illustrating a feed through channel and a filled media storage location according to one example embodiment.

With reference to FIG. 35, in front of a media dam, such as removable media dam 500, a channel 126 is provided to allow for media M to be fed through RMIT 100. Channel 126 is positioned between side walls 104 having a length and width to accommodate various widths and thicknesses, respectively, of media M being fed to IFD 2. As illustrated, the depth of channel 126 extends the first height H1 from the top portion 122 through the bottom 108. Channel 126 along with corresponding slots in housing 200 form a media path extension PX allowing media to be fed through option assembly 50.

Channel 126 comprises a front wall 128, a rear wall 129, a bottom opening 130 and a top opening 131. In one embodiment, the width of bottom opening is greater than the width of the top opening. Front wall 128 of channel 126 extends vertically between the top and bottom openings 130, 131. Rear wall 129 of channel 126 has an angled section 132 that tapers upwardly from bottom opening 130 toward top opening 131 of channel 126 where it connects with a vertical section 133 of rear wall 129 that extends to top opening 131. Corresponding openings 134, 135 are provided in rear and front walls 129, 128 respectively of channel 126. Feed roller 150 is rotatably mounted on shaft 151 in cavity 120 and has a portion of its surface projecting through opening 134 into channel 126. One end of shaft 151 passes through an opening on first plate 602 on which drive gear 160 is mounted. Backup roller 152 is rotatably mounted in carrier 161 in opening 135 and its surface forms a nip 154 with feed roller 150 in channel 126. Backup roller 152 may be biased toward feed roller 150 by a biasing means, such as a spring 156 positioned between carrier 161 and a wall of opening 135. In one embodiment, carrier 161 is pivotally mounted to first plate 602 at post 153 (See FIGS. 39A, 39B).

The rotational axes of the feed roller 150 and the backup roller 152 are spaced vertically below the rotation axis of the separator rollers 504. This minimizes the height of the RMIT 100 and in turn the height of the IFD 2. Embodiments include those wherein the feed roller 150 and the separator rollers 504 are connected to a common drive source. As shown in FIGS. 30 and 31, the separator roller drive gear 510 which drives the separator rollers 504 is connected to drive gear 160 via transfer gear 158. Drive gear 160 is attached to an end of the shaft (not shown) on which the feed roll 150 is mounted. As discussed above, a motor (not shown) provided in housing assembly 200 provides torque for rotating gears 510, 158, and 160.

Figure 36:
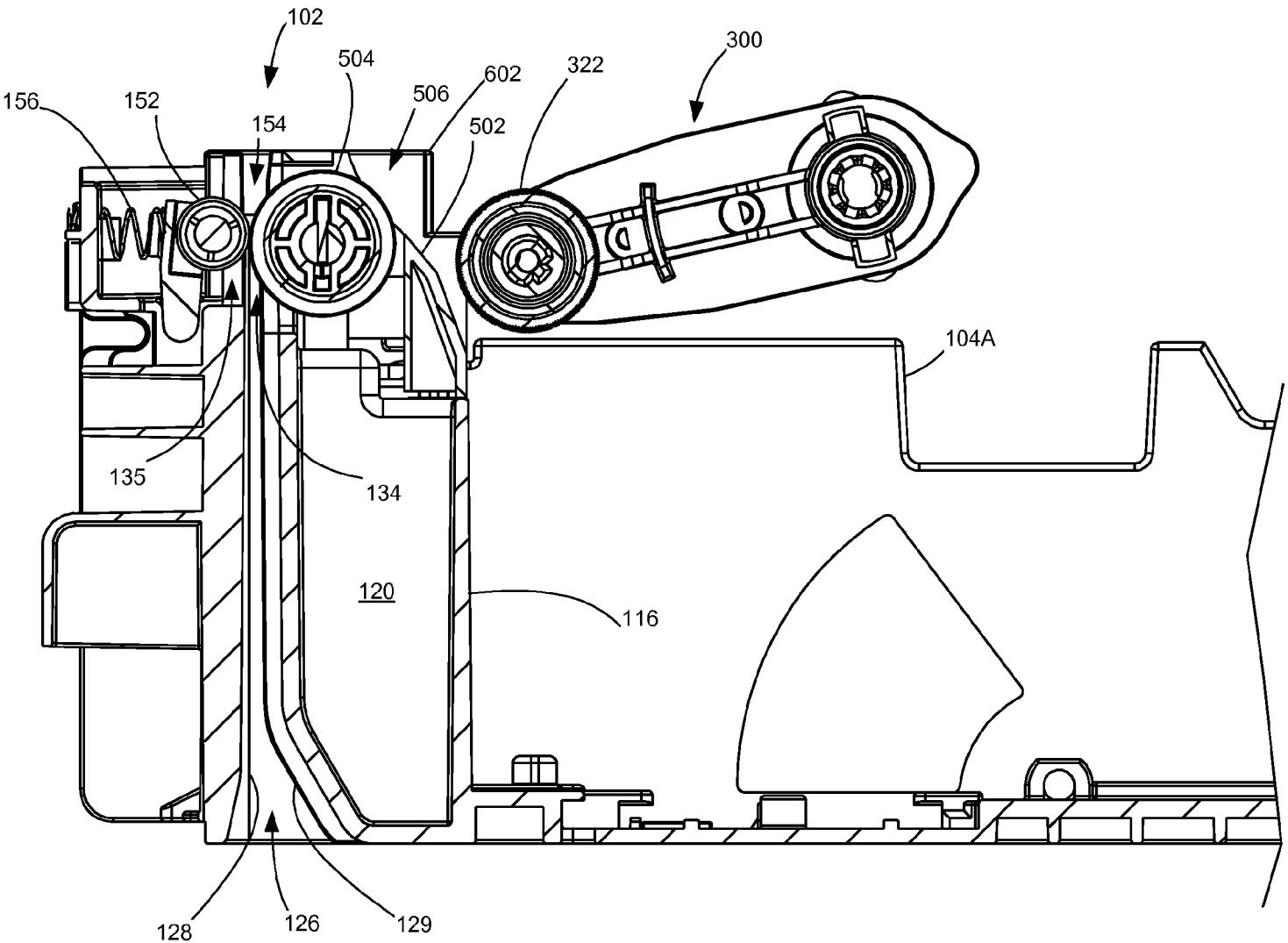
FIG. 36 is an embodiment of an RMIT having a separator roller performing both media separation and pass through media feeding.

With reference to FIG. 36, an alternative embodiment is shown wherein the nip 154 is formed by a separator roller 504 and backup roller 152. In this configuration, the separator roller 504 aids in separating shingled fed media and functions as the feed roller to the nip 154. Accordingly, a separate feed roller 150 is no longer necessary. Further, because the separator roller 504 is driven by drive gear 510, transfer gear 158 and drive gear 160 may be eliminated. A first portion of the outer surface of the separator roller 504 extends radially through opening 506 into the media feed path. A second portion of the outer surface of the separator roller 504 extends radially through opening 134 in rear wall 129 into channel 126. Backup roller 152 extends radially through opening 135 in front wall 128 into channel 126. Backup roller 152 may be biased toward separator roller 504 by a biasing means, such as a spring 156.

Figure 37:
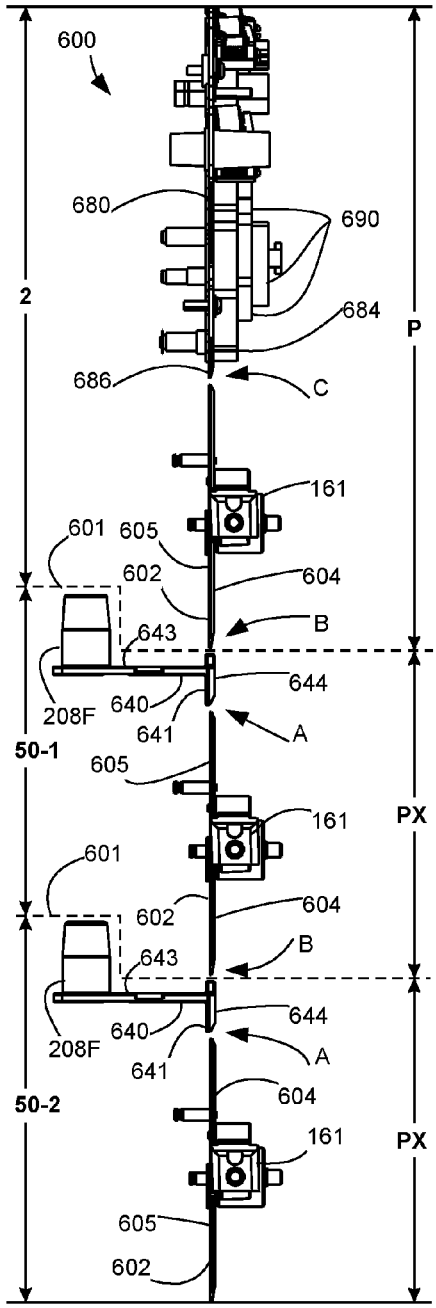
FIGS. 37 and 38 illustrate a media edge guide reference system according to one example embodiment.
Figure 38:
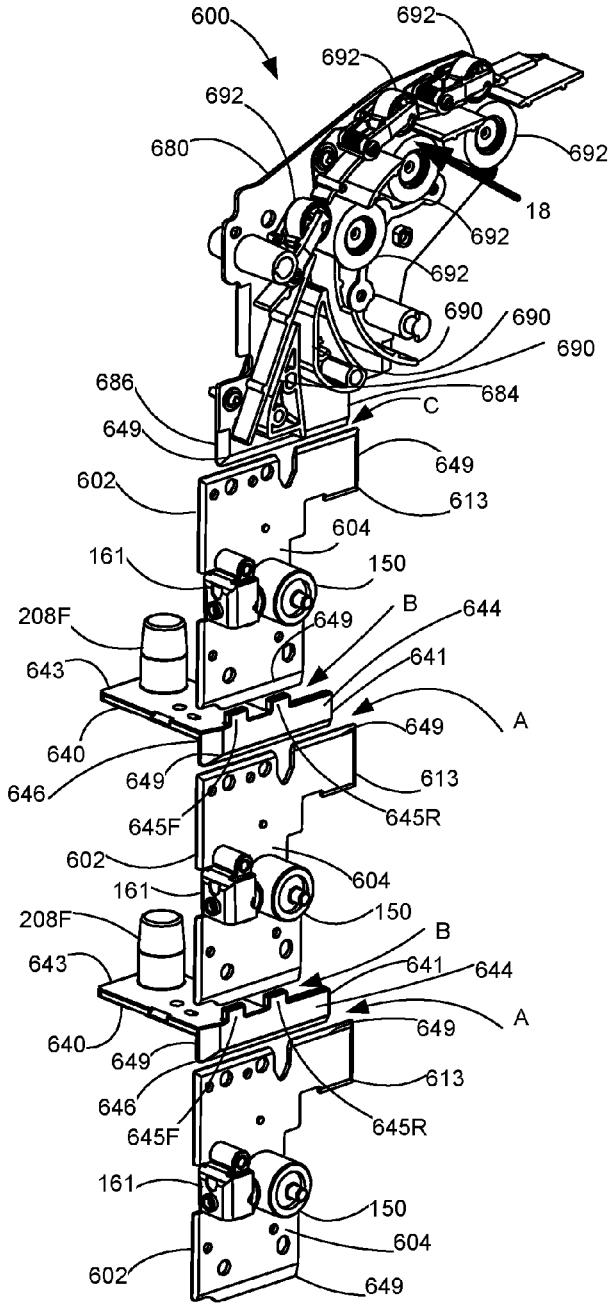

With reference back to FIGS. 30 and 31, a plurality of spaced vertical ribs 136 are provided on the surface of the front and rear walls 128, 129 of channel 126. Ribs 136 are used to support the media passing through channel 126. Ribs 136 are spaced across the width of channel 126 so that one or more ribs 136 will fall within the width of most common media types that will be fed from RMIT 100 and that one of those ribs 136 will be within a few millimeters of the edge of the media M being fed. With reference to FIGS. 37 and 38, in some embodiments, one end of channel 126 is formed by a plate 602 attached to side wall 104A. In other embodiments, a vertically oriented rectangular post 138 is provided at the end of channel 126 and adjacent side wall 104A and abuts a media reference surface 604 of first plate 602. Plate 602 and post 138, when provided, are part of a media reference edge guide system 600 that keeps the media M in proper alignment as it travels through or into media path extensions PX found in an option assembly 50 and on to media path P of IFD 2.

In prior art design, the media feed roller was placed above the media exit from the media contact surface 502 and above the top of channel 126 in housing 20 or housing 200. This placement increased the overall height of the option assembly by about 20 mm over the presently described option assembly 50. Typically image forming systems may employee 3 to 5 option assemblies or more. For such systems this means option assembly 50 saves 60 to 100 mm or more in the overall height of the image forming system 1. With the present arrangement, feed roller 150 of a given unit pulls media from the unit positioned beneath and feeds it to the unit above it.

Referring to FIGS. 37-43, a substantially continuous media edge reference guide (MERG) system 600 is illustrated. In prior art designs the media edge reference guides were subject to large vertical gaps and vertical misalignment from unit to unit within the media path P and path extension PX due to tolerance stack ups of components within a unit. As viewed in FIGS. 37 and 38, vertical misalignment refers to a left or right displacement from the media path P or media path extension PX. In FIGS. 37 and 38 only the reference guide system elements of the media path P within IFD 2 and media path extensions PX within option assemblies 50-1, 50-2 are shown for purpose of clarity. In FIGS. 37 and 38 there is shown a MERG system 600 for IFD 2 mounted on top of two option assemblies 50-1, 50-2. Boundaries between the various units in the stack are indicated by the dashed lines 601 in FIG. 37. Beginning at the bottom of each figure and working vertically upward there is a first plate 602 then a second plate 640 for option assembly 50-2. Next in line going upward is first plate 602 and second plate 640 for option assembly 50-1. Continuing upward, first plate 602 is provided in RMIT 100 that is integrated into IFD 2. At the top is the media edge reference base plate 680 found in IFD 2. The components just described are made from steel or other durable material and may be chromed or plated to provide for enhanced resistance to the wear caused by the media moving along media path P, media path extensions PX, and media path branches PB.

Vertical media edge reference surfaces 604, 644 and 684 are provided on first, second and base plates 602, 640, and 680, respectively. Gap A is found between first and second plates 602, 640 within a given option assembly 50. Gap B is found between the top of second plate 640 of one option assembly and the first plate of the immediately superior RMIT 100. Gap C is found between the top of first plate 602 in RMIT 100 of IFD 2 and the bottom edge of base plate 680. Gap A is about 2.3 mm+/−0.4 mm. Gap B is about 2 mm+/−0.3 mm while Gap C is about 2.3 mm+/−0.25 mm. The total vertical distance from the bottom edge of first plate 602 in the bottom unit to the top of first plate 602 in IFD 2 is approximately 330 mm with a total of only 6.6 mm in gaps. Reference surfaces 604, 644, 684 form a substantially continuous surface against which an edge of media being fed is biased against to ensure alignment of media M as it travels along media path extensions PX and media P path. Further each option assembly 50 has an overall height of about 100 mm with the media reference surfaces 604, 644 forming a substantially continuous reference surface save for gap A within option assembly 50. Because of the relatively small size of gaps A-C, the chance of media misalignment and media edge damage occurring as media transitions from one reference surface to the next is significantly diminished. Beveling 649 may also be provided on the bottom edges of first, second and base plates 602, 640, and 680 which aids in the transition of media as it is fed up the media extensions PX and media path P. Beveling 649 is also provided on the front edges 646, 686 of second and base plates 640, 680, respectively, and on rear edge 613 of first plate 602. First plates 602 are vertically mounted on side portions 118A of front wall of RMITs 100.

Figure 39B:
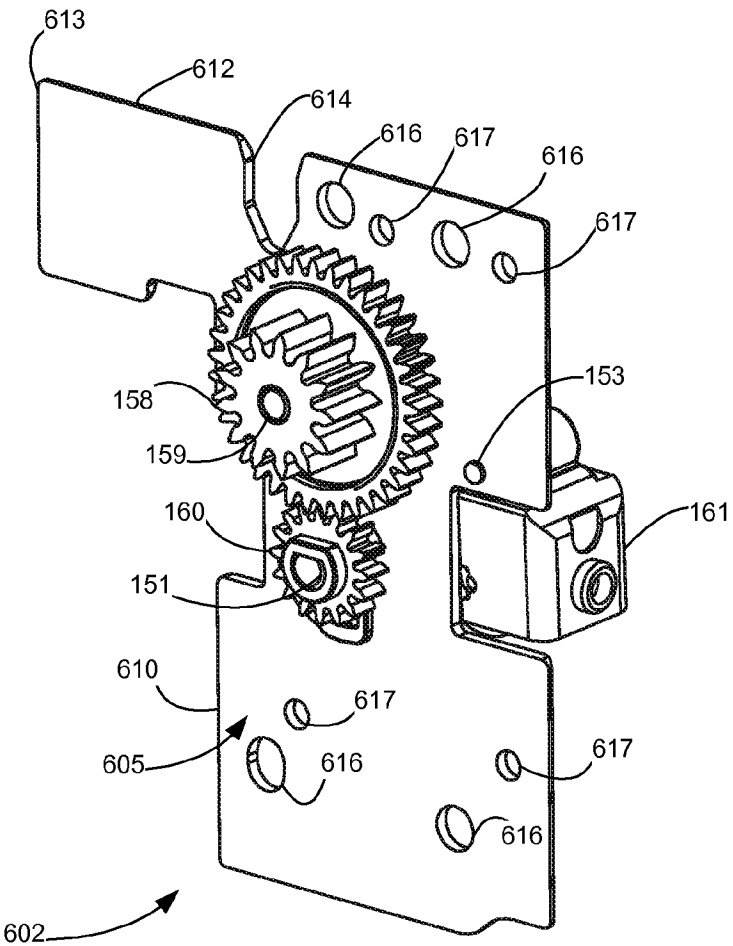
FIGS. 39A and 39B illustrate the front and back surfaces of a portion of the media edge guide reference system according to one example embodiment.
Figure 39A:
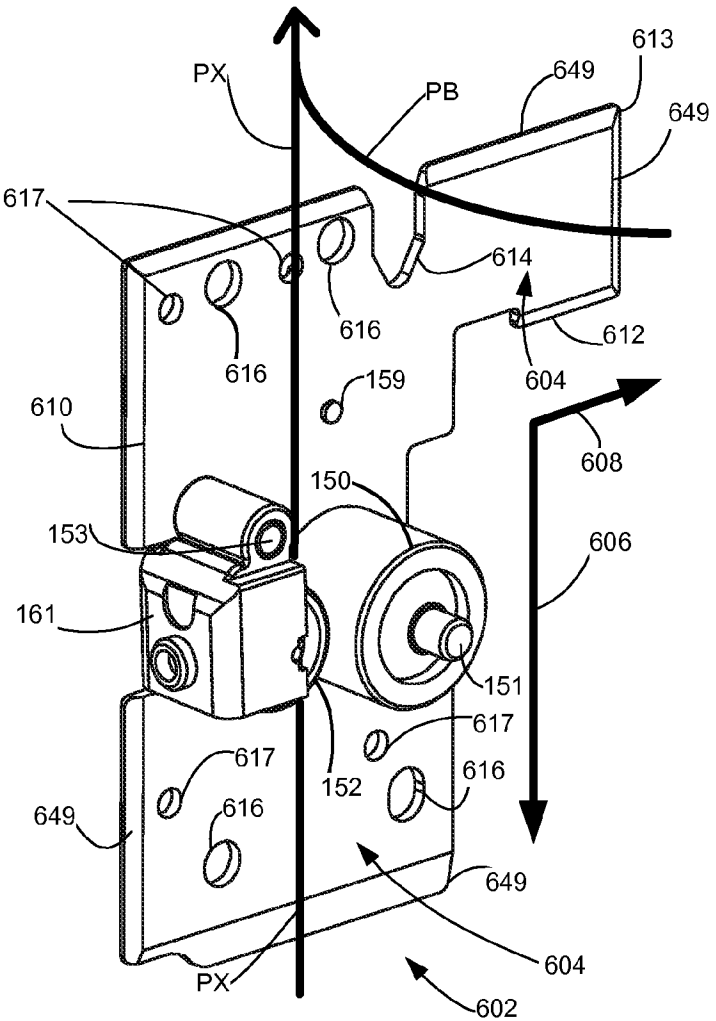

As illustrated in FIGS. 39A, 39B, reference surfaces 604 of first plates 602 extend in a first direction 606 the height H1 of side portion 118A and extend in a second direction 608 into media storage location 140. In one embodiment, the extension in second direction 608 is about 5 mm rearward of the back portion 116 of front wall 102. An edge of media traveling through channel 126 or being fed from storage location 140 contacts and is aligned with reference surface 604. In one embodiment, first plate 602 has first and second legs 610, 612 extending in first and second directions 606, 608, respectively.

First plate 602 also may have a number of holes 616 for use with fasteners that attach first plate 602 to side portion 118A of front wall 102. Further, a plurality of alignment holes 617 may also be provided which receive corresponding posts or projections provided on side portion 118A which ensure that first plate 602 is properly aligned and oriented on side portion 118. In the top edge of first plate 602, a notch 614 may also be provided to accommodate drive shaft 511 of removable media dam assembly 500 when it is installed in front wall 102. In addition to providing a media edge reference surface, first plate 602 may also serve as a support member for other components found in RMIT 100. For example, feed roller 150, backup roller 152 and its carrier 161 may be mounted on reference surface 604 via shaft 151, and posts 153, 159, respectively. On outer surface 605 of first plate 602, intermediary gear 158 and drive gear 160 are mounted on post 159 and shaft 151.

Referring again to FIG. 38, second plate 640 comprises a vertical portion 641, a horizontal portion 643 extending outwardly from the second plate and an alignment post 208F extending upwardly from horizontal portion and spaced from vertical portion 641. Second plate 640 is mounted atop side wall 204 and is aligned with front wall 102 of RMIT 100 when installed in housing 200. The surface of vertical portion 641 that faces toward RMIT 100 forms media reference surface 644 which surface may also form an end of media slots 230, 232. Front and rear legs 645F, 645R may extend upwardly from the top edge of vertical portion 641 to enclose an end of media slots 230, 232. Use of front and rear legs 645F, 645R extends the media reference surface 644 to be flush with a top surface of top 202 of housing 200. Alignment features 647 (see FIG. 42) may be provided on horizontal portion 643 for cooperation with corresponding alignment features provided on top of side wall 204A for controlling side-to-side and front-to-back positioning of second plate 640 atop of side wall 204A. A top portion of post 208F is tapered to ease the insertion of post 208F into opening 210 in the bottom of the superior unit.

Base plate 680, in addition to having a plurality of media guides 690 extending outwardly from media reference surface 684, provides support for various media feed rollers 692. As illustrated, 3 pairs of media feed rollers 692 are shown.

Figure 40:
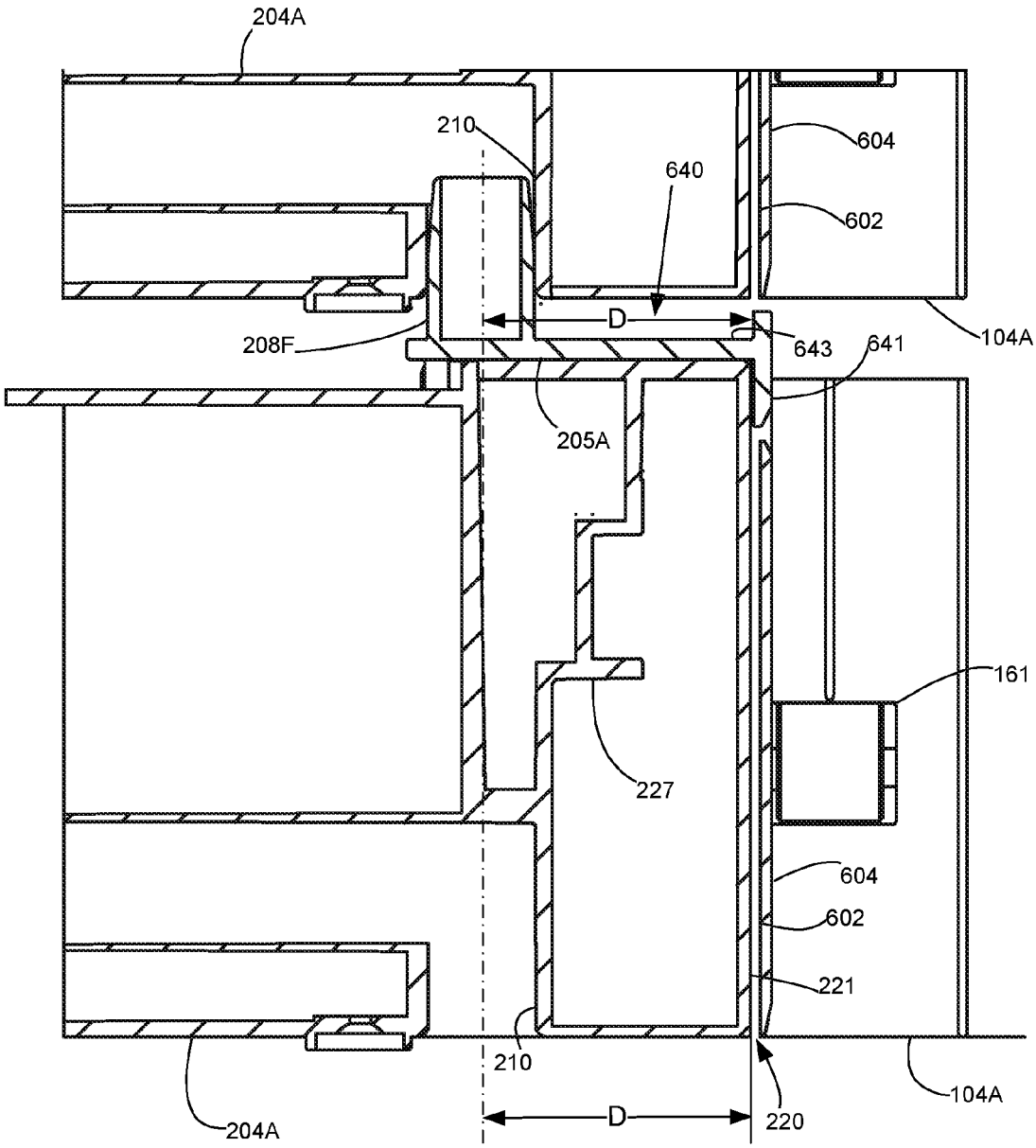
FIG. 40 illustrates the arrangement of portions of the media edge guide reference system within an option housing according to one example embodiment.

Referring now to FIG. 40, there is shown a sectional view of side wall 204A of housing 200 showing the internal structure of side wall 204A and the relationship between second plate 640 of the inferior unit and first plate 602 of the superior unit. For each option housing 200, extending between opening 210 to beneath the intersection of horizontal portion 643 with vertical portion 641 of second plate 640 is an internal rib 227 extending to a top portion 205A of side wall 204A. In one embodiment, because side wall 204A is molded, the distance D between the outer surface 221 of interior portion 220 and the center of opening 210, which is also the centerline of post 208F, may be tightly controlled. Also, distance D represents the distance from the back surface of vertical portion 641 to the centerline of post 208F. Further, the distance from the center of opening 210 to the front of side wall 204A is also closely controlled.

Figure 41:
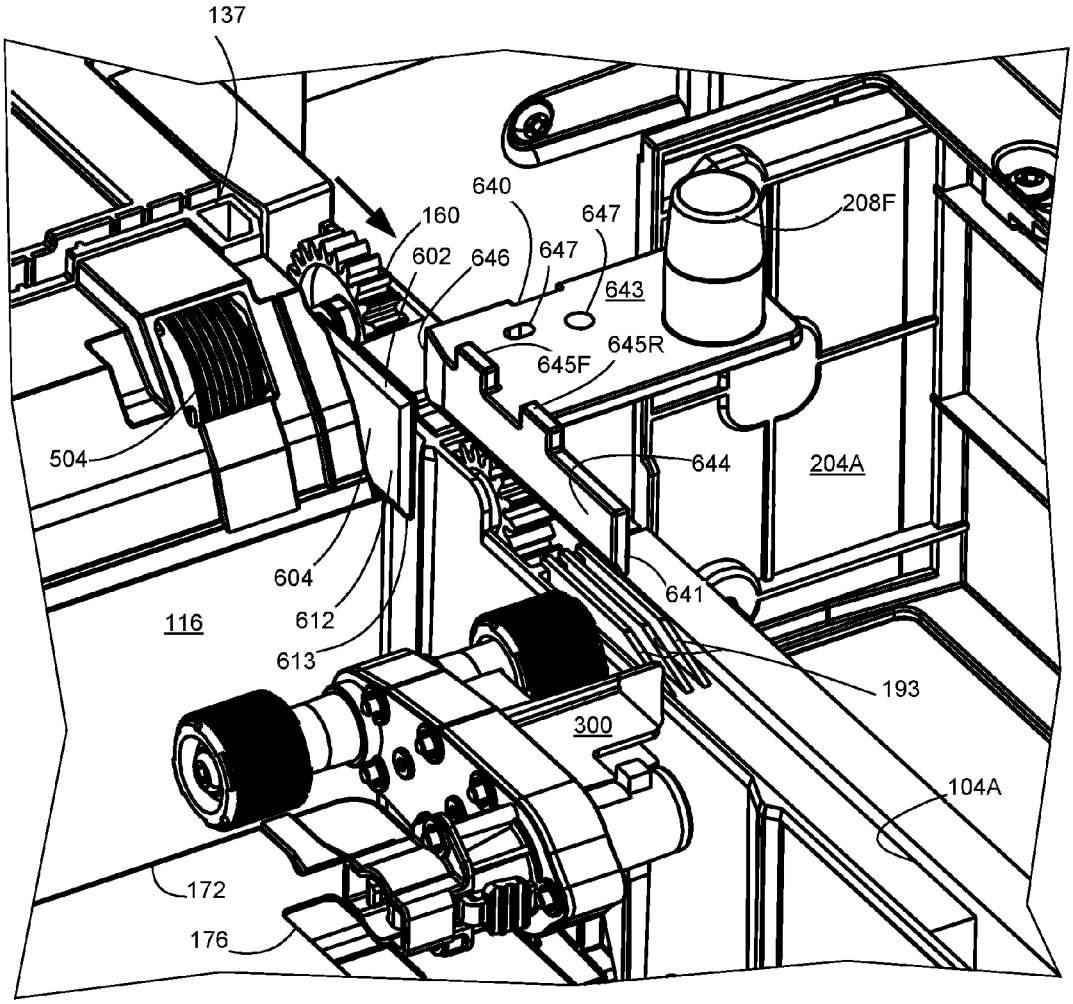
FIGS. 41 and 42 illustrate the alignment between two portions of the media edge guide reference system of FIGS. 37 and 38 as a media tray moves from an open position to an inserted position with an option housing.
Figure 42:
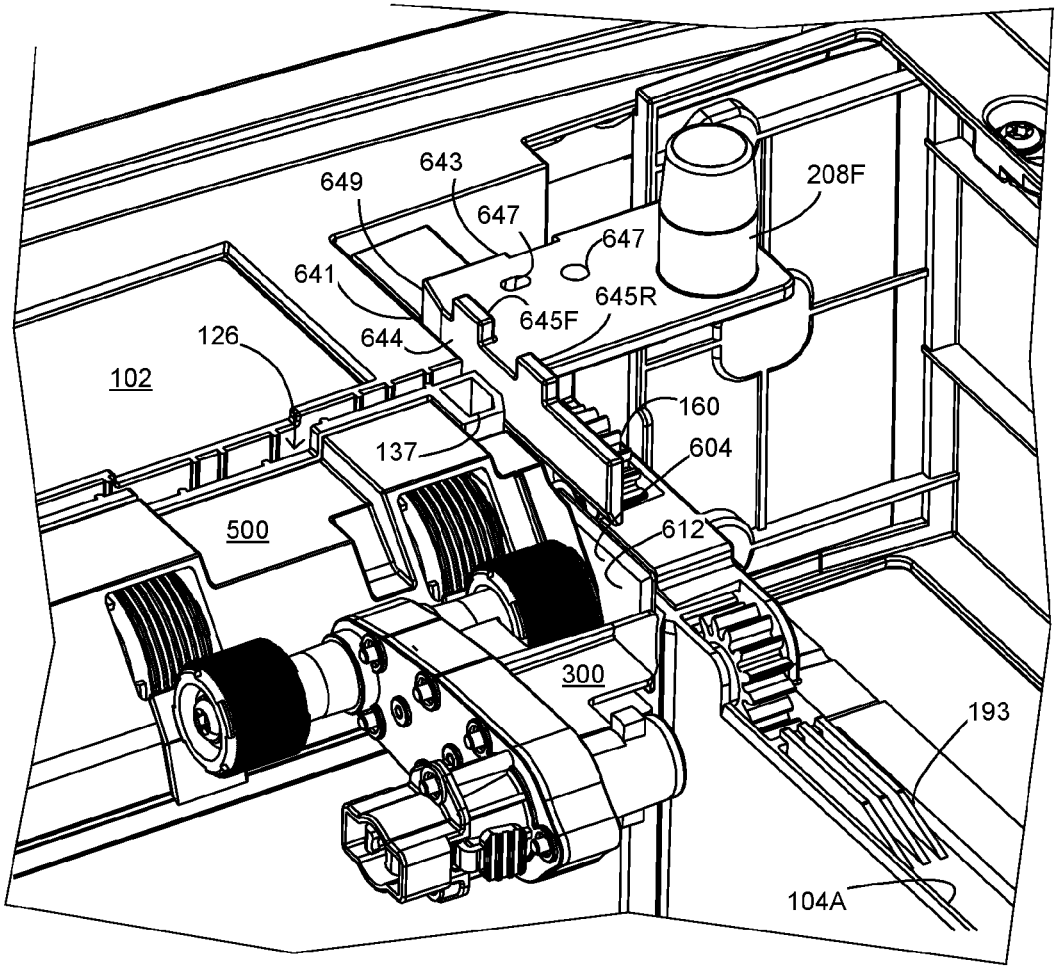
Figure 43:
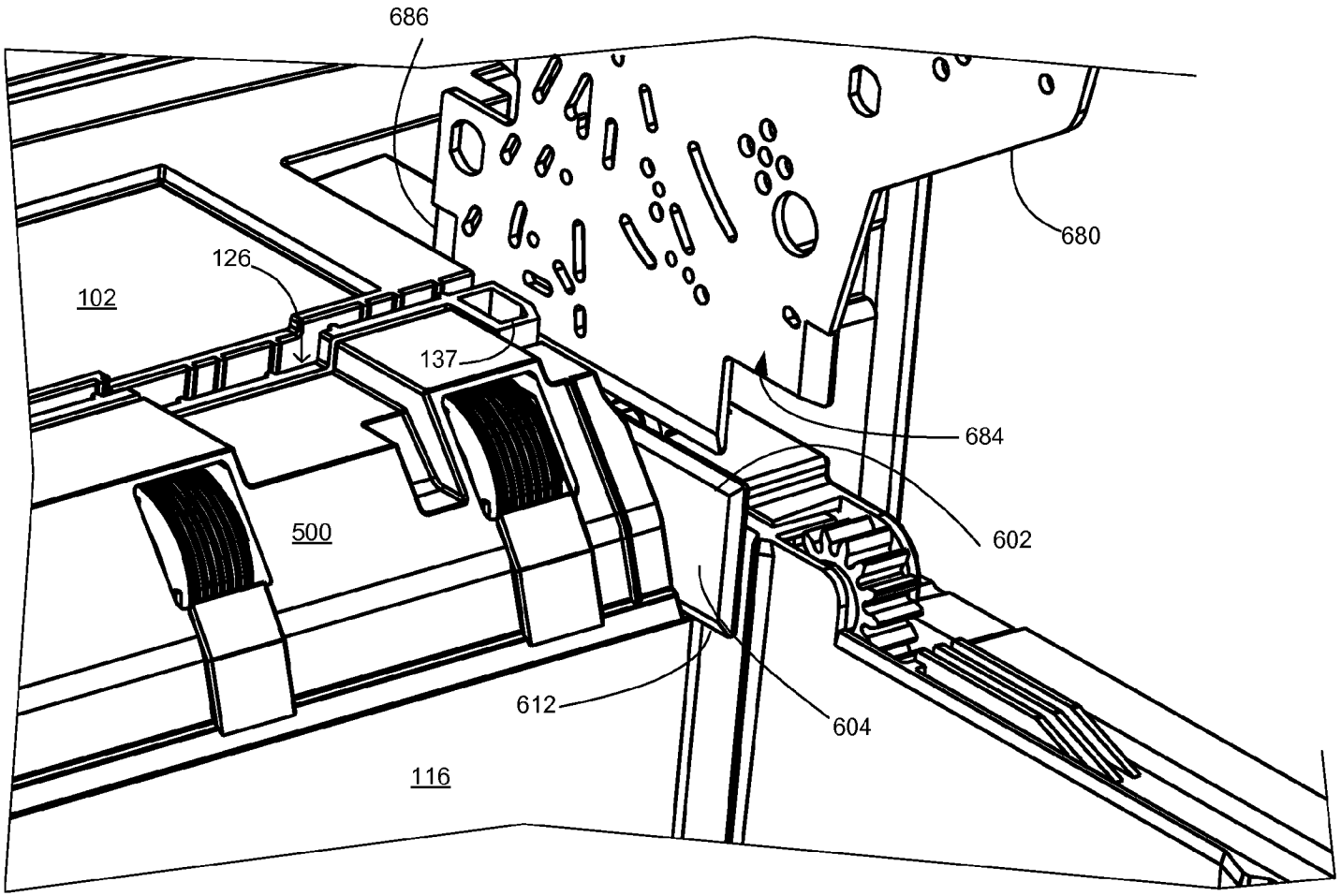
FIG. 43 illustrates another portion of the media edge guide alignment system of FIGS. 37 and 38 within IFD 2.

FIGS. 41 and 42 illustrate the aligning of first plate 602 with second plate 640 of RMIT 100 during insertion of RMIT 100 into housing 200. Components and structures obscuring the view of second plate 640 mounting atop side wall 204A have been removed and second plate 640 appears to be floating in the air. As RMIT 100 closes, rear edge 613 of first plate 602 approaches front edge 646. Both media reference surfaces 604, 644 are in the same vertical plane. In FIG. 42, RMIT is fully in position in housing 200. First and second plates 602, 640 are aligned with reference surface 604 enclosing the end of channel 126. FIG. 43 shows the alignment of first plate 602 with base plate 680 within IFD 2. The RMIT 100 is fully in position within housing 20 of IFD 2.

Because of alignment features found in option assemblies 50-1, 50-2 and IFD 2, the horizontal misalignment between each of the units due to tolerance stackup is between 0 mm and 0.25 mm or a total worst case horizontal misalignment of 0.50 mm for the two option assemblies and IFD 2 shown. Whereas in prior art systems of having an image forming device and two option assemblies, horizontal misalignment due to tolerance stackup was about +/−2 mm. Such a reduction in horizontal misalignment reduces skewing and jamming of fed media and improves the feed reliability of this enhanced device.

System Schematic

Figure 44:
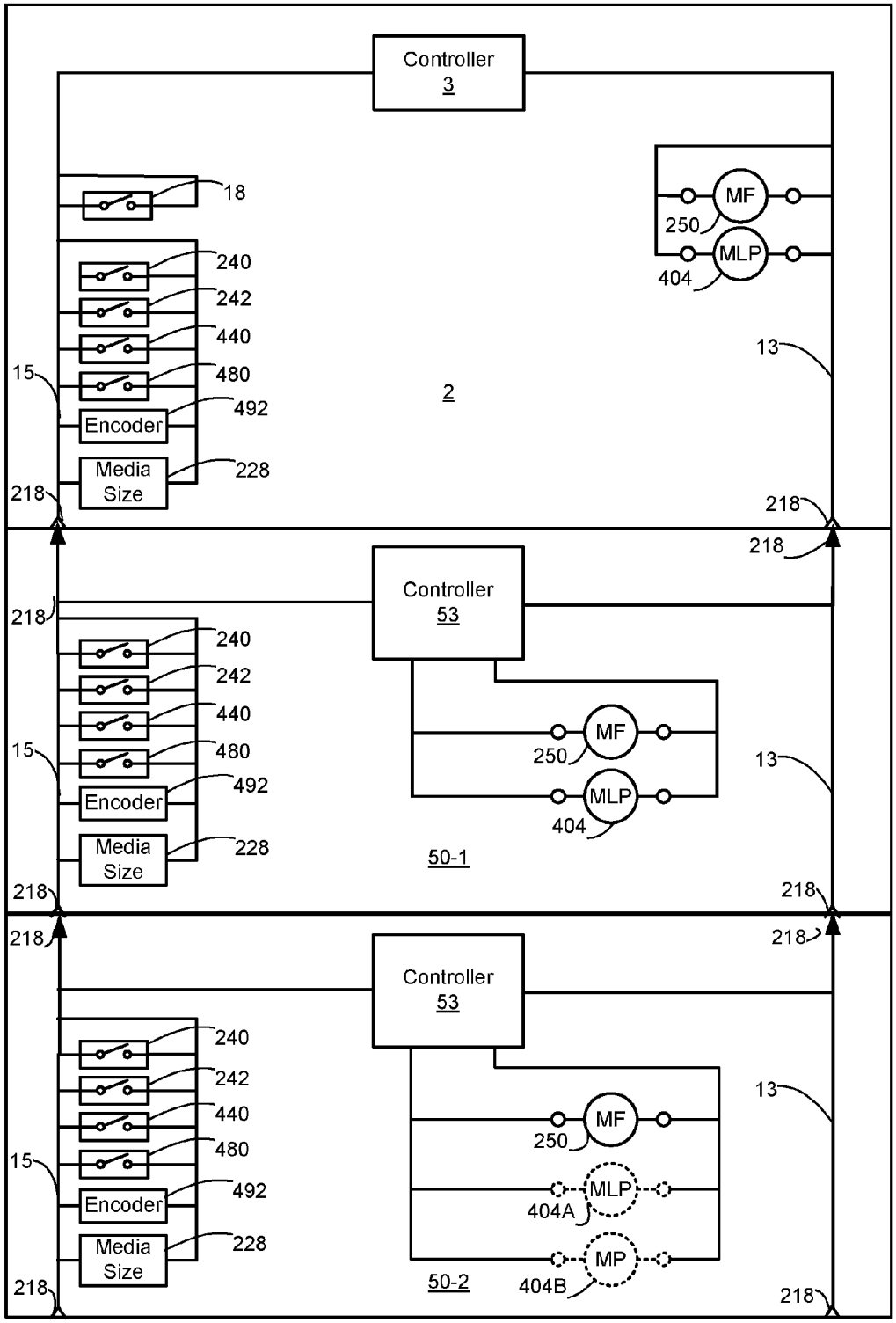
FIG. 44 is an electrical schematic of the sensors and motors used in the media input feed system of IFD2 and option assemblies 50 according to one example embodiment.

A basic schematic of the various sensors and motors used to feed media to IFD 2 is illustrated in FIG. 44. IFD 2 and with controller 3 is shown on top of two option assemblies 50-1 and 50-2. Communications links 13 and 15 from controller 3 are connected to each option assembly 50-1 and 50-2 via electrical connectors 218 as previously described. Media sensor 18 located in IFD 2 is shown connected to communications link 15, which is shown providing input signals to controller 3 while communications link 13 is shown providing output signals from controller 3. Communications links 13 and 15 may be one communications link. A media sensor 18 is provided adjacent base plate 680 at the location shown as arrow MS in FIG. 38. Also provided in IFD 2, are media sensor 240 for sensing media in channel 126, media sensor 242 for sensing media picked from RMIT 100, media out sensor 440 and index sensor 480, encoder wheel sensor 492 and media size sensor 228. Connected to communication link 13 are feed motor 250 that drives feed roller 150 and separator roller 504 and the drive motor 404 used for the drive mechanism that powers pick mechanism 300 and drives the lift arm and lift plate for indexing the media into the picking location.

In option assembly 50-1, connected to communications link 15, are media sensor 240 for sensing media in channel 126, media sensor 242 for sensing media picked from RMIT 100, media out sensor 440 and index sensor 480, encoder wheel sensor 492, media size sensor 228 and controller 53, all of which provide data used by controller 3. Connected to communication link 13 is controller 53 which receives communications from controller 3 for feeding media out of RMIT 100 and along media path extensions PX. Feed motor 250 that drives feed roller 150 and separator roller 504 and drive motor 404 used for the drive mechanism 400 that powers pick mechanism 300 and drives the lift arm 173 and lift plate 172, are controlled by controller 53.

In option assembly 50-2, again connected to communications link 15, are media sensor 240 for sensing media in channel 126, media sensor 242 for sensing media picked from RMIT 100, media out sensor 440 and index sensor 480, encoder wheel sensor 492, media size sensor 228 and controller 53. Like in option assembly 50-1, connected to communication link 13, is controller 53 which in turn is connected to feed motor 250 that drives feed roller 150 and separator roller 504. However, provided in option assembly 50-2 an alternate embodiment for the drive mechanism 400 is shown. Here two motors are provided in drive mechanism 400. Motor 404A is used to drive lift arm 173 to raise media M while motor 404B is used to drive pick mechanism 400. By providing two motors 404A and 404B, motor 404B can be run to move media counter to the media process direction prior to each media picking operation without causing the elevator lift arm 173 to move or index. The topmost media sheet is driven back against the rear media restraint 170 which will assure the leading edge of the topmost sheet of media will be located at a predetermined distance with respect to the pick location. (See FIG. 45). In one embodiment, the leading edge of media is about 10 mm downstream from the pick location. This may be done prior to each media fed operation. With a single motor in drive mechanism 400, the only time pick mechanism 300 is rotating counter to the media process direction to provide alignment of the leading edge of the topmost media sheet is when the elevator lift arm is being driven to perform an indexing operation. During normal feeding of media, pick mechanism 300 cannot be reversed prior to feeding each topmost sheet without causing an index move to occur.

Methods for Media Feeding

Figure 46:
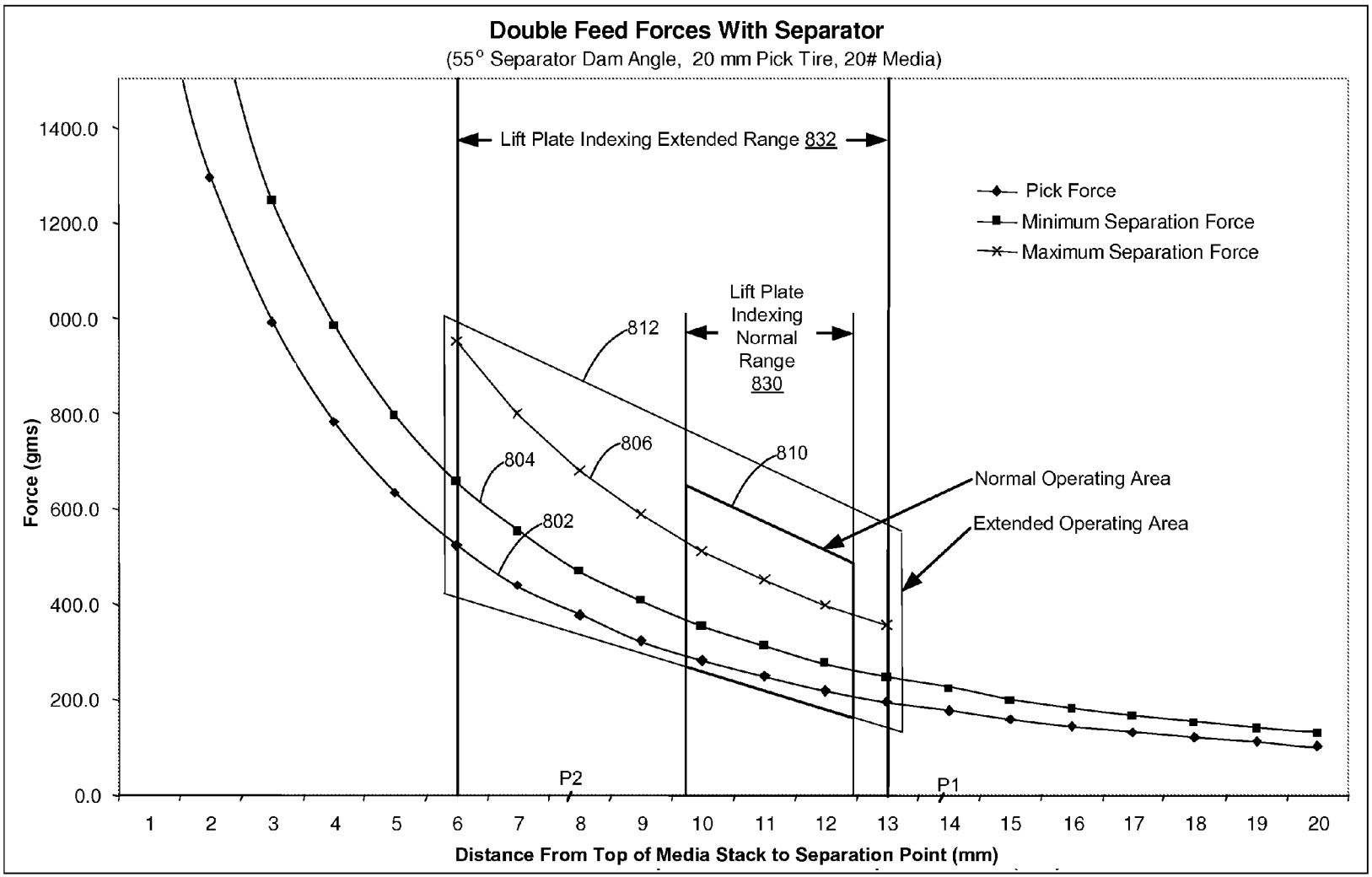
FIG. 46 is a graph of separation force versus distance from the top of the media to the separation point according to one example embodiment.

For the methods described herein, reference is made FIGS. 45 and 46. As discussed above, lift plate 172 is raised in indexed moves. Motor 404 raises lift plate 172 until index flag 357 of pick mechanism 300 changes the state of index sensor 480. This signals that pick mechanism 300 has reached the lowest desired pick location. In one embodiment, lift plate 172 continues to be raised a predetermined distance above the lowest pick point as determined by motor 404 rotation. For example, lift plate continues to raise approximately 2 mm, which is about the height of 20 sheets of 20 pound media. As media is fed, the pick mechanism moves downward to a point just beneath the lowest desired pick point where the index flags and changes the state of index sensor 480. This signals controller 3, 53 to again index lift plate 172 upward to the predetermined distance about the lowest desired pick point. For the exemplary 2 mm index move just described, the rotation movement of pick mechanism 300 is in an essentially linear motion, meaning that there is only a minute variance in the pick location of the topmost sheet. Lift plate 172 is raised periodically in an indexed move each time index flag 357 drops below index sensor 480. Thus media height positioning is accomplished with use of a single sensor and the rotation of motor 404 while the media is still being fed by pick mechanism 300 without having to wait for the trailing edge of the media to exit pick mechanism 300.

For example, assume that pick mechanism 400 had fed a media and has been turned off as it has been engaged subsequently by downstream feed rollers. Because of the light weight of pick mechanism 100, pick wheels 322 skid along the surface of the media being feed. At that point 712, when pick mechanism 300 is turned off, there is still a trailing portion of the media being fed that remains within the media storage location 140. The length of the trailing portion of the media remaining plus the amount of interpage gap 720 for the next media to be fed translates in an amount of time 730 available to perform an indexing move of lift plate 172. The amount of time is dependent on the process speed, the interpage gap and the length of media being fed. As all three are known, controller 53 can determine if enough time is available to perform an index move. Because with the present system, index moves are occurring in steps ranging from approximately 1 mm to approximately 3 mm, indexing moves take about 100 ms to occur and may be normally be performed on all standard size media such as A4, etc. and even media as short as A6.

In prior art systems, an indexing sensor is located within the tray within a few millimeters to the nominal location of the leading edge of media to be fed and the leading edge of the media and the trailing edge of the media being fed would have to be detected before an index move of a lift plate could occur. However, at this location, a reliable signal from the indexing sensor was difficult to achieve while media was moving past the indexing sensor. When the trailing edge of the media being fed cleared the indexing sensor, the indexing sensor could be reliably read. Thus, indexing move could not be initiated until the media being fed had exited the tray. This increases the interpage gap between successively fed media, as much as 250 mm in some prior art designs, decreasing throughput.

Further in prior art designs, the downward rotation movement of the pick mechanism into the media tray can result in the pick location moving as much as 60 mm leading to a high amount of uncertainty in the location of the leading edge of the media being feed. To account for this leading edge uncertainty, additional media edge sensors for sensing leading and trailing edges were suspended into the media storage location.

A method for determining the amount of media remaining in RMIT 100 is also provided. Lift plate 172 supporting a stack of media is raised toward pick mechanism 300 for feeding the media sheets by rotation of motor 404. As discussed above, where a single motor 404 is used to raise lift plate 172 and drive pick mechanism 300, lift plate 172 is raised when motor 404 rotates pick mechanism 300 opposite the media process direction. Conversely, when motor 404 drives pick mechanism 300 in the media process direction, lift plate 172 is held in place. Each time lift plate 172 is raised or indexed, controller 3, 53 determines an amount of rotation of motor 404 and stores this value in memory 8. The amount of rotation of motor 404 can be determined by counting the number of pulses of encoder wheel 490 as motor 404 rotates. Each time RMIT 100 is removed from housing 20, lift plate 172 falls to bottom 108 of RMIT 100. When RMIT 100 is re-inserted into housing 20, lift plate 172 is then raised from bottom surface 108 until index sensor 357 changes the state of index sensor 480. As a result, embodiments include those wherein each time RMIT 100 is removed from housing 20, the determined amount of rotation of motor 404 is reset. Because lift plate 172 is raised from bottom 108 of RMIT 100 each time RMIT 100 is removed and re-inserted into housing 20 when RMIT 100 is relatively empty, motor 404 must rotate a number of times in order to raise lift plate 172 to desired pick height. In contrast, when the RMIT 100 is relatively full, relatively few rotations are necessary to raise lift plate 172 to the desired pick height. Accordingly, by tracking the number of rotations of motor 404 in the direction of rotation used to raise lift plate 172, controller 3, 53 is able to estimate the amount of media remaining in RMIT 100.

IFD 2 provides an indication of an amount of media sheets remaining in each RMIT 100 based on the determined amount of rotation of its respective motor 404 used to raise lift plate 172. In some embodiments, when the number of rotations of motor 404 exceeds a predetermined threshold, IFD 2 signals that the amount of media sheets remaining in RMIT 100 is low. Alternatives include those wherein IFD 2 displays an estimate of the amount of media sheets remaining in RMIT 100 in the form of a "gas gage." Embodiments include those wherein IFD 2 then signals that RMIT 100 is empty when flag arm 442 falls through opening 176 in lift plate 172. The signal or gas gage may be provided on display 34. Alternatively, the tray low or tray empty status may be displayed on an indicator light such as an LED indicator light. Alternatives include those wherein the signal or gas gage is provided on a display device of a peripheral unit such as a computer 16 connected to IFD 2 either directly or indirectly via a communications link.

An issue arises when RMIT 100 is removed when IFD 2 is turned off. If this occurs, the amount of rotation of motor 404 stored in memory 8 may no longer be indicative of the amount of media remaining in RMIT 100 as a result of the removal of RMIT 100. First, removal of RMIT 100 causes lift plate 172 to fall to the bottom 108. Second, media may have been added to or subtracted from RMIT 100 when it was removed. The amount of rotation of motor 404 stored in memory 8 will not take into account the change in position of lift plate 172 or the added or subtracted media. When IFD 2 is turned on, controller 3, 53 determines whether lift plate 172 needs to be raised based on the status of index sensor 480. When lift plate 172 needs to be raised when the power is turned on, in order to correct the amount of rotation of motor 404 stored in memory 8, controller 3, 53 determines whether the number of rotations of motor 404 required to raise lift plate 172 exceeds a predetermined amount of rotation associated with a nominal index. If it does, this indicates that RMIT 100 was removed while IFD 2 was turned off and controller 3, 53 resets the amount of rotation of motor 404 stored in memory 8 as of the beginning of the index operation. This helps ensure that the amount of rotation of motor 404 stored in memory 8 reflects the current status of the media remaining in RMIT 100.

While the present example embodiment of a method for determining the amount of media remaining in RMIT 100 discusses the use of a single motor 404 to raise lift plate 172 and drive pick mechanism 300, it will be appreciated that the method is equally applicable in embodiments wherein separate motors 404A raise lift plate 172 and motor 404B drive pick mechanism 300, respectively. In such embodiments, controller 3, 53 tracks the number of rotations of motor 404A in the direction that raises the lift plate 172. The number of motor rotations is then used to provide an indication of the amount of media remaining in RMIT 100.

Referring to FIG. 45, a method for positioning and feeding media into a media feed path is also provided. Pick mechanism 300 is driven in the media process direction to move a first or topmost media sheet 702 from the top of the stack of media sheets in media storage location 140 in the media process direction from an initial pick position 710 into the media feed path P, media path extension PX or media path branch PB leaving a second media sheet 704 at the top of the stack of media sheets. Leading edge 702L of topmost media sheet 702 moves tangentially over and atop separator rollers 504 that rotate opposite the media process direction. While trailing edge 702T has not exited from beneath pick wheels 322, topmost sheet 702 is being bent to conform to the angle of the media dam contact surface 502 as it is fed by pick mechanism 300. This applies a normal force against separator rollers 504 and the lower surface of topmost sheet 702 acts as a nip with respect to a following sheet that is double fed or shingle fed with the topmost sheet. If topmost and following media sheets 702, 704 are double fed or shingle fed, leading edge 704L of the following media sheet 704 strikes separator rollers 504 in a non-tangential direction and the rotation of separator rollers 504 counter to the process direction together with the nip force applied by topmost sheet 702 skives off and stops further motion of following media sheet 704 in the media process direction at about separation point 701 immediately upstream and adjacent separator rollers 504. Skiving of following sheet 704 is achieved in part due to the reactionary force received from separator rollers 504 and applied to following sheet 704. The leading edge of the media sheet refers to the edge of the media sheet closest to the entrance to media path P, media path extension PX or media path branch PB. Double feeding refers to a condition when both the topmost and following sheets are fed together with their leading edges substantially aligned. Shingle feeding refers to a condition where the topmost and following sheets are fed together, but the leading edge of the following sheet is upstream of or lags behind leading edge 702L of topmost sheet 702 usually about 1-5 mm up to the length of the page. After topmost media sheet 702 is fed, if following media sheet 704 was double or shingled fed with topmost media sheet 702, leading edge 704L of following media sheet 704 may be at separation point 701 on media dam 500 directly upstream and adjacent to separator rollers 504. If following media sheet 704 was not shingled fed, it will be positioned such that the pick position for it will be pick position 710. It is also possible that the following media sheet may have been partially shingled fed such that its leading edge is located somewhere between initial pick position 710 and separation point 701 after topmost media sheet 702 is fed. In some embodiments, this distance may range from 6-10 mm. As illustrated, the distance between separation point 701 and pick position 710 is about 20 mm and this would be the maximum amount of uncertainty 700 in the location of the leading edges. As illustrated, the distance D1 between pick wheels 322 and separator rollers 504 is about 10 mm.

In media storage location 140, pick mechanism 300 is then driven opposite the media process direction, to move following media sheet 704, opposite the media process direction away from the entrance to the media feed path until leading edge 704L of following media sheet 704 reaches a known predetermined position in the media storage location thereby reducing uncertainty regarding the location of the leading edge. In some embodiments, following media sheet 704 is moved opposite the media process direction until trailing edge 704T of the sheet contacts rear media restraint 170 thereby positioning leading edge 704L and pick position 710 at known locations. In those embodiments that do not include a rear media restraint 170, following media sheet 704 may be moved opposite the media process direction until trailing edge 704T contacts the rear wall 106. Embodiments include those wherein pick mechanism 300 is driven opposite the media process direction for a set amount of time such that, in some cases, after the trailing edge of the media sheet contacts rear media restraint 170 or rear wall 106, pick mechanism 300 continues to rotate opposite the media process direction. However, the weight of pick mechanism 300 is low enough that the normal force applied by pick mechanism 300 is small enough to allow pick wheels 322 to slip against the surface of the media sheet. This aids in preventing pick mechanism 300 from wrinkling or bending the media sheet by excessively forcing it against rear media restraint 170 or rear wall 106. After leading edge 704L of the following media sheet 704 reaches the known predetermined position, pick mechanism 300 is driven in the media process direction to move following media sheet 704 in the media process direction from the stack of media sheets M into media feed path P, media path extension PX or media path branch PB.

In addition to reducing leading edge uncertainty 700 by moving leading edge 704L of following media sheet 704 to a known location, rotation of pick mechanism 300 opposite the media process direction prior to feeding following sheet 704 helps eliminate leading edge uncertainty that occurs as a result of backlash in drive transmission 304 and drive transmission 401. When pick mechanism 300 is driven opposite the media process direction, each of the gears in respective drive transmissions 304, 401 are moved all the way to one end. At this point, the total backlash in the system is known and can be accounted for. This substantially eliminates the leading edge uncertainty that occurs as a result of drive transmission backlash. Leading edge uncertainty 700 is further reduced through the use of lift plate 172 which limits the pick height to a discrete rotational range of pick mechanism 300. In normal operation for the illustrated systems, media is indexed in about 2 mm increments, meaning the pick mechanism 300 rotates through about 2.5 degrees of rotation. This, in turn, limits the leading edge uncertainty that occurs as a result of change in the distance from the initial pick position due to such rotation. By reducing leading edge uncertainty, interpage gap 720 between successive media sheets can be reduced. In turn, IFD 2 is able to feed media at a higher rate of speed with the same linear velocity of each page. In those embodiments where IFD 2 includes an image transfer section, reduced leading edge uncertainty also aids in image transfer, as precise knowledge of the position of the media sheet is necessary in order to accurately place an image on a media sheet.

In those embodiments that include a common motor 404 for driving pick mechanism 300 and raising lift plate 172, media is moved opposite the media process direction when lift plate 172 is raised as a result of index flag 357 changing the state of index sensor 480. Alternative embodiments include those wherein pick mechanism 300 and lift plate 172 are driven by separate motors and those wherein no lift plate 172 is included such that pick mechanism 300 gradually descends as media is fed from RMIT 100 in order to remain in contact with the topmost media sheet. In these embodiments, pick mechanism 300 may be driven opposite the media process direction after each pick in order to move the next media sheet opposite the media process direction until its leading edge reaches a known predetermined location and a known pick location.

A further media feeding method is also provided. The method provides for varying the separation force depending upon the weight of the media experiencing misfeed problems. Referring to FIG. 46, shown are four curves 802, 804, 806, and 820 indicating the relationship between the distance in millimeters from the top of the media stack to the separation point at separator rollers 504 (along the X axis) and the force in grams (along the Y axis). The distance measurement is essentially a vertical measurement taken from the top of the media stack on elevator lift plate 172. All four curves exhibit the same general shape in that as distance from the top of the media stack to the separation point decreases, sheet separation force increases in a non-linear manner. Curves 802, 804, and 806 increase in an asymptotic manner as the distance decreases. Curve 802 shows the amount of force provided by pick mechanism 300. Curves 804 and 806 show the maximum and minimum reactionary separation forces provided by separator rollers 504. Two separation force curves are provided to account for component variance in separator rollers, media contact surfaces, etc. Curves 802, 806 and 806 were developed using 20 mm diameter pick wheels 322, 20 pound paper as the media, and a media contact surface 502 that forms a 125 degree angle with respect to bottom 108 of RMIT 100 (conversely media contact surface 502 can be said to form a 55 degree angle with respect to the top of rear portion 116 of front wall 102). It will be realized, that in order to reliably separate double fed and shingle fed media, the separation force needs to be greater than the pick mechanism feed force over the chosen indexing range and the operating range. Operating areas 810, 812 are chosen, usually by testing, to provide sufficient force for feeding media and separating media of different types over all indexing ranges without having forces of an upper magnitude that could damage media while also have forces of a lower magnitude that can still feed and separate media. For the illustrated curves, it was empirically determined that the maximum distance from the top of the media stack to the separation point distance would be about 13 mm (a lower extent of the range) and still have enough force for reliably feeding and separating media and conversely, the minimum distance from the top of the media stack to the separation point distance was chosen to be about 6 mm (an upper extent of the range) to limit the force so as to prevent damage to the media.

Within the lift plate indexing normal range 830, chosen to be from between a normal upper extent at about 10 mm to a normal lower extent at about 12 mm, distance between the top of the media stack to the separation point along curve 804, the maximum separation force varies in a substantially linear fashion from about 390 grams to about 250 grams, along curve 806, the minimum separation force varies in a substantially linear fashion from 550 grams to about 390 grams, and along curve 802, the pick force varies in a substantially linear fashion from about 250 grams to about 200 grams. This is designated normal operating area 810. Similarly, within the lift plate indexing extended range 832, chosen to be from between an extended upper extent at about 6 mm to an extended lower extent at about 13 mm distance from the top of the media stack to the separator point, the minimum separation force along curve 804 varies in a nonlinear fashion from about 650 grams to about 250 grams, along curve 806, the maximum separation force varies in a nonlinear fashion from 980 grams to about 380 grams, and along curve 802, the pick force varies in a nonlinear fashion from about 550 grams to about 200 grams. This is designated extended operating space 812. Other normal and extended operating areas 810, 812 may be used.

When feeding media, if double feeds or shingle feeds occur with heavier weight media, separation forces will be increased by indexing elevator lift plate 172 upward. As previously described, index sensor 480 is provided, which changes state due to motion of index flag 357 on pick mechanism 300. Because elevator lift plate 172 is indexed only in one direction, upward, index sensor 480 is positioned at a predetermined point P1 that is either at or beyond the lower extent of the extended operating range 812. For example, P1 may be located at a point where the top of the media stack would be 15 mm from the separation point. It is at this point P1 where further rotation of motor 404 to raise lift plate 172 is tracked. As the elevator lift plate 172 is raised from the bottom 108 of RMIT 100, pick mechanism 300 will eventually come into contact with the top of the media stack and will be raised, along with the media stack, to the predetermined point P1 at which index flag 357 actuates sensor 480. From this point P1, the lower extent in the lift plate indexing extended range 832 and extended operating area 812 can be established by tracking motor 404 rotation or point P1 may be used to set such lower extent of lift plate indexing extended range 812. For normal operation, continued rotation of motor 404 beyond point P1 is measured until the 12 mm distance from the top of the media stack to the separation point is achieved setting the lower normal extent in the lift plate indexing normal range 830 and operating area 810. A subsequent 2 mm normal index move to reach the 10 mm distance reaching the upper extent of normal operating area 810 is made. During normal media feeding and indexing operations, as media is fed, the distance from the top of the media stack to the separation point varies between 10 mm to 12 mm, at which an index move raises the top of the media stack to 10 mm from the separation point.

In order to achieve a lower than normal separation force for lighter weight media, feeding of the lighter weight media would occur when the distance from the top of the media stack to the separation point was at, for instance, 13 mm rather than 12 mm. Separation forces are decreased by resetting the elevator lift plate by pulling RMIT 100 outwardly from its housing 20, 200, reinserting it and then indexing elevator lift plate 172 up until the top of the media stack reaches point P1 at which media sensor 480 changes state. To achieve a higher than normal separation force, resetting the elevator lift plate is not required, indexing of elevator lift plate 172 would continue until the distance from the top of the media stack to the separation point was at a predetermined point P2 between about 6 mm and about 10 mm.

Figure 47:
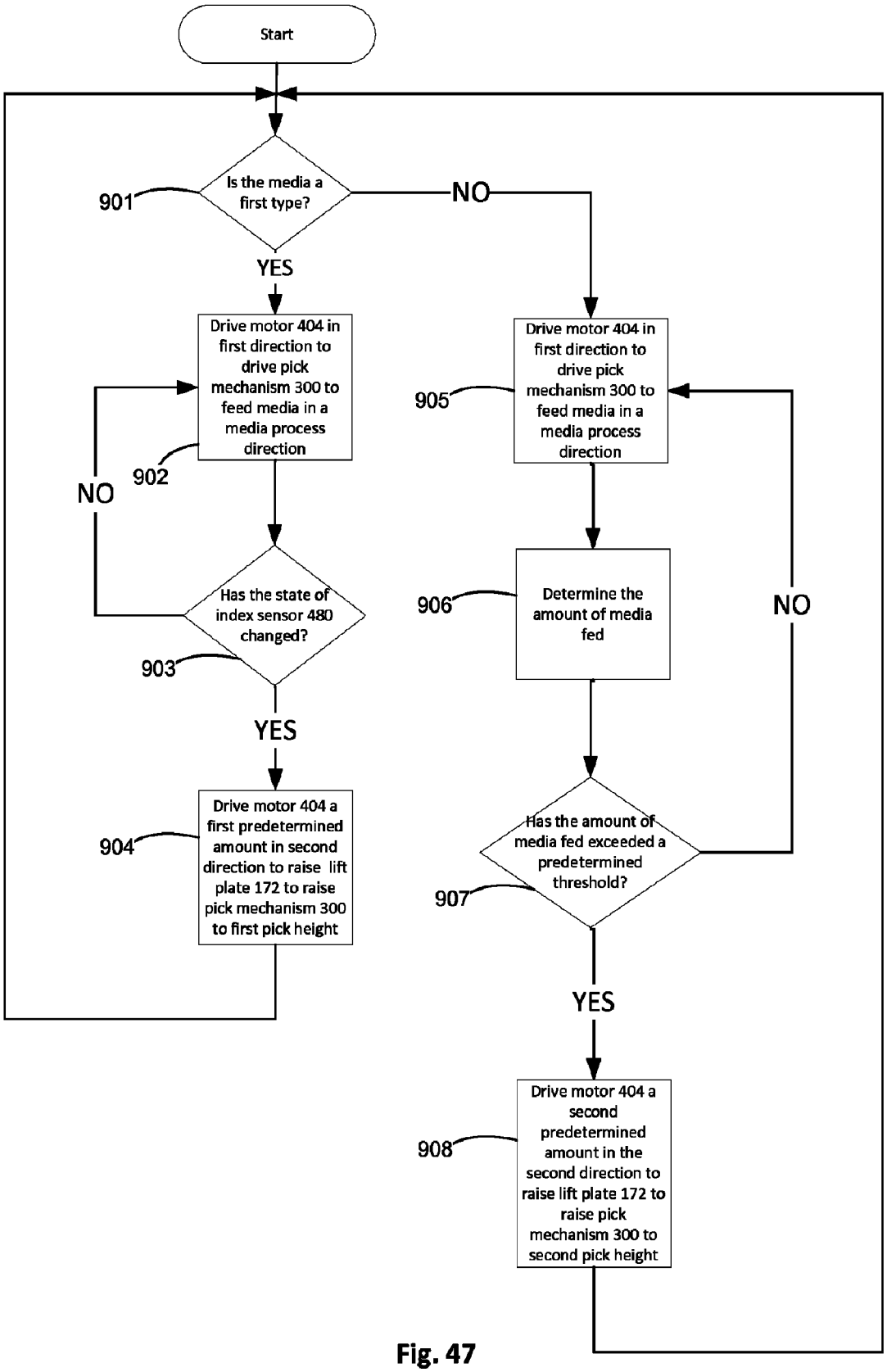
FIG. 47 is a flowchart of a method for adjusting media position based on media type according to one example embodiment.

Accordingly, in some embodiments, media position is adjusted based on media type. With reference to FIG. 47, at step 901, controller 3, 53 first determines the type of media on lift plate 172. The media type may be indicated by a user, for example, at user interface 7 or at a peripheral device. Alternatives include those wherein the controller 3, 53 determines the media type based on the position of actuators 142. When the media is a first media type that does not require adjustment of the separation force outside of the normal range 830, indexing is performed as described above. At step 902, motor 404 is driven in a first direction to drive pick mechanism 300 for feeding the media in the media process direction such that as media is fed, the height of pick mechanism 300 decreases. At step 903, between each pick, the controller 3, 53 determines if the height of the pick mechanism has fallen below predetermined level, for example by determining whether index flag 357 has changed the state of index sensor 480. At step 904, when the height of pick mechanism 300 falls below the predetermined level, motor 404 is driven a first predetermined amount of rotation in a second direction, opposite the first direction, to raise lift plate 172 to raise pick mechanism 300 to a first desired pick height. As discussed above, in some embodiments, motor 404 raises lift plate 172 until the increase in height of pick mechanism 300 changes the state of index sensor 480 and then motor 404 rotates the first predetermined amount of rotation. In other embodiments, indexing is performed solely based on encoder 490 pulses. Once index flag 357 drops below index flag 480 thereby indicating that an index is required, motor 404 rotates the first predetermined amount of rotation without regard to when index flag 357 changes the state of index sensor 480 as a result of the increase in height of lift plate 172.

Conversely, when the media is a second type that requires increased or decreased separation force outside of the normal range 830, a modified index operation is performed. At step 905, motor 404 is driven in a first direction to drive pick mechanism 300 for feeding the media in the media process direction such that, as media is fed, the height of pick mechanism 300 decreases. Rather than analyzing whether index flag 357 has changed the state of index sensor 480, at step 906, controller 3, 53 determines the amount of media fed since the last index, for example, by counting the number of media fed or by determining an amount of rotation of motor 404 in the first direction. At step 907, controller 3, 53 determines whether the amount of media fed has exceeded a predetermined threshold indicating that pick mechanism 300 has reached or is about to reach the minimum pick height. At step 908, once the number of media exceeds the predetermined threshold, motor 404 is driven a second predetermined amount of rotation in the second direction to raise lift plate 172 to raise pick mechanism 300 to a second desired pick height different from the first desired pick height. If the second desired pick height is above the first desired pick height, then (1) the distance from the second desired pick height to the separation point is less than the distance from the first desired pick height to the separation point and (2) a reaction force applied by separator rollers 504 to a media sheet fed from the second desired pick height is greater than the reaction force applied by separator rollers 504 to a media sheet fed from the first desired pick height. In contrast, if the second desired pick height is below the first desired pick height, then (1) the distance from the second desired pick height to the separation point is less than the distance from the first desired pick height to the separation point and (2) the reaction force applied by separator rollers 504 to a media sheet fed from the second desired pick height is less than the reaction force applied by separator rollers 504 to a media sheet fed from the first desired pick height. Accordingly, it will be appreciated that the separation force can be modified by altering the timing and amount of indexing that is performed depending on media type.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A method for adjusting media position for media to be fed in an image forming device, comprising:

determining a media type for a stack of media sheets on a raisable lift plate;

when the media type determined is a first media type:

driving a motor in a first direction to drive a pick mechanism for feeding media in a media process direction from the stack of media sheets such that as media is fed the height of the pick mechanism decreases;

determining if the height of the pick mechanism has fallen below a predetermined level based on whether a sensor adjacent to the pick mechanism has changed from a first state to a second state as a result of the decrease in height of the pick mechanism; and when the height of the pick mechanism falls below the predetermined level, driving the motor a first predetermined amount of rotation in a second direction opposite the first direction to raise the lift plate in order to raise the pick mechanism to a first desired pick height; and when the media type determined is a second media type:

driving the motor in the first direction to drive the pick mechanism for feeding media in the media process direction from the stack of media sheets such that as media is fed the height of the pick mechanism decreases;

determining at least one of a number of media fed and an amount of rotation of the motor in the first direction; and when the at least one of the number of media fed and the amount of rotation of the motor in the first direction exceeds a predetermined threshold, driving the motor a second predetermined amount of rotation in the second direction to raise the lift plate in order to raise the pick mechanism to a second desired pick height different from the first desired pick height.

2. The method of claim 1, wherein the state of the sensor is changed by a flag arm extending from the pick mechanism.

3. The method of claim 1, wherein the state of the sensor is analyzed between each media feed when the motor is not being driven in the first direction.

4. The method of claim 1, wherein driving the motor the first predetermined amount of rotation in the second direction and driving the motor the second predetermined amount of rotation in the second direction raise the lift plate between about 1 mm and about 10 mm.

5. The method of claim 1, wherein the first predetermined amount of rotation of the motor in the second direction and the second predetermined amount of rotation of the motor in the second direction are determined using an output from an encoder wheel coupled to the motor.

6. The method of claim 1, wherein the amount of rotation of the motor in the first direction is determined using an output from an encoder wheel coupled to the motor.

7. The method of claim 1, further comprising when the media type determined is the first media type and the height of the pick mechanism falls below the predetermined level, before driving the motor the first predetermined amount of rotation in the second direction, driving the motor in the second direction to raise the lift plate until the increase in height of the pick mechanism changes the sensor from the second state to the first state.

8. The method of claim 1, further comprising:

at least one separator roller positioned downstream from and forming an open nip with the pick mechanism rotatable counter to the media process direction for separating a following media sheet from the topmost media sheet at a separation point if the following media sheet is double fed with the topmost media sheet;

wherein when the second desired pick height is above the first desired pick height then the distance from the second desired pick height to the separation point is less than the distance from the first desired pick height to the separation point and a reaction force applied by the at least one separator roller to a media sheet fed from the second desired pick height is greater than the reaction force applied by the at least one separator roller to a media sheet fed from the first desired pick height, and when the second desired pick height is below the first desired pick height then the distance from the second desired pick height to the separation point is less than the distance from the first desired pick height to the separation point and the reaction force applied by the at least one separator roller to a media sheet fed from the second desired pick height is less than the reaction force applied by the at least one separator roller to a media sheet fed from the first desired pick height.

* * * * *